US009981303B2

(12) United States Patent
Vrabie et al.

(10) Patent No.: US 9,981,303 B2
(45) **Date of Patent: *May 29, 2018**

(54) TUBE EXPANDER FOR HEAT EXCHANGER COIL UNITS

(71) Applicant: FIRST CO., Dallas, TX (US)

(72) Inventors: Sergiu Vrabie, Trophy Club, TX (US); Anthony Garrett Orchard, Plano, TX (US); Jessie Doria, Dallas, TX (US); Irving George Pennini, Prosper, TX (US)

(73) Assignee: FIRST CO., Dallas, TX (US)

( * ) Notice: Subject to any disclaimer, the term of this patent is extended or adjusted under 35 U.S.C. 154(b) by 7 days.

This patent is subject to a terminal disclaimer.

(21) Appl. No.: 15/202,892

(22) Filed: Jul. 6, 2016

(65) Prior Publication Data

US 2016/0311009 A1 Oct. 27, 2016

Related U.S. Application Data

(63) Continuation of application No. 14/482,626, filed on Sep. 10, 2014, now Pat. No. 9,409,225.

(51) Int. Cl.

| | |
|---|---|
| ***B21D 53/06*** | (2006.01) |
| ***B21D 39/08*** | (2006.01) |
| ***B21D 43/00*** | (2006.01) |
| ***B21D 39/06*** | (2006.01) |
| ***B21D 53/08*** | (2006.01) |

(52) U.S. Cl.

CPC ..... *B21D 53/06* (2013.01); *B21D 39/06* (2013.01); *B21D 39/08* (2013.01); *B21D 43/003* (2013.01); *B21D 53/085* (2013.01)

(58) Field of Classification Search

CPC ..... B21D 39/08; B21D 39/20; B21D 39/203; B21D 39/206; B21D 41/02; B21D 41/026; B21D 41/028; B21D 53/06; B21D 43/003; B23P 19/02; B23P 19/027

See application file for complete search history.

(56) References Cited

U.S. PATENT DOCUMENTS

| | | | |
|---|---|---|---|
| 4,980,966 | A | 1/1991 | Milliman et al. |
| 5,003,691 | A | 4/1991 | Milliman et al. |
| 5,220,722 | A | 6/1993 | Milliman |
| 5,353,496 | A | 10/1994 | Harman et al. |
| 2013/0213105 | A1 | 8/2013 | Milliman |

OTHER PUBLICATIONS

Notice of Allowance dated Apr. 6, 2016 in U.S. Appl. No. 14/482,626 (8 pages).

*Primary Examiner* — Debra Sullivan
(74) *Attorney, Agent, or Firm* — Haynes and Boone LLP

(57) ABSTRACT

A tube expander for heat exchanger coil units according to which a tubular expansion process is conducted. In one aspect, the tube expander includes a fixture, which includes a back unit and first and second door assemblies movably connected thereto. One or more heat exchanger coil units are adapted to be connected to each of the first and second door assemblies. In another aspect, the fixture is adjustable to accommodate different heat exchanger coil units. In yet another aspect, the tubular expansion process is not permitted when the first or second door assembly is closed and a sensor does not sense the presence of a latch bar.

22 Claims, 31 Drawing Sheets

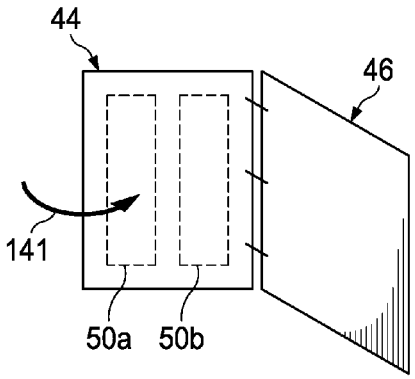
Fig. 18a
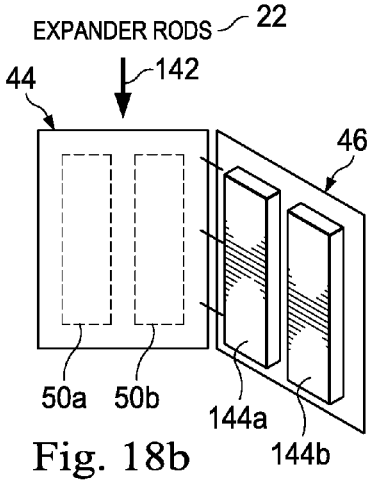
Fig. 18b
Fig. 18c
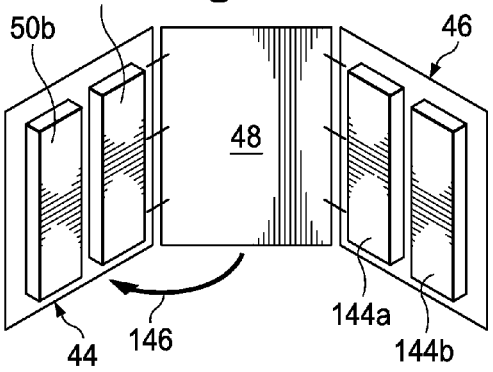
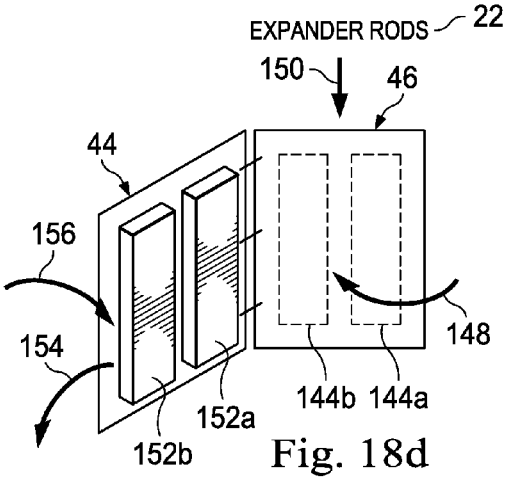
Fig. 18d
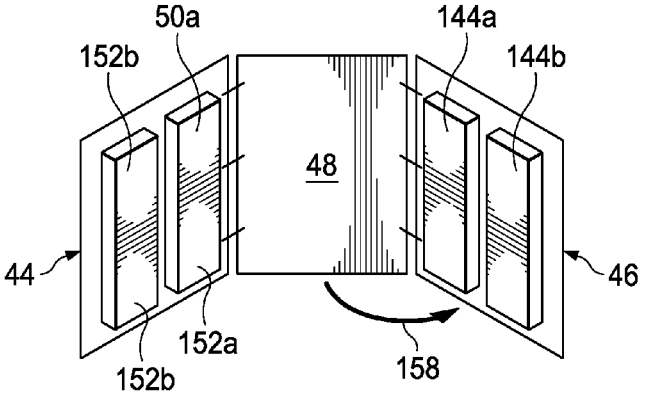
Fig. 18e

TUBE EXPANDER FOR HEAT EXCHANGER COIL UNITS

CROSS-REFERENCE TO RELATED APPLICATION

This application is a continuation of U.S. application Ser. No. 14/482,626, filed Sep. 10, 2014, the entire disclosure of which is hereby incorporated herein by reference.

TECHNICAL FIELD

The present disclosure relates in general to heat exchanger coil units and, in particular, to a tube expander for heat exchanger coil units.

BACKGROUND

A tube expander may be a ram-driven machine typically used in the manufacture of heat exchanger components. The tube expander uses multiple tipped expander rods to form interference fits between tubes and a stack of fins by expanding the tubes into the fins. The finished assembly is often referred to as a slab or coil, and may also be referred to as a heat exchanger coil unit (or "coil unit"). The coil unit may have an initial configuration in which it is a loose assembly of tubes and fins, and a finished configuration in which the tubes are expanded and form interference fits between the tubes and fins. In a vertical tube expander, the coil unit, in its initial configuration that includes a loose assembly of tubes and fins, is placed under a collection of vertically oriented, fixed center, tipped expander rods. Upon actuation, the tipped expander rods are rammed into the open ends of the tubes in the assembly, and the tubes are expanded. The tube ends are flared, the expander rods are withdrawn, and the coil unit, now in its finished configuration, is removed and replaced with another loose tube-and-fin assembly the tubes of which are ready to be expanded.

In some cases, one or more sets of individual doors are provided with the vertical tube expander, which doors vary in height and are not connected to the vertical tube expander. Each door is used to secure the loaded, or installed, position of the coil unit(s) within the vertical tube expander. An operator may "square" a set of door mounting points, snug side constraints to the coil unit(s), and adjust the door hinges for a proper fit. However, after the coil unit(s) have been installed within the vertical tube expander, an operator must wait until the tubular expansion process within the coil unit(s) is completed and the coil units are in their finished configuration before removing the coil units and then using the door to secure the loaded, or installed, position of one or more additional coil units (in their initial, loose tube-and-fin configuration) within the vertical tube expander. Such a "load-then-wait" process increases the time it takes to manufacture several coil units. Further, if the door is not properly locked, the door may accidentally open during the tubular expansion process, that is, during the ramming of the tipped expander rods into the respective open ends of the tubes in the loose assembly and the subsequent expansion of the tubes. Additionally, for each coil unit having a different height, width, or depth, the vertical tube expander must be reconfigured to accept and contain the associated loose tube-and-fin assembly such that the tubes are precisely located, relative to the tipped expander rods. Typical reconfiguration procedures increase the time it takes to manufacture coil units having variances in height, width, or depth.

Therefore, what is needed is an apparatus, kit, system, or method that addresses one or more of the above-described issues, and/or one or more other issues.

BRIEF DESCRIPTION OF THE DRAWINGS

FIGS. 18*a*-18*e* are diagrammatic views of the fixture of FIGS. 1, 2, 11-14, and 17 during different steps of the method of FIG. 16, according to respective exemplary embodiments.

DETAILED DESCRIPTION

Figure 1:
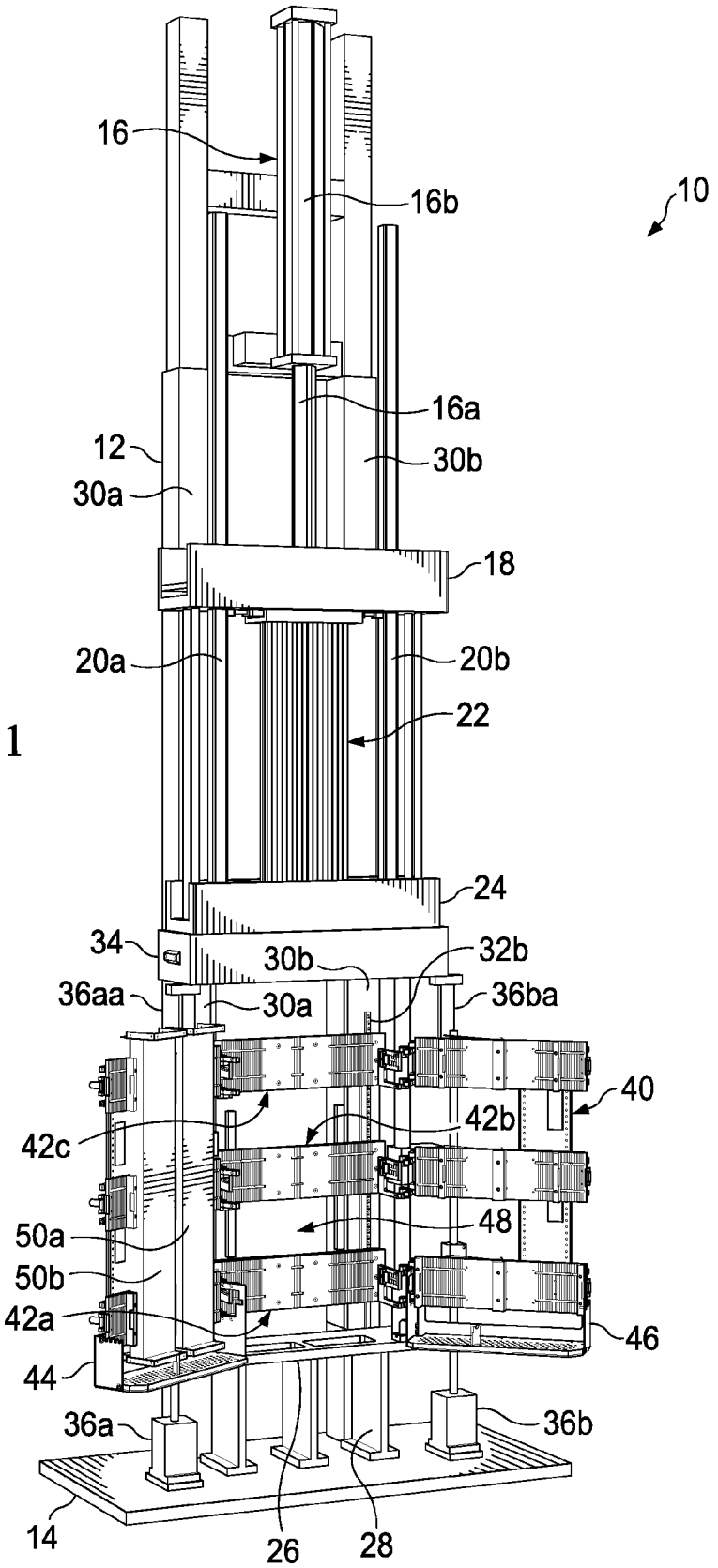
FIG. 1 is a perspective view of a tube expander for heat exchanger coil units according to an exemplary embodiment.

In an exemplary embodiment, as illustrated in FIG. 1, a tube expander for heat exchanger coil units is generally referred to by the reference numeral 10 and includes a frame 12 mounted on a base 14. An actuator 16 is connected to the frame 12. The right door actuator 16 includes a rod 16*a*, which is adapted to reciprocate relative to a cylinder 16*b*. To so reciprocate, the rod 16*a* is adapted to extend out from, and retract into, an end of the cylinder 16*b*. In an exemplary embodiment, the actuator 16 is a hydraulic actuator. In an exemplary embodiment, the actuator 16 is a ram-style actuator. A pressure plate 18 is connected to the rod 16*a* of the actuator 16. The pressure plate 18 is adapted to move vertically in response to the movement of the rod 16*a*. The frame 12 includes vertically-extending guide rods 20*a* and 20*b*, which extend through the pressure plate 18. The rods 20*a* and 20*b* are adapted to guide the pressure plate 18 during its vertical movement.

A plurality of expander rods 22 extend downward from the pressure plate 18. Although not shown, the respective lower end portions of the expander rods 22 are tipped, that is, include downwardly-directed bullet-shaped ends that are adapted to expand tubes of a tube-and-fin assembly so that interference fits are created, between the tubes and the fins, in response to the vertical downward movement of the rod 16*a*, the pressure plate 18, and the expander rods 22. The expander rods 22 extend through a plurality of openings (not shown), which are formed in a stationary guide plate 24, so that the lower end portions of the expander rods 22 are aligned with the tubes to be expanded. In an exemplary embodiment, the expander rods 22 extend through one or more additional guide plates (not shown), which are vertically positioned between the pressure plate 21 and the stationary guide plate 24. In an exemplary embodiment, the guide rods 20*a* and 20*b* are connected to the stationary guide plate 24.

Figure 2:
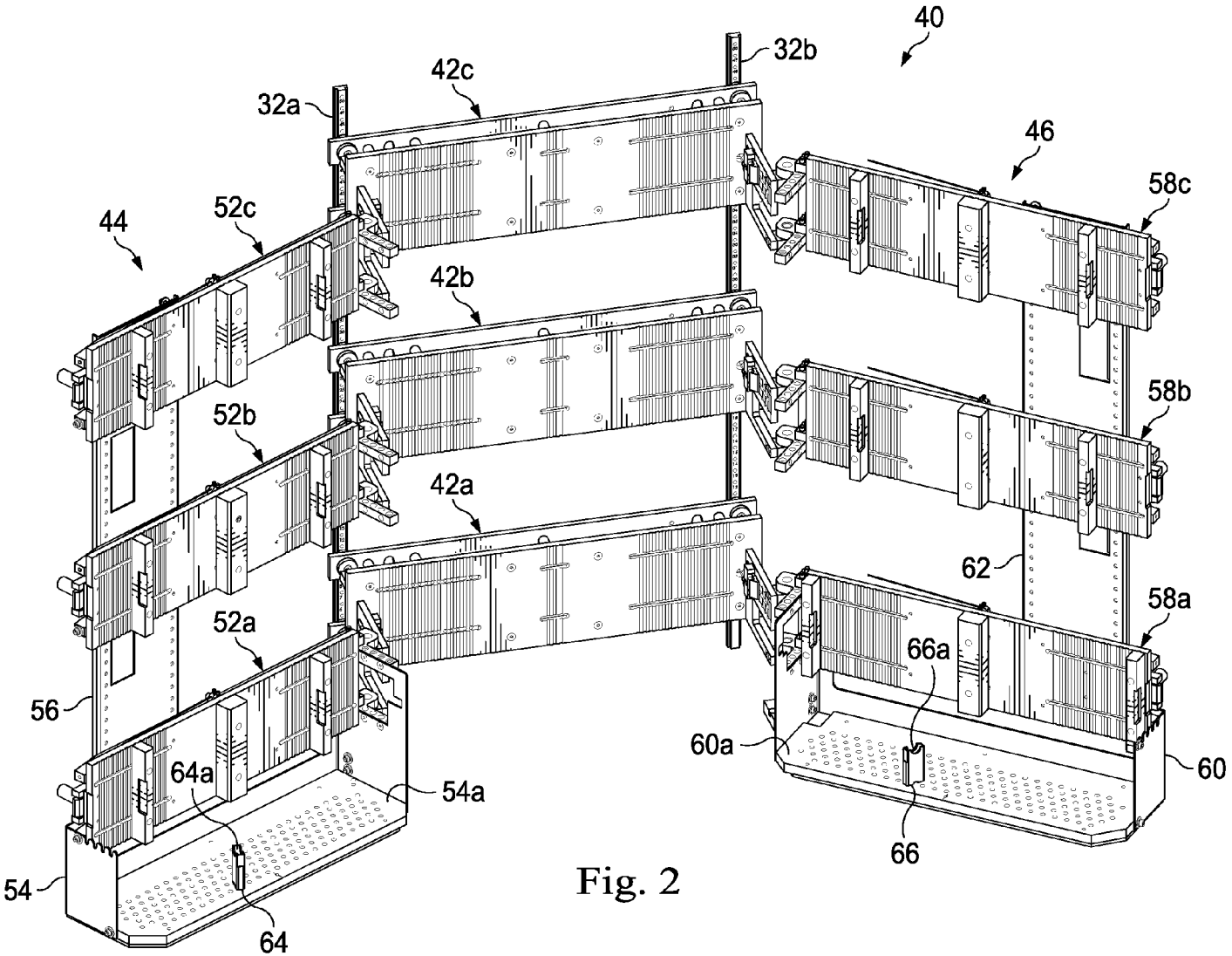
FIG. 2 is a perspective view of a fixture of the tube expander of FIG. 1 according to an exemplary embodiment, the fixture including a plurality of back units, a plurality of left door units, and a plurality of right door units.

A horizontal support 26 is mounted to the base 14 via downwardly-extending structural members 28. The frame 12 further includes parallel-spaced vertical supports 30*a* and 30*b*. T-tracks 32*a* and 32*b* are connected to the vertical supports 30*a* and 30*b*, respectively (the T-track 32*a* is shown in FIG. 2). In several exemplary embodiments, each of the T-tracks 32*a* and 32*b* is omitted in favor of a single, constrained, replaceable bar including a plurality of vertically-spaced threaded holes formed therein. An upper shroud 34 is connected to the frame 12 and/or the stationary guide plate 24. The upper shroud 34 includes a plurality of openings (not shown) formed therethrough; the openings are aligned with respective ones of the openings formed through the stationary guide plate 24 so that the expander rods 22 are permitted to extend through the upper shroud 34. In an exemplary embodiment, at least one of the stationary guide plate 24 and the upper shroud 34 is omitted from the tube expander 10. Post assemblies 36*a* and 36*b* are mounted on the base 14 and include rods 36*aa* and 36*ba*, respectively, which rods extend upwards and are connected to the upper shroud 34.

A fixture 40 is connected to the frame 12 and is vertically disposed between the upper shroud 34 and the horizontal support 26. The fixture 40 includes back units 42*a*, 42*b*, and 42*c*, a left door assembly 44, and a right door assembly 46. The back units 42*a*, 42*b*, and 42*c* are connected to the T-tracks 32*a* and 32*b*, thereby connecting the fixture 40 to the frame 12. The fixture 40 defines an internal region 48, which is positioned below the expander rods 22. Each of the back units 42*a*, 42*b*, and 42*c* at least partially defines the internal region 48. Representative heat exchanger coil units, or coil units, 50*a* and 50*b* are connected to the left door assembly 44. As will be described in further detail below, the coil units 50*a* and 50*b* are adapted to be loaded or installed in the internal region 48 in order to undergo a tubular expansion process using the expander rods 22. Two coil units identical to the coil units 50*a* and 50*b* are adapted to be connected to the right door assembly 46, and are adapted to be loaded or installed in the internal region 48 in order to undergo a tubular expansion process using the expander rods 22. As will be described in further detail below, instead of the coil units 50*a* and 50*b*, one or more other types or sizes of coil units may be connected to the left door assembly 44. Likewise, instead of coil units that are identical to the coil units 50*a* and 50*b*, one or more other types or sizes of coil units may be connected to the left door assembly 44. In several exemplary embodiments, the left door assembly 44 and the right door assembly 46 are mirror images of each other about the centerline of the set of expander rods 22.

In an exemplary embodiment, as illustrated in FIG. 2 with continuing reference to FIG. 1, the left door assembly 44 includes left door units 52*a*, 52*b*, and 52*c*, a left door lower shroud 54 connected to the left door unit 52*a*, and a left door brace 56, which is connected to each of the left door units 52*a*, 52*b*, and 52*c*. The left door units 52*a*, 52*b*, and 52*c* are movably connected to the back units 42*a*, 42*b*, and 42*c*, respectively. As shown in FIG. 2, the left door units 52*a*, 52*b*, and 52*c* are hingedly connected to the back units 42*a*, 42*b*, and 42*c*, respectively. The left door units 52*a*, 52*b*, and 52*c* are hingedly connected on the respective left side portions of the back units 52*a*, 52*b*, and 52*c*, as viewed in FIG. 2. Similarly, the right door assembly 46 includes right door units 58*a*, 58*b*, and 58*c*, a right door lower shroud 60 connected to the right door unit 58*a*, and a right door brace 62, which is connected to each of the right door units 58*a*, 58*b*, and 58*c*. The right door units 58*a*, 58*b*, and 58*c* are movably connected to the back units 42*a*, 42*b*, and 42*c*, respectively. As shown in FIG. 2, the right door units 58*a*, 58*b*, and 58*c* are hingedly connected to the back units 42*a*, 42*b*, and 42*c*, respectively. The right door units 58*a*, 58*b*, and 58*c* are hingedly connected on the respective right side portions (opposing the left side portions) of the back units 52*a*, 52*b*, and 52*c*, as viewed in FIG. 2.

A receiver 64 is positioned on a horizontally-extending surface 54*a* defined by the left door lower shroud 54. The receiver 64 includes a U-shaped cavity 64*a* adapted to receive a 180-degree hairpin bend of one of the tubes in the coil unit 50*b*. The receiver 64 supports the coil unit 50*b* when the coil unit 50*b* is connected to the left door assembly 44. Although not shown, additional receivers, each of which is identical to the receiver 64, are positioned on the horizontally-extending surface 54*a* to receive respective hairpin bends of the other tubes of the coil unit 50*b*, as well as tubes of the coil unit 50*a*. Likewise, a receiver 66 is positioned on a horizontally-extending surface 60*a* defined by the right door lower shroud 60. The receiver 66 includes a U-shaped cavity 66*a* adapted to receive a 180-degree hairpin bend of one of the tubes in one of the coil units adapted to be connected to the right door assembly 46; the receiver 66 supports the one coil unit when the one coil unit is connected to the right door assembly 46. Although not shown, additional receivers, each of which is identical to the receiver 66, are positioned on the horizontally-extending surface 60*a* to receive respective hairpin bends of the other tubes of the one coil unit, as well as tubes of the other of the coil units adapted to be connected to the right door assembly 46.

Figure 3:
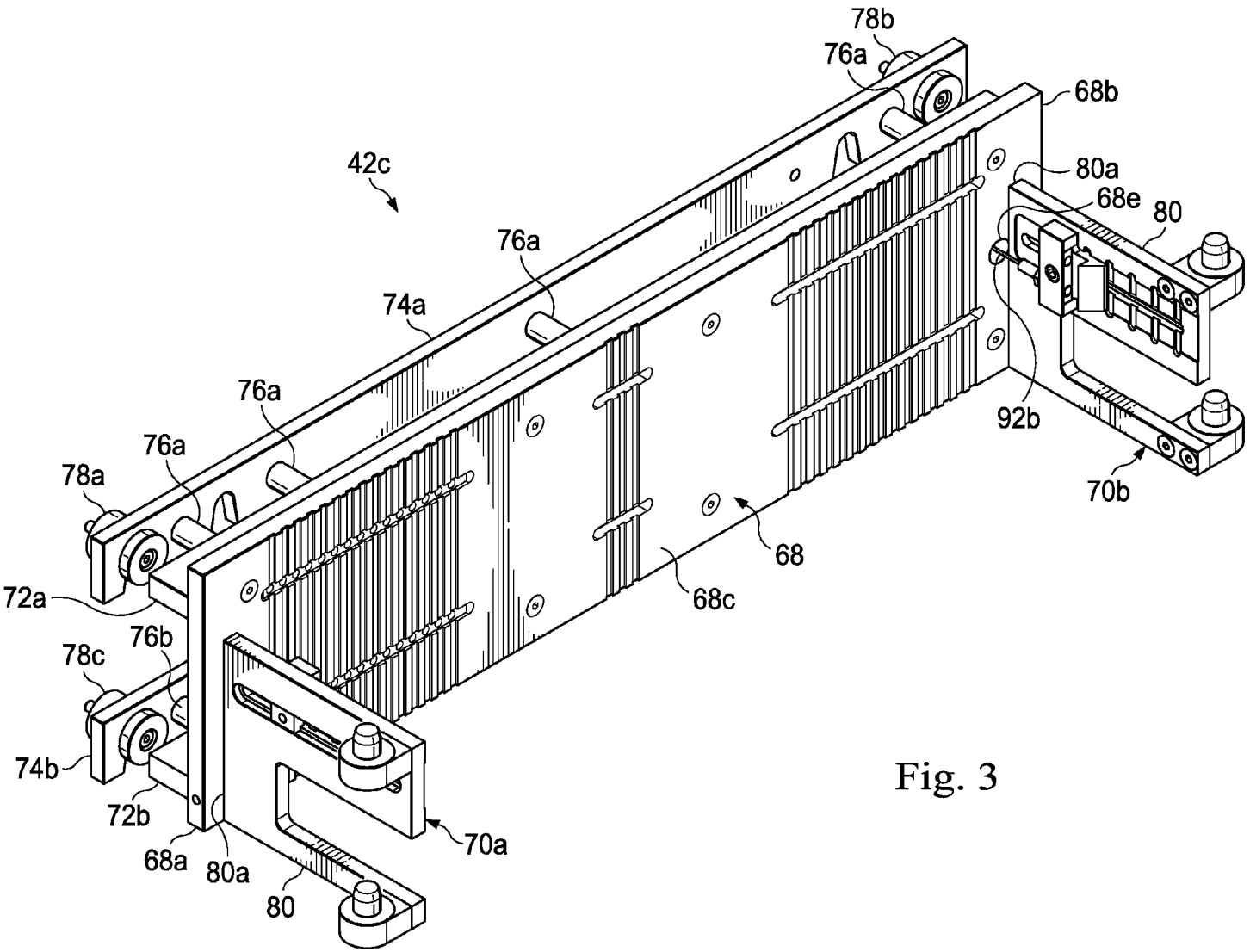
FIG. 3 is a perspective view of one of the back units of the fixture of FIGS. 1 and 2, according to an exemplary embodiment.
Figure 4:
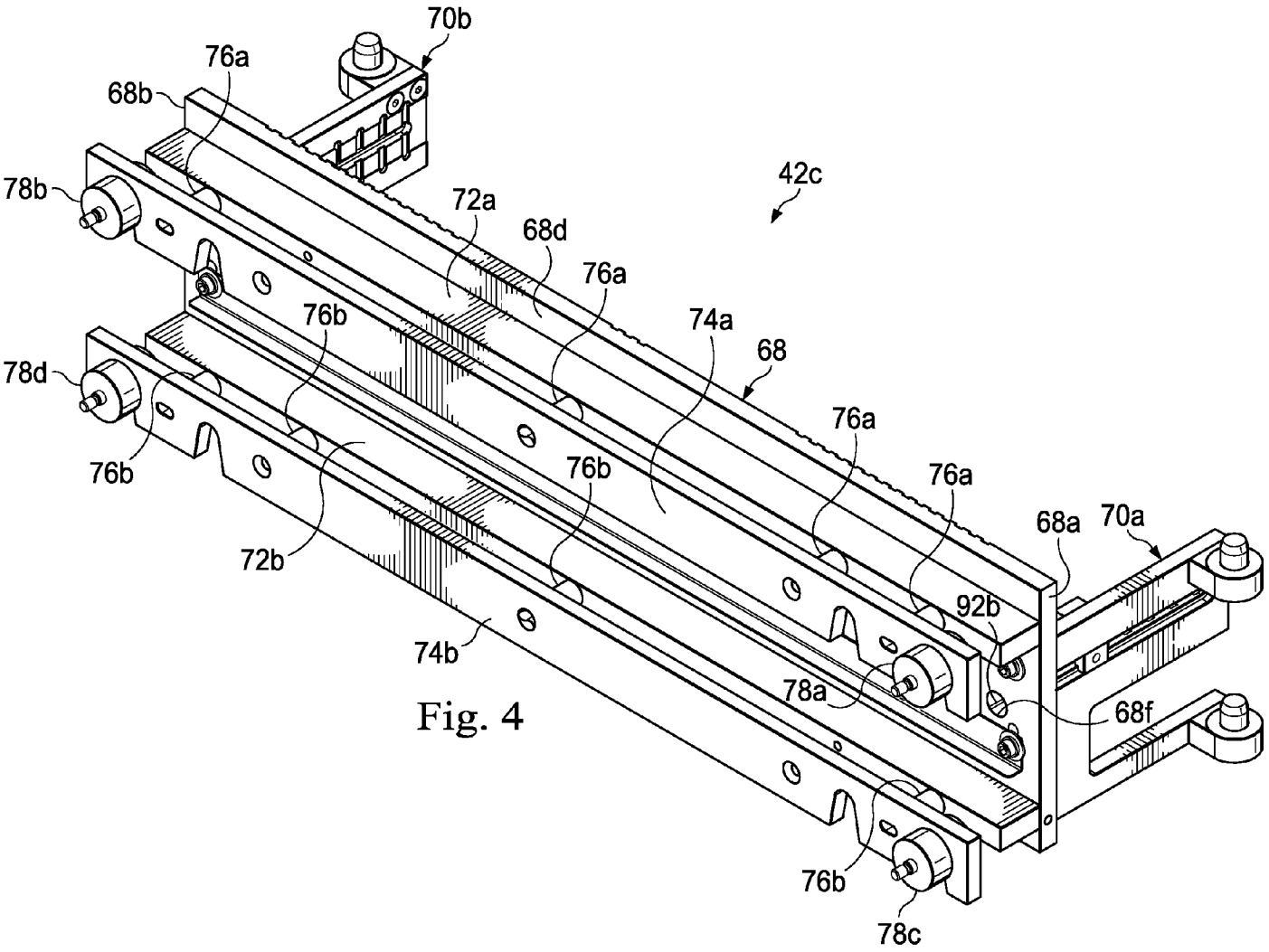
FIGS. 4 and 5 are additional perspective views of the back unit of FIG. 3, according to an exemplary embodiment.
Figure 5:
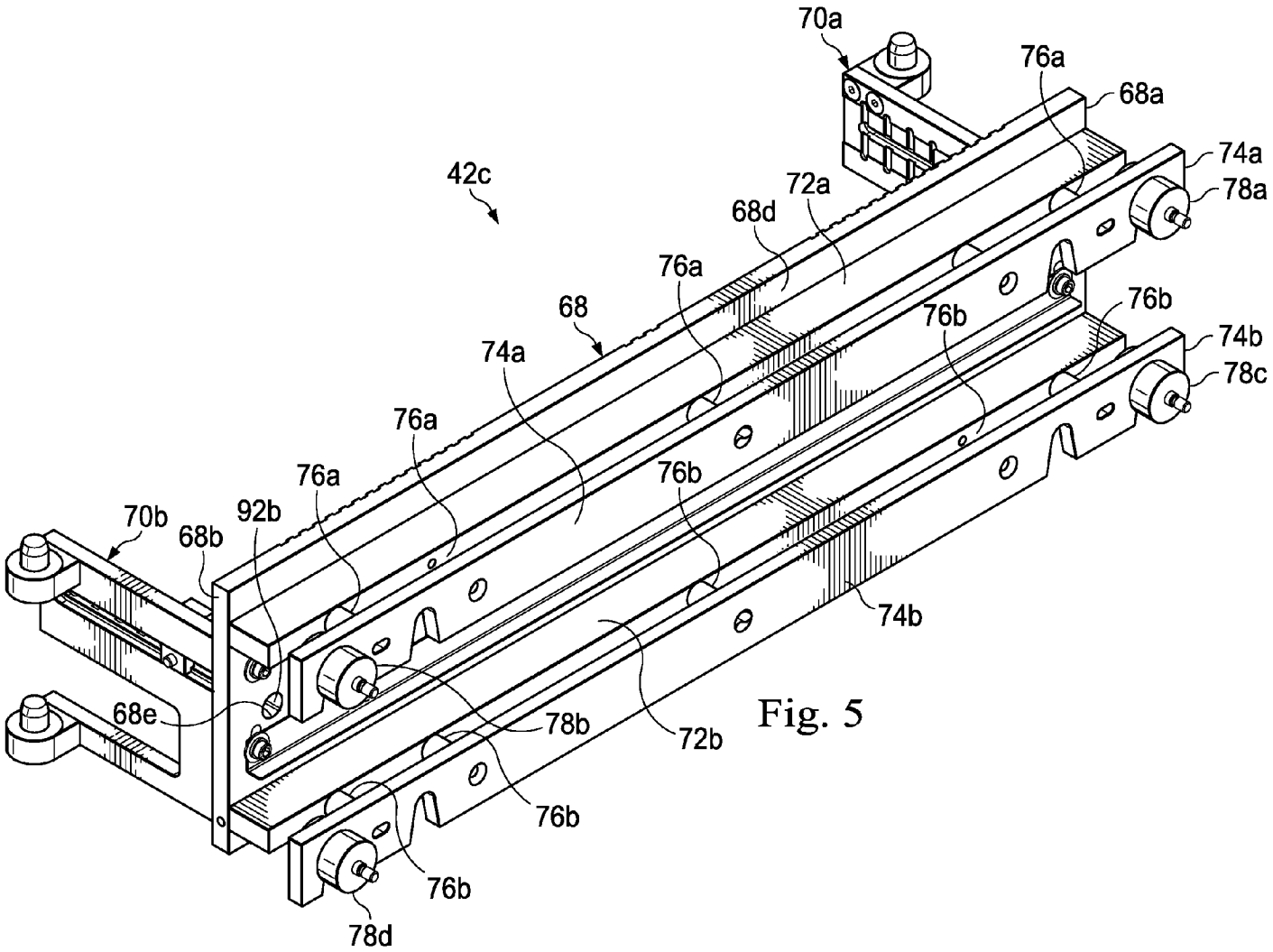

In an exemplary embodiment, as illustrated in FIGS. 3-5 with continuing reference to FIGS. 1 and 2, the back unit 42*c* includes a back plate 68 having a left end portion 68*a* and a right end portion 68*b*, and defining a front surface 68*c* and a back surface 68*d*. A through opening 68*e* (shown in FIG. 5) is formed through the plate 68 at the right end portion 68*b* thereof. Likewise, a through opening 68*f* (shown in FIG. 4) identical to the through opening 68*e*, and vertically aligned therewith, is formed through the plate 68 at the left end portion 68*a* thereof. A left hinge plate assembly 70*a* is connected to the plate 68 at the left end portion 68*a* thereof, and extends from the front surface 68*c*. Likewise, a right hinge plate assembly 70*b* is connected to the plate 68 at the right end portion 68*b* thereof, and extends from the front surface 68*c*. Parallel-spaced horizontal supports 72*a* and 72*b* extend along the back surface 68*d* of the plate 68, and between the end portions 68*a* and 68*b*. The horizontal supports 72*a* and 72*b* are connected to the plate 68. Horizontally-extending track mount members 74*a* and 74*b* are connected to, and spaced in a parallel relation from, the horizontal supports 72*a* and 72*b*, respectively. Pluralities of spacers 76*a* and 76*b* maintain the respective parallel spacings between the track mount member 74*a* and the horizontal support 72*a*, and between the track mount member 74*b* and the horizontal support 72*b*. The quantity of spacers in the each of the respective pluralities of spacers 76*a* and 76*b* may vary. T-track connectors 78*a* and 78*b* are connected to opposing ends, respectively, of the track mount member 74*a*. Likewise, T-track connectors 78*c* and 78*d* are connected to opposing ends, respectively, of the track mount member 74*b*.

Figure 6:
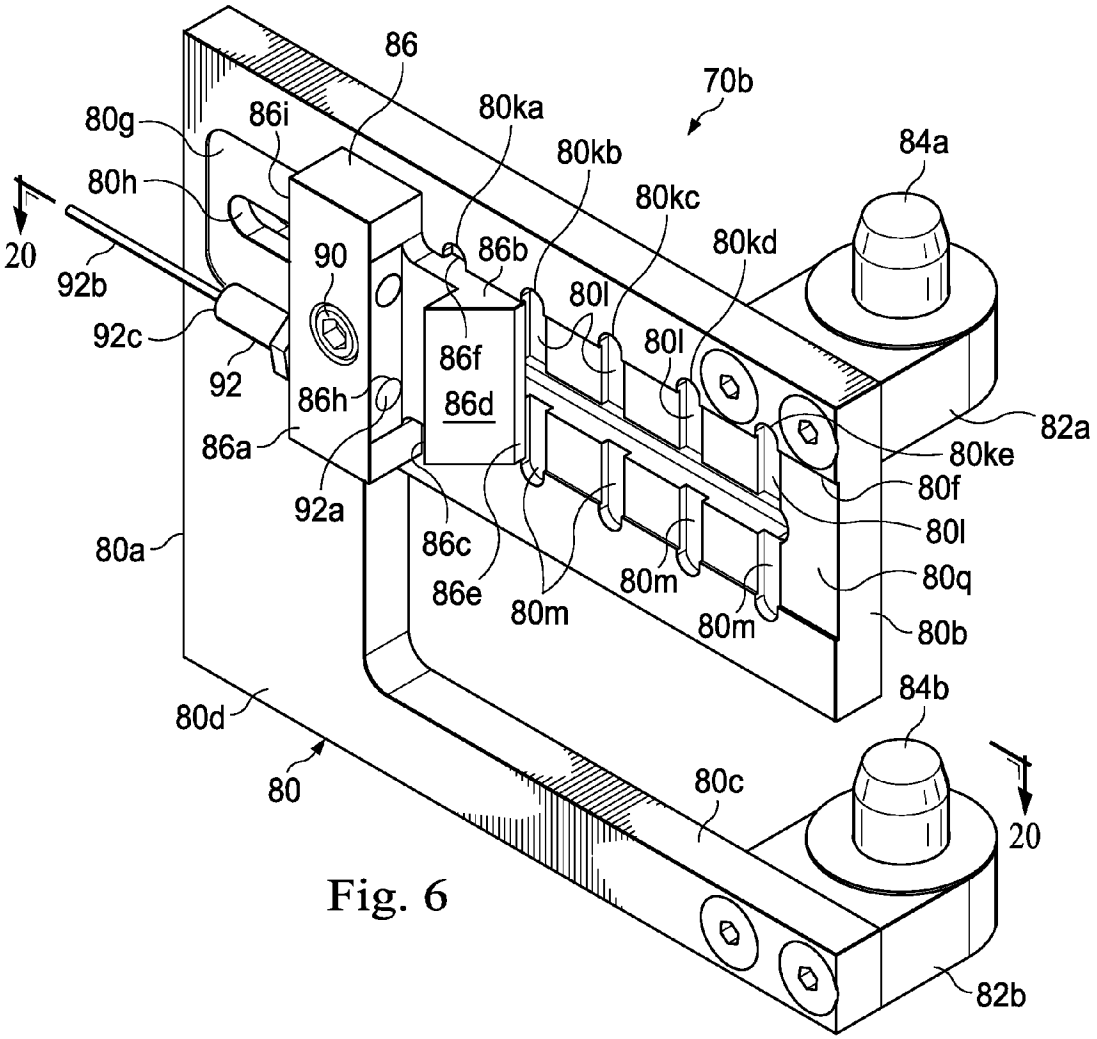
FIGS. 6 and 7 are perspective views of a right hinge plate assembly of the back unit of FIGS. 3-5, according to an exemplary embodiment.
Figure 7:
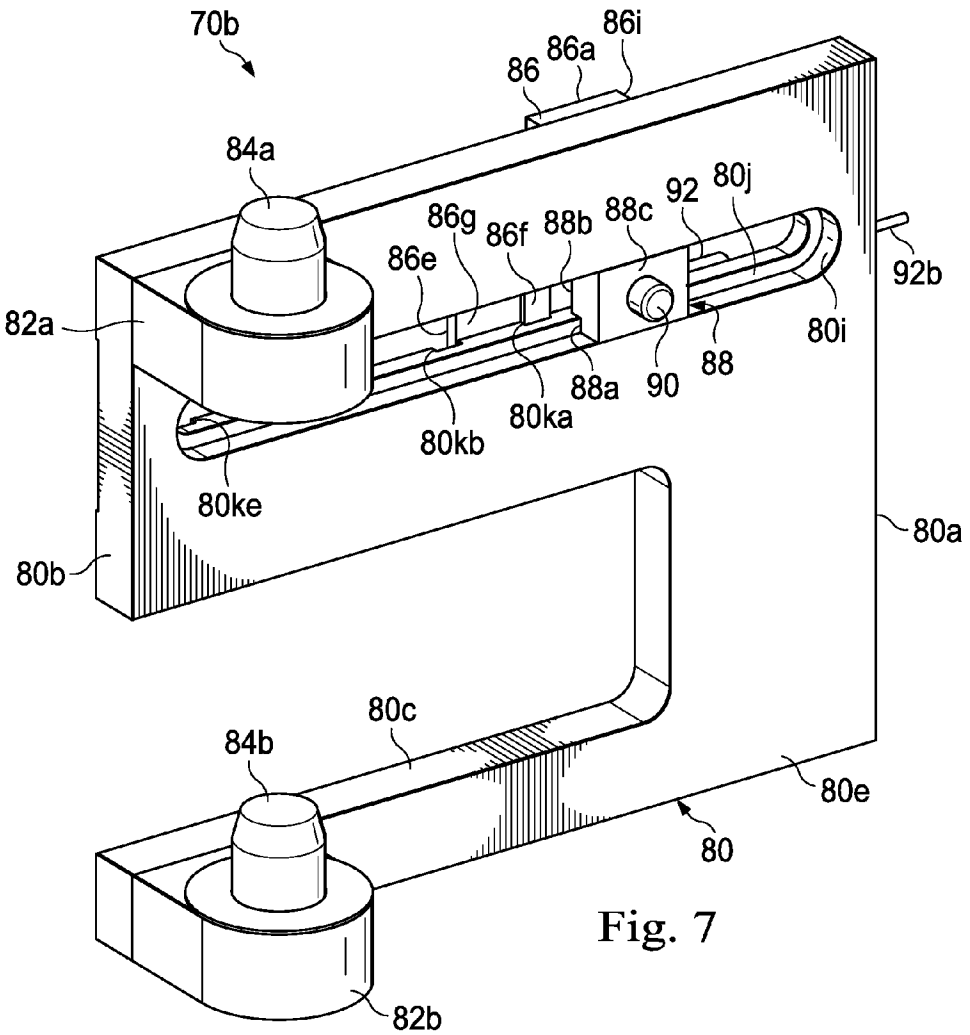

In an exemplary embodiment, as illustrated in FIGS. 6 and 7 with continuing reference to FIGS. 1-5, the right hinge plate assembly 70*b* is configured to provide the hinged connection between the back unit 42*c* and the right door unit 58*c*, with the hinged connection's hinge axis being located on the right side of the back unit 42*c*. The right hinge plate assembly 70*b* includes a hinge plate 80 connected to the plate 68 and having a proximal end 80*a* and a distal end 80*b*. The proximal end 80*a* engages the front surface 68*c* of the plate 68 so that the hinge plate 80 is perpendicular to the front surface 68*c*. A U-shaped cut-out 80*c* is formed in the distal end 80*b* of the hinge plate 80. The hinge plate 80 defines parallel spaced and vertically-extending inside and outside surfaces 80*d* and 80*e*. Pin supports 82*a* and 82*b* are connected to, and extend from, the outside surface 80*e*. The pin support 82*a* is located at the upper portion of the distal end 80*b* of the hinge plate 80, and the pin support 82*b* is located at the lower portion of the distal end 80*b*. Hinge pins 84*a* and 84*b* extend vertically upwards from the pin supports 82*a* and 82*b*, respectively. The hinge pins 84*a* and 84*b* are coaxial (or axially aligned). The coaxial hinge pins 84*a* and 84*b* of the right hinge plate assembly 70*b* are axially aligned with the hinge axis of the hinged connection between the back unit 42*c* and the right door unit 58*c*.

The plate 80 further includes a recess 80*f*, which is formed in the vertically-extending surface 80*d* and positioned above the U-shaped cut-out 80*c*. The recess 80*f* extends from the distal end 80*b* and towards the proximal end 80*a*. A surface 80*g* is defined by the recess 80*f*, the surface 80*g* being laterally offset from the vertically-extending surface 80*d*. A slot 80*h* is formed in the surface 80*g* and through the plate 80. The slot 80*h* extends within the recess 80*f* and between the ends 80*a* and 80*b* of the plate 80. A slot 80*i* is formed in the surface 80*e* and into the plate 80. The slot 80*i* is larger than, and overlaps, the slot 80*h* to thereby define an internal shoulder 80*j* that tracks the slot 80*h* and faces away from the vertically-extending surface 80*d*. Parallel-spaced detents 80*ka*, 80*kb*, 80*kc*, 80*kd*, and 80*ke* are formed in the surface 80*d*, as well as in the surface 80*g* and the slot 80*h*. Each of the detents 80*ka*-80*ke* extends in a direction that is perpendicular to the direction of extension of each of the recess 80*f* and the slot 80*h*. Each of the detents 80*ka*-80*ke* defines a respective pair of surfaces 80*l* and 80*m*, which are coplanar and interrupted by the slot 80*h*.

A latch keeper 86 is connected to the hinge plate 80. The latch keeper 86 includes a block 86*a* and protrusion 86*b* extending therefrom. A slot 86*c* is formed in the protrusion 86*b*, and is adjacent the block 86*a*. The protrusion 86*b* defines an angularly-extending surface 86*d*, which extends from the slot 86*c* to a distal end 86*e* of the protrusion 86*b*. The angularly-extending surface 86*d* extends so that the lateral thickness of the protrusion 86*b* decreases from the slot 86*c* to the distal end 86*e*. A rib 86*f* extends from a vertically-extending side surface 86*g* of the protrusion 86*b*; the side surface 86*g* is opposite the slot 86*c*. The rib 86*f* extends vertically along the side surface 86*g*. A through opening 86*h* extends from a back surface 86*i* defined by the block 86*a*, through the block 86*a*, and to the slot 86*c*.

The latch keeper 86 is connected to the hinge plate 80 via a nut, such as T-nut 88, which is disposed in the slots 80*h* and 80*i*. The T-nut 88 includes an external shoulder 88*a*, which engages the internal shoulder 80*j* of the plate 80 so that a portion 88*b* of the T-nut 88 extends within the slot 80*h*, and a portion 88*c* extends within the slot 80*i*. The block 86*a* of the latch keeper 86 engages the surface 80*d* of the plate 80, and a fastener 90 extends through the block 86*a* and threadably engages the T-nut 88, thereby connecting the latch keeper 86 to the hinge plate 80. As shown in FIGS. 6 and 7, the rib 86*f* extends within the detent 80*ka* so that the rib 86*f* engages, or is at least proximate, the corresponding pair of surfaces 80*l* and 80*m* defined by the detent 80*ka*. The protrusion 86*b* extends within the recess 80*f* so that the surface 86*g* engages, or is at least proximate, the surface 80*g*. As a result of the extension of the rib 86*f* within the detent 80*ka*, the extension of the protrusion 86*b* within the recess 86*f*, and the threaded engagement between the fastener 90 and the T-nut 88, the position of the latch keeper 86 is locked, relative to the hinge plate 80. The extension of the rib 86*f* within the detent 80*ka* prevents relative movement between the latch keeper 86 and the hinge plate 80 in the depth direction as viewed in FIGS. 6 and 7, that is, in a direction that extends either from the proximal end 80*a* to the distal end 80*b* or vice versa. The extension of the protrusion 86*b* within the recess 80*f* prevents relative movement between the latch keeper 86 and the hinge plate 80 in a vertical direction as viewed in FIGS. 6 and 7. The threaded engagement between the fastener 90 and the T-nut 88 prevents relative movement between the latch keeper 86 and the hinge plate in a lateral direction as viewed in FIGS. 6 and 7.

A sensor 92 is connected to the latch keeper 86. The sensor 92 extends within the through opening 86*h* so that a face 92*a* of the sensor 92 is adjacent, or at least proximate, the slot 86*c* of the latch keeper 86. The sensor 92 extends from the back surface 86*i* of the block 86*a*, and a cable 92*b* extends away from a back end 92*c* of the sensor 92. As shown in FIGS. 4 and 5, the cable 92*b* extends through the through opening 68*e*. Via at least the cable 92*b*, the sensor 92 is in communication with a control unit 94 (shown in at least FIGS. 11, 15, and 17). In an exemplary embodiment, the sensor 92 is a proximity sensor.

The left hinge plate assembly 70*a* is identical to the right hinge plate assembly 70*b*, except that the left hinge plate assembly 70*a* is configured to provide the hinged connection between the back unit 42*c* and the left door unit 52*c*, with the hinged connection's hinge axis being located on the left side of the back unit 42*c*. Therefore, the left hinge plate assembly 70*a* will not be described in further detail. The left hinge plate assembly 70*a* includes the same components of the right hinge plate assembly 70*b*, which same components are given the same reference numerals. The left hinge plate assembly 70*a* is connected to the plate 68 of the back unit 42*c* in a manner identical to the above-described manner in which the right hinge plate assembly 70*b* is connected to the plate 68. As shown in FIG. 3, the cable 92*b* of the sensor 92 of the left hinge plate assembly 70*a* extends through the through opening 68*f* that is formed through the plate 68 and vertically aligned with the through opening 68*e*. Via at least the cable 92*b* of the sensor 92 of the right hinge plate assembly 70*b*, the sensor 92 is in communication with the control unit 94 shown in at least FIGS. 11, 15, and 17. The coaxial hinge pins 84*a* and 84*b* of the left hinge plate assembly 70*a* are axially aligned with the hinge axis of the hinged connection between the back unit 42*c* and the left door unit 52*c*.

Each of the back units 42*a* and 42*b* is identical to the back unit 42*c*. Therefore, the back units 42*a* and 42*b* will not be described in further detail. Each of the back units 42*a* and 42*b* includes the same components of the back unit 42*c*, which same components are given the same reference numerals.

Figure 8:
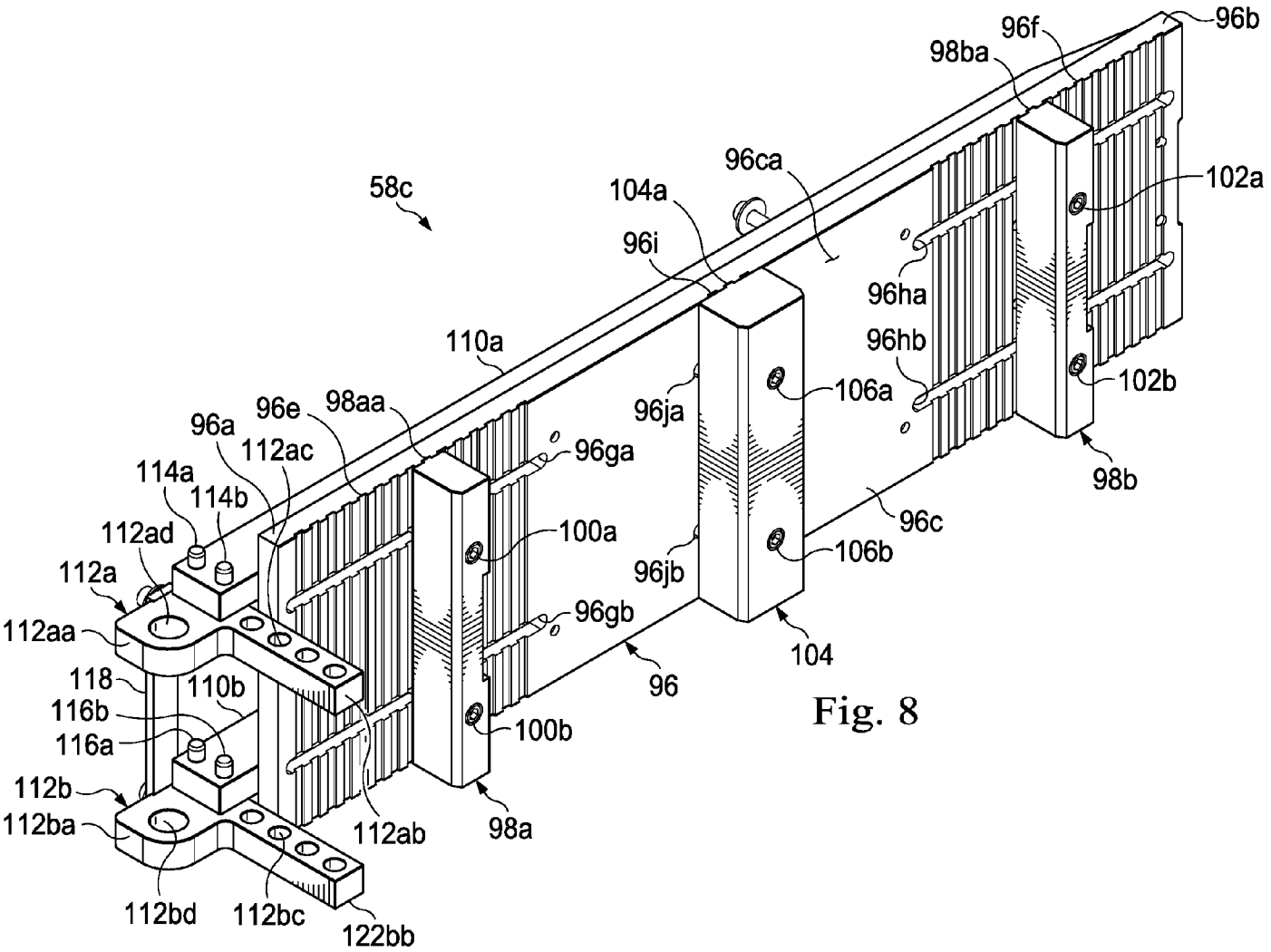
FIG. 8 is a perspective view of one of the right door units of the fixture of FIGS. 1 and 2, according to an exemplary embodiment.
Figure 9:
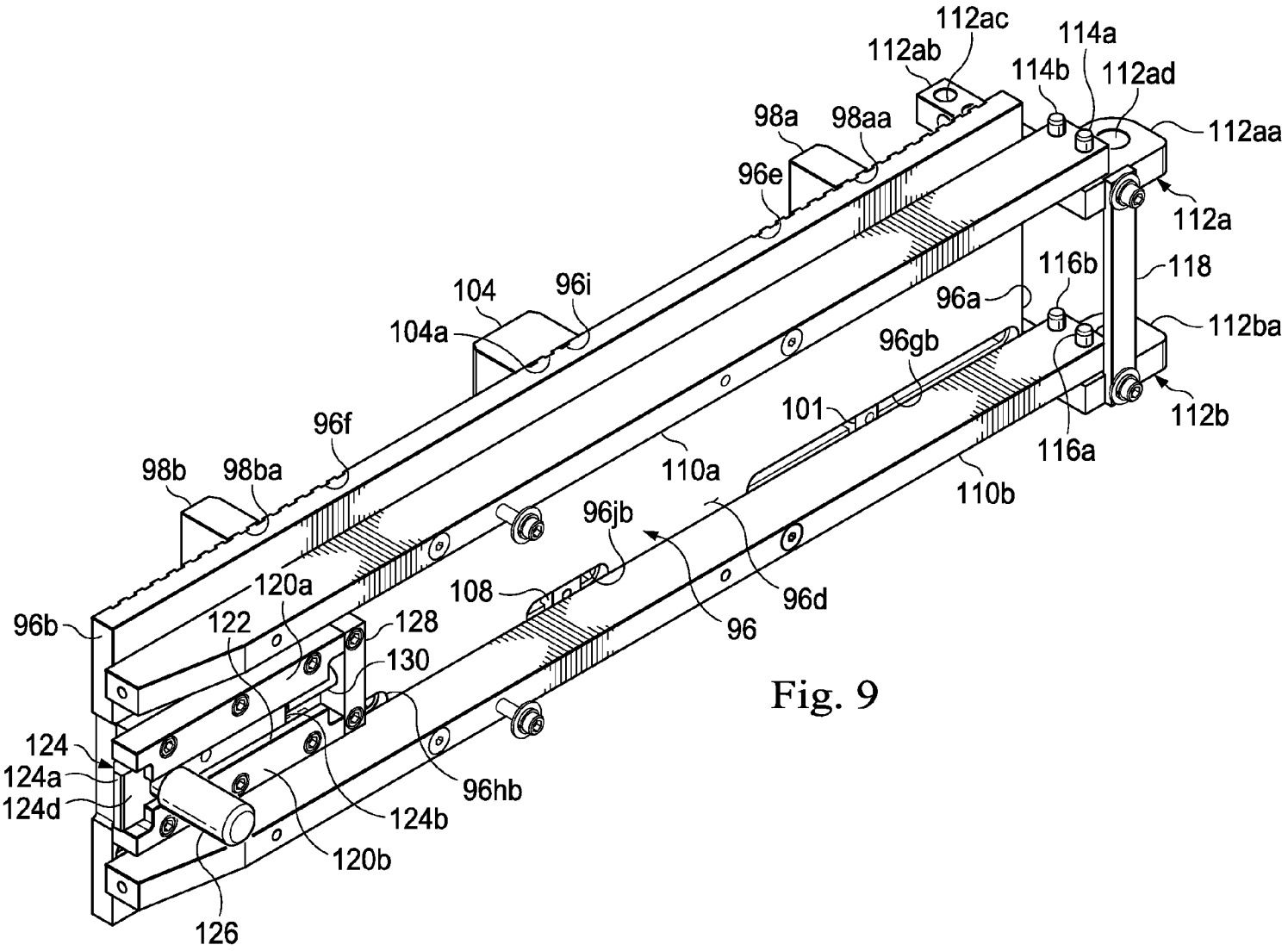
FIGS. 9 and 10 are additional perspective views of the right door unit of FIG. 8, according to an exemplary embodiment.
Figure 10:
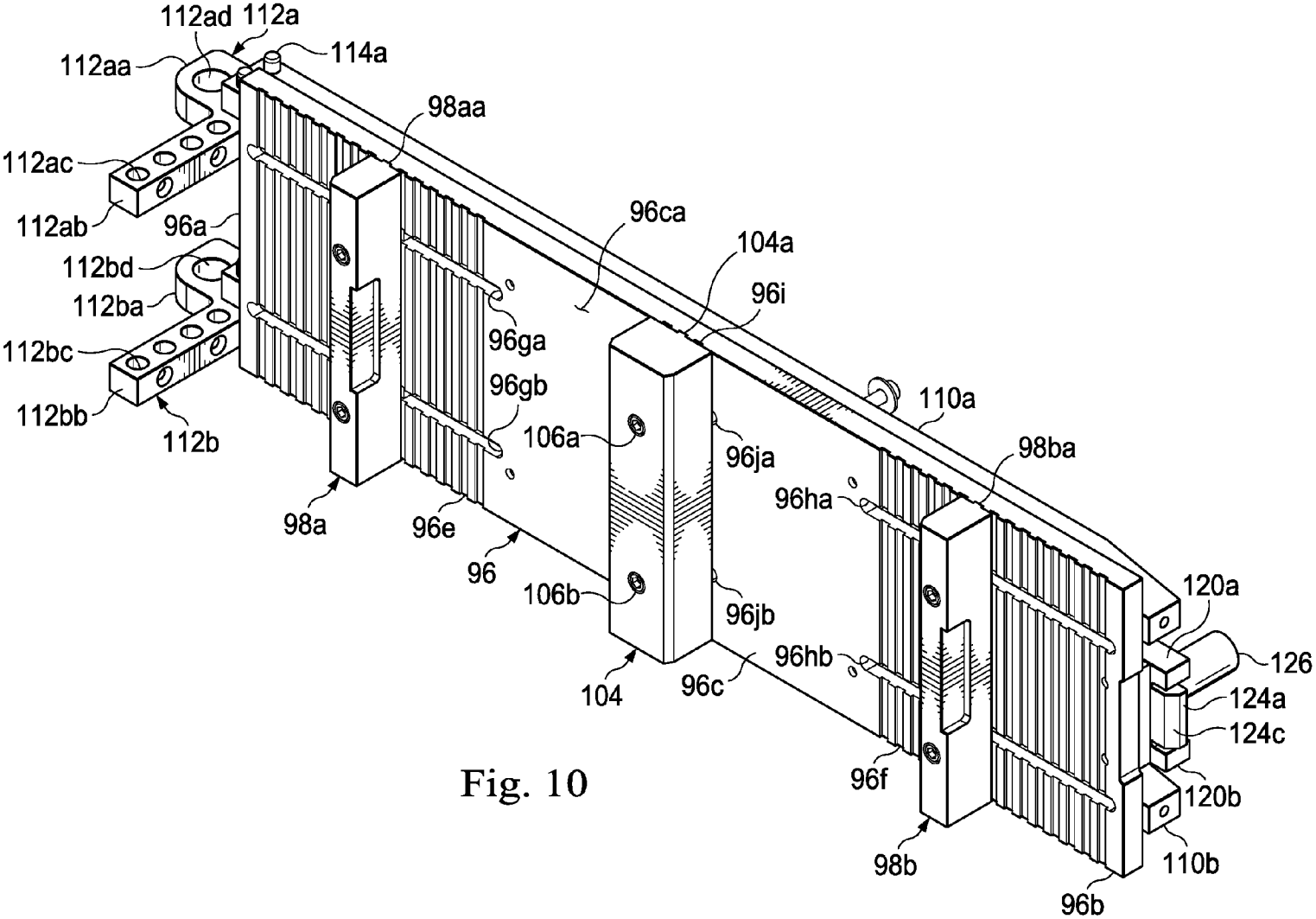

In an exemplary embodiment, as illustrated in FIGS. 8-10 with continuing reference to FIGS. 1-7, the right door unit 58*c* includes a door plate 96 having opposing end portions 96*a* and 96*b*, and defining a vertically-extending inside surface 96*c* and a vertically-extending outside surface 96*d*. A plurality of vertically-extending channels, or detents 96*e*, are formed in the inside surface 96*c* at, and proximate, the end portion 96*a*; the detents 96*e* extend along the height of the inside surface 96*c*. In an exemplary embodiment, each of the detents 96*e* is spaced from at least one other detent 96*e* adjacent thereto by a predetermined increment. Likewise, a plurality of vertically-extending channels, or detents 96*f*, are formed in the inside surface 96*c* at, and proximate the end portion 96*b*; the detents 96*f* extend along the height of the inside surface 96*c*. In an exemplary embodiment, each of the detents 96*f* is spaced from at least one other detent 96*f* adjacent thereto by a predetermined increment. A middle region 96*ca* of the inside surface 96*c* is defined between the pluralities of detents 96*e* and 96*f*. Parallel-spaced and horizontally-extending slots 96*ga* and 96*gb* are formed in the detents 96*e* and through the plate 96*a*. Likewise, parallel-spaced and horizontally-extending slots 96*ha* and 96*hb* are formed in the detents 96*f* and through the plate 96. A plurality of vertically-extending channels, or detents 96*i*, are formed in the middle region 96*ca* of the inside surface 96*c*; the detents 96*i* extend along the height of the inside surface 96*c*. In an exemplary embodiment, each of the detents 96*i* is spaced from at least one other detent 96*i* adjacent thereto by a predetermined increment. Parallel-spaced and horizontally-extending slots 96*ja* and 96*jb* are formed in the detents 96*i* and through the plate 96. In an exemplary embodiment, the plate 96 of the right door unit 58*c* is identical to the above-described plate 68 of the back unit 42*c*.

Outside spacer blocks 98*a* and 98*b*, which include respective ribs 98*aa* and 98*ba* extending vertically along the respective backsides thereof, are connected to the plate 96 so that the ribs 98*aa* and 98*ab* extend within respective ones of the detents 96*e* and 96*f*. In an exemplary embodiment, the outside spacer block 98*a* is connected to the plate 96 via fasteners 100*a* and 100*b*, which extend through the outside spacer block 98*a* and into the slots 96*ga* and 96*gb*, respectively, and threadably engage respective nuts, such as respective T-nuts, which are at least partially disposed in the slots 96*ga* and 96*gb*. The T-nut at least partially disposed in the slot 96*gb* is shown in FIG. 9 and referred to by the reference numeral 101. In an exemplary embodiment, the outside spacer block 98*b* is connected to the plate 96 via fasteners 102*a* and 102*b*, which extend through the outside spacer block 98*b* and into the slots 96*ha* and 96*hb*, respectively, and threadably engage respective nuts, such as respective T-nuts, which are at least partially disposed in the slots 96*ha* and 96*hb*. Since each of the detents 96*e* is spaced from at least one other detent 96*e* adjacent thereto by a predetermined increment, the detents 96*e* correspond to a plurality of predetermined positions, each of which is a predetermined position at which the outside spacer block 98*a* is adapted to be connected to the right door unit 58*c*, each of the predetermined positions being spaced from at least one other predetermined position adjacent thereto by the predetermined increment (the spacing between each adjacent pair of the detents 96*e*). Since each of the detents 96*f* is spaced from at least one other detent 96*f* adjacent thereto by a predetermined increment, the detents 96*f* correspond to a plurality of predetermined positions, each of which is a predetermined position at which the outside spacer block 98*b* is adapted to be connected to the right door unit 58*c*, each of the predetermined positions being spaced from at least one other predetermined position adjacent thereto by the predetermined increment (the spacing between each adjacent pair of the detents 96*f*).

A center spacer block 104, which includes a rib 104*a* extending vertically along the backside thereof, is connected to the plate 96 so that the rib 104*a* extends within one of the detents 96*i*. In an exemplary embodiment, the center spacer block 104 is connected to the plate 96 via fasteners 106*a* and 106*b*, which extend through the center spacer block 104 and into the slots 96*ja* and 96*jb*, respectively, and threadably engage respective nuts, such as respective T-nuts, which are at least partially disposed in the slots 96*ja* and 96*jb*. The T-nut at least partially disposed in the slot 96*jb* is shown in FIG. 9 and referred to by the reference numeral 108. Since each of the detents 96*i* is spaced from at least one other detent 96*i* adjacent thereto by a predetermined increment, the detents 96*i* correspond to a plurality of predetermined positions, each of which is a predetermined position at which the center spacer block 104 is adapted to be connected to the right door unit 58*c*, each of the predetermined positions being spaced from at least one other predetermined position adjacent thereto by the predetermined increment (the spacing between each adjacent pair of the detents 96*i*).

Parallel-spaced horizontal supports 110*a* and 110*b* extend along the outside surface 96*d* of the plate 96, and between the opposing end portions 96*a* and 96*b* thereof. The horizontal supports 110*a* and 110*b* are connected to the plate 96. A door support 112*a* is connected to the horizontal support 110*a* at the end thereof proximate the end portion 96*a* of the plate 96. The door support 112*a* includes a block 112*aa* and a beam 112*ab* extending therefrom. The beam 112*ab* is generally perpendicular to the plate 96. A plurality of linear-aligned through openings 112*ac* are formed through the block 112*aa* and the beam 112*ab*. A through opening 112*ad* is formed through the block 112*aa*. The door support 112*a* is connected to the horizontal support 110*a* via fasteners 114*a* and 114*b*, which extend at least within each of the horizontal support 110*a* and an adjacent pair of the through openings 112*ac*. In an exemplary embodiment, each of the fasteners 114*a* and 114*b* includes a dowel pin. Likewise, a door support 112*b* is connected to the horizontal support 110*b* at the end thereof proximate the end portion 96*a* of the plate 96. The door support 112 includes a block 112*ba* and a beam 112*bb* extending therefrom. The beam 112*bb* is generally perpendicular to the plate 96. A plurality of linearly-aligned through openings 112*bc* are formed through the block 112*ba* and the beam 112*bb*. A through opening 112*bd* is formed through the block 112*ba*. The door support 112*b* is connected to the horizontal support 110*b* via fasteners 116*a* and 116*b*, which extend at least within each of the horizontal support 110*b* and an adjacent pair of the through openings 112*bc*. In an exemplary embodiment, each of the fasteners 116*a* and 116*b* includes a dowel pin.

The door supports 112*a* and 112*b* are spaced in a parallel relation. The through openings 112*ad* and 112*bd* are coaxial (or axially aligned). The coaxial through openings 112*ad* and 112*bd* are axially aligned with the hinge axis of the hinged connection between the back unit 42*c* and the right door unit 58*c*. The linearly-aligned through openings 112*ac* are coaxial, or axially aligned, with respective ones of the linearly-aligned through openings 112*bc*. In an exemplary embodiment, the door supports 112*a* and 112*b* are identical to each other. A strut 118 extends vertically between the door supports 112*a* and 112*b*.

As shown in FIGS. 9 and 10, opposing latch brackets 120*a* and 120*b* are connected to the outside surface 96*d* at the end portion 96*b* of the plate 96. The opposing latch brackets 120*a* and 120*b* are vertically disposed between the horizontal supports 110*a* and 110*b*. The latch brackets 120*a* and 120*b* are proximate the horizontal supports 110*a* and 110*b*, respectively, and extend along respective portions thereof. A slot 122 is defined between the latch brackets 120*a* and 120*b*. A latch bar 124 is operably coupled to the plate 96. In particular, in an exemplary embodiment, the latch bar 124 is slidably disposed between the latch brackets 120*a* and 120*b*. The latch bar 124 defines opposing end surfaces 124*a* and 124*b*, an angularly-extending engagement surface 124*c* proximate the end surface 124*a* and the edge of the end portion 96*b* of the plate 96, and a back surface 124*d* extending between the end surfaces 124*a* and 124*b*. A handle 126 extends from the back surface 124*d*, and is perpendicular to the latch bar 124. The handle 126 extends through the slot 122. An end bracket 128 is connected to the outside surface 96*d* and engages respective ends of the latch brackets 120*a* and 120*b* that are opposite each of the end surface 124*a* and the angularly-extending engagement surface 124*c* of the latch bar 124. A latch spring 130 is disposed between the latch brackets 120*a* and 120*b*, and extends axially between the end bracket 128 and the end surface 124*b* of the latch bar 124. In an exemplary embodiment, the latch spring 130 is a helical spring. The latch spring 130 is adapted to apply a biasing force against the latch bar 124, urging the latch bar 124 to move away from the end bracket 128. In several exemplary embodiments, additional hardware maintains the position of the latch spring 130 between the latch brackets 120*a* and 120*b*; for example, a rod may extend from the end bracket 128, through the latch spring 130 and into the latch bar 124, with the latch bar 124 being movable relative to each of the end bracket 128 and the rod extending therefrom.

Each of the right door units 58*a* and 58*b* is identical to the right door unit 58*c*. Therefore, the right door units 58*a* and 58*b* will not be described in further detail. Each of the right door units 58*a* and 58*b* includes the same components of the right door unit 58*c*, which same components are given the same reference numerals.

The left door units 52*a*, 52*b*, and 52*c* are identical to the right door units 58*a*, 58*b*, and 58*c*, respectively, except that the left door units 52*a*, 52*b*, and 52*c* are configured to be hingedly connected on the respective left sides of the back units 42*a*, 42*b*, and 42*c* on the left side thereof, as viewed in FIG. 2, rather than on the respective right sides. Therefore, the left door units 52*a*, 52*b*, and 52*c* will not be described in further detail. Each of the left door units 52*a*, 52*b*, and 52*c* includes the same components of the right door unit 58*c*, which same components are given the same reference numerals.

Figure 11:
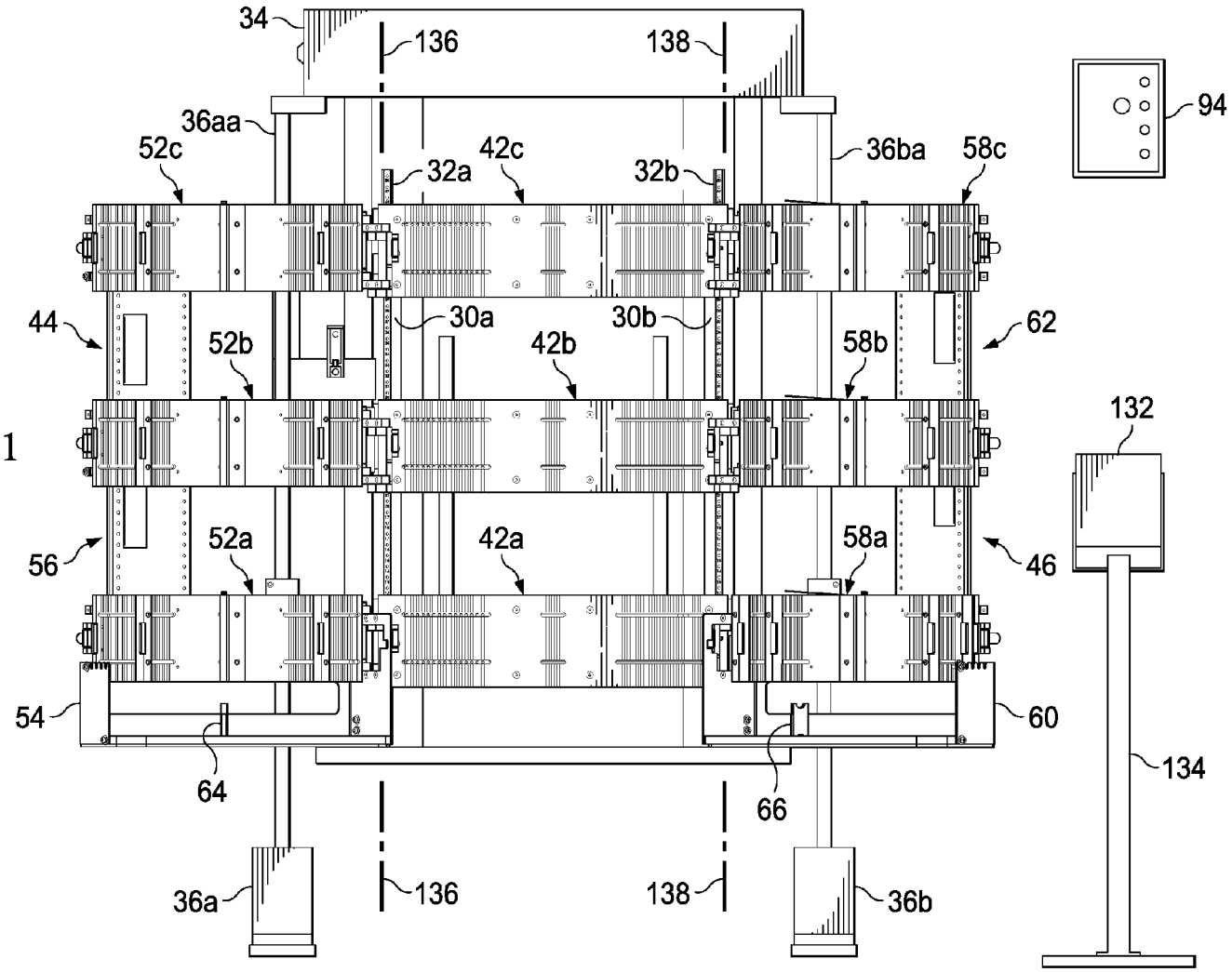
FIG. 11 is a front elevational view of the fixture of FIGS. 1 and 2, according to an exemplary embodiment.
Figure 12:
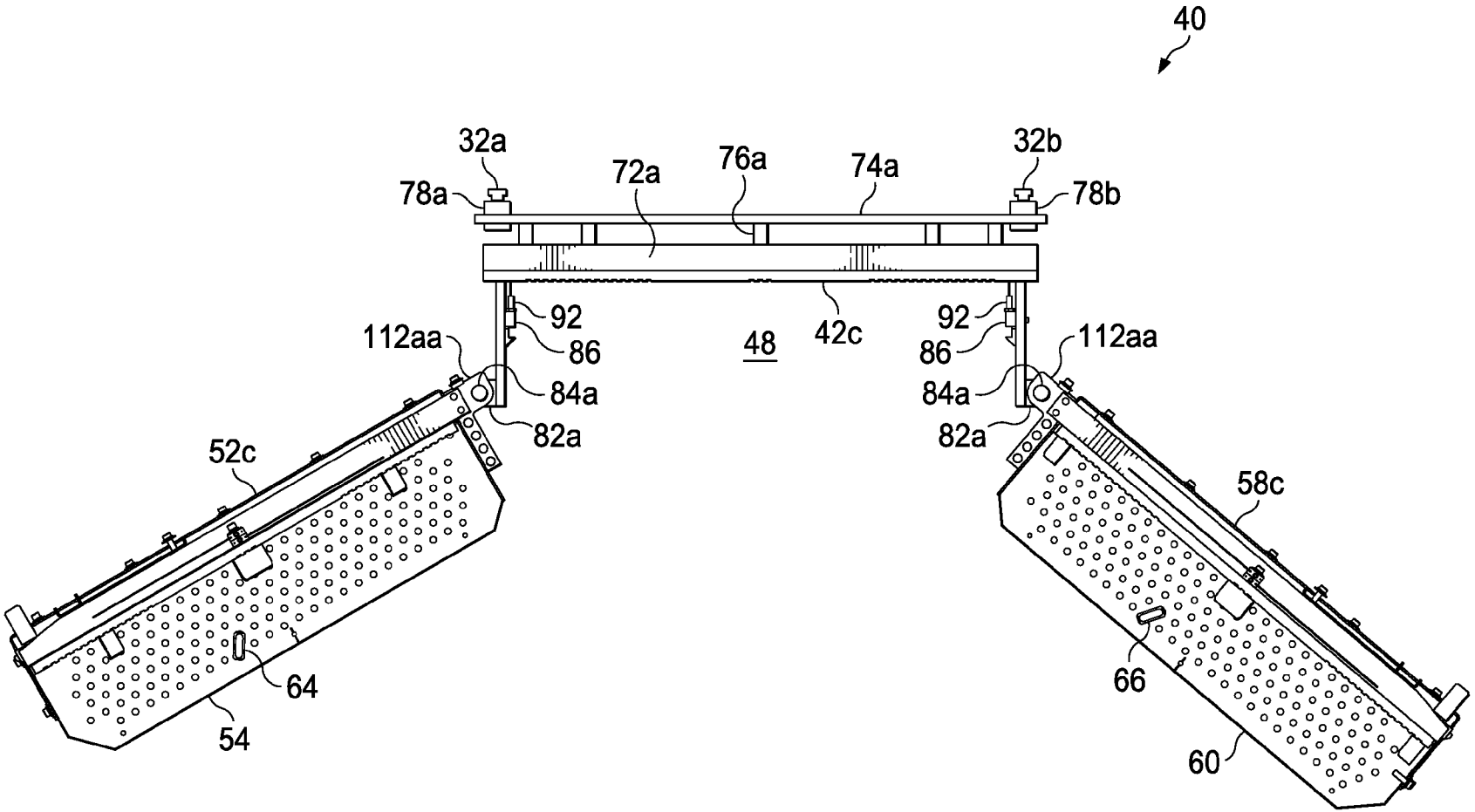
FIG. 12 is a top plan view of the fixture of FIGS. 1, 2, and 11, according to an exemplary embodiment.
Figure 13:
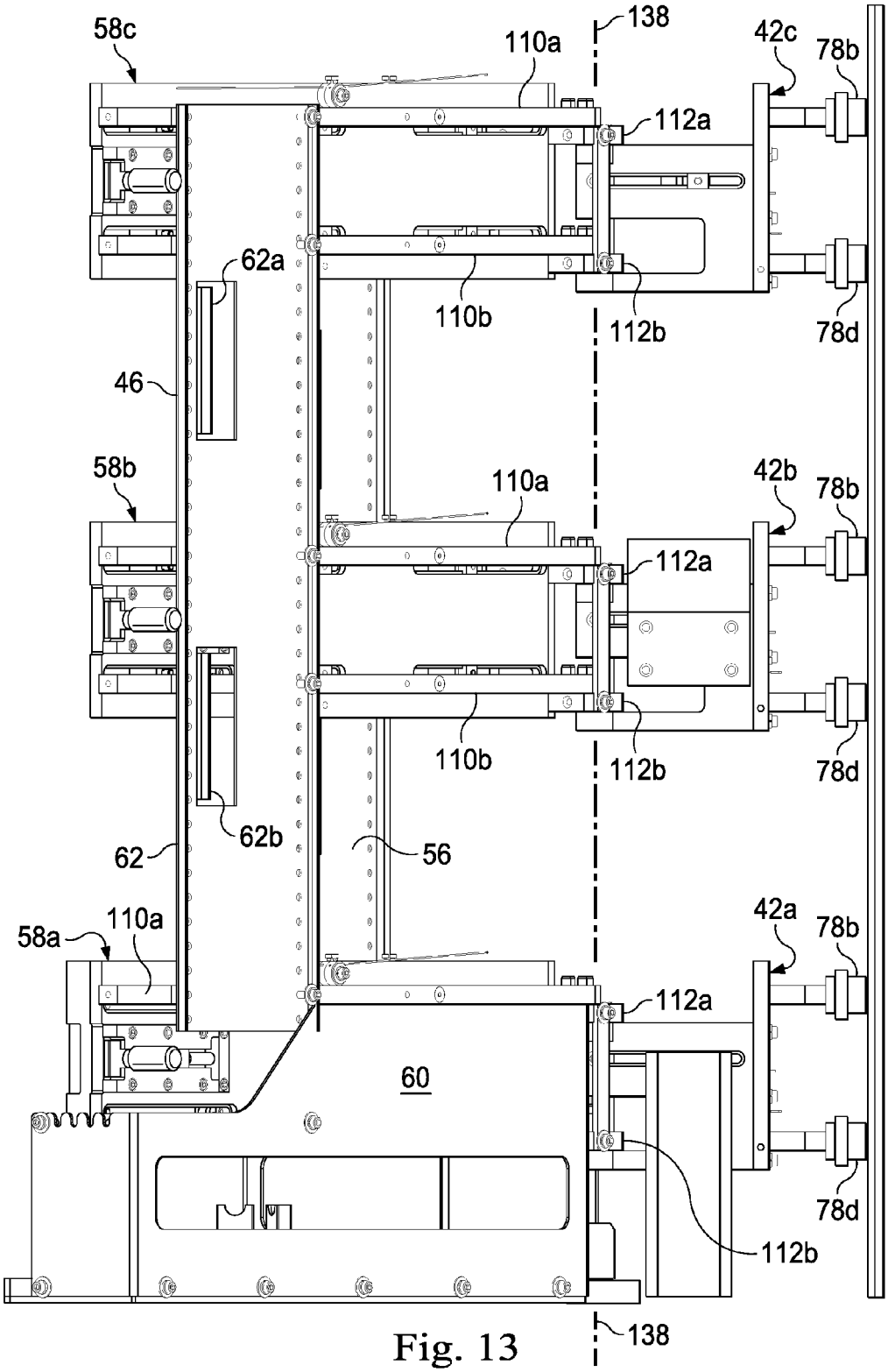
FIG. 13 is a right side elevational view of the fixture of FIGS. 1, 2, 11, and 12, according to an exemplary embodiment.
Figure 14:
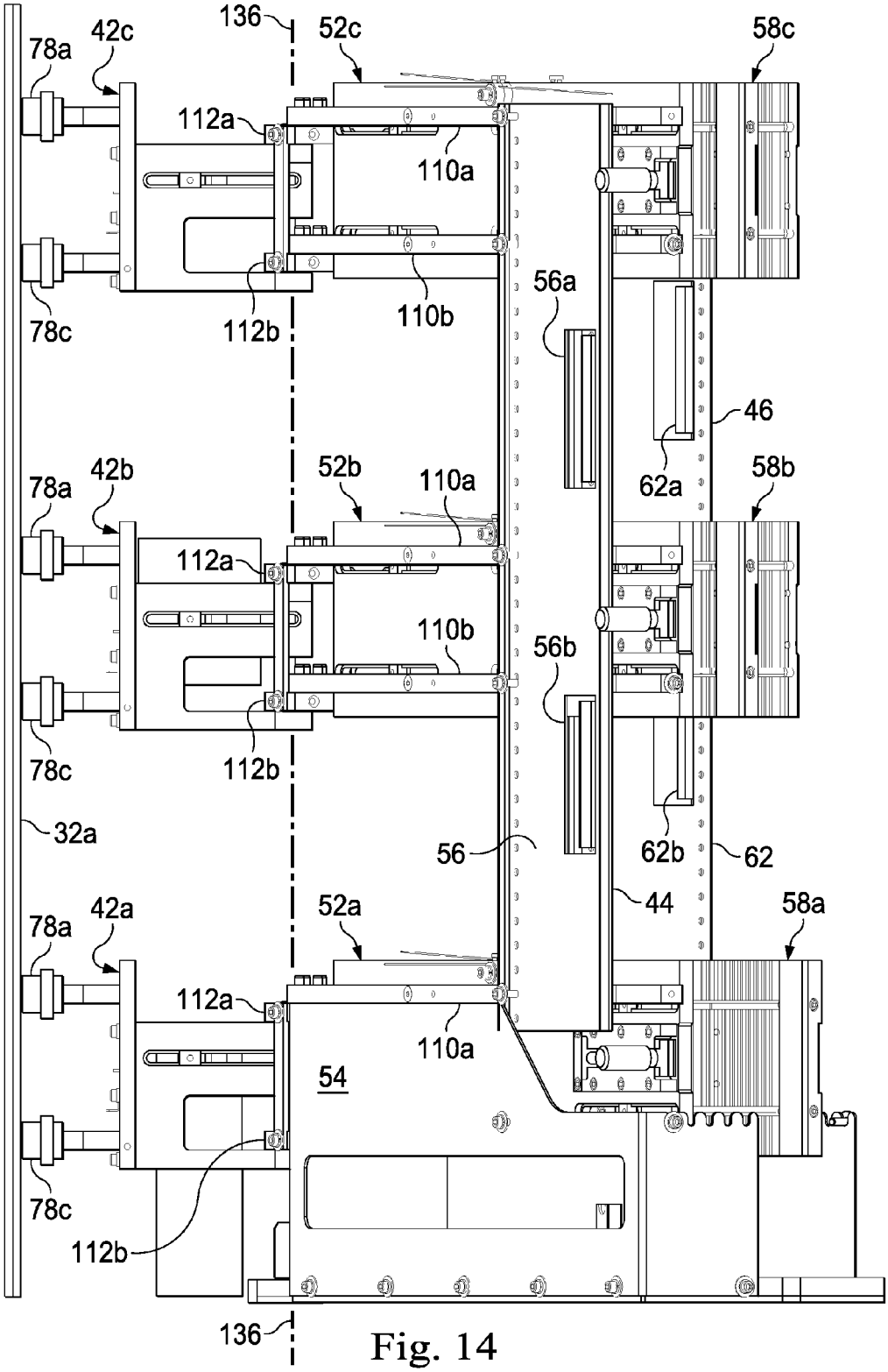
FIG. 14 is a left side elevational view of the fixture of FIGS. 1, 2, and 11-13, according to an exemplary embodiment.

In an exemplary embodiment, as illustrated in FIG. 11 with continuing reference to FIGS. 1-10, the tube expander 40 includes a control panel 132, which is in communication with the control unit 94. In an exemplary embodiment, the control panel 132 is mounted on stanchion 134. In an exemplary embodiment, the control unit 94 is connected to a vertically-extending wall of the structure in which the tube expander 10 is positioned. In an exemplary embodiment, the control unit 94 is connected to the frame 12 of the tube expander 10. In several exemplary embodiments, the control unit 94 is part of the control panel 132, or vice versa.

In several exemplary embodiments, one or more of the sensors 92 are wireless sensors, and the respective cables 92*b* thereof are omitted in favor of respective wireless transmitters; in several exemplary embodiments, the control unit 94 or the control panel 132, includes a wireless signal receiver that is in communication with the wireless sensors.

In several exemplary embodiments, the control panel 132 is, or includes, a handheld control module, which is either wireless or retractably suspended from a ceiling of the structure in which the tube expander 10 is positioned.

In an exemplary embodiment, as illustrated in FIGS. 11-14 as well as FIGS. 1 and 2, with continuing reference to FIGS. 3-10, when the fixture 40 is in an assembled condition, the connectors 78*a* and 78*c* of each of the back units 42*a*, 42*b*, and 42*c* are connected to the T-track 32*a*. Likewise, the connectors 78*b* and 78*d* of each of the back units 42*a*, 42*b*, and 42*c* are connected to the T-track 32*b*. As a result, each of the back units 42*a*, 42*b*, and 42*c* is connected to the frame 12 of the tube expander 10.

The hinge pins 84*a* and 84*b* of the back unit 42*c* extend upwards through the through openings 112*ad* and 112*bd*, respectively, of the door supports 112*a* and 112*b* of the right door unit 58*c*. The pin supports 82*a* and 82*b* engage and support the blocks 112*aa* and 112*ba*, respectively. As a result, the right door unit 58*c* is hingedly connected to the back unit 42*c*. The right door unit 58*a* is hingedly connected to the back unit 42*a* in a manner identical to the above-described manner in which the right door unit 58*c* is hingedly connected to the back unit 42*a*. Likewise, the right door unit 58*b* is hingedly connected to the back unit 42*b* in a manner identical to the above-described manner in which the right door unit 58*c* is hingedly connected to the back unit 42*a*. The respective hinge pins 84*a* and 84*b*, and the respective through openings 112*ad* and 112*bd*, of the right door units 58*a*, 58*b*, and 58*c*, are all coaxial. The left door units 52*a*, 52*b*, and 52*c* are hingedly connected to the back units 42*a*, 42*b*, and 42*c*, respectively, in a manner identical to the above-described manner in which the right door units 58*a*, 58*b*, and 58*c* are hingedly connected to the back units 42*a*, 42*b*, and 42*c*, respectively. The respective hinge pins 84*a* and 84*b*, and the respective through openings 112*ad* and 112*bd*, of the left door units 52*a*, 52*b*, and 52*c*, are all coaxial.

The lower end portion of the left door brace 56 is connected to the horizontal support 110*a* of the left door unit 52*a*. The left door brace 56 extends upwards from the horizontal support 110*a* of the left door unit 52*a*, and is connected to the horizontal supports 110*a* and 110*b* of the left door unit 52*b*. The left door brace 56 extends upwards from the horizontal support 110*a* of the left door unit 52*b*, and is connected to the horizontal supports 110*a* and 110*b* of the left door unit 52*c*. The left door brace 56 connects the left door units 52*a*, 52*b*, and 52*c* together so that the left door units 52*a*, 52*b*, and 52*c* pivot together about a hinge axis 136. The hinge axis 136 is the hinge axis for the respective hinged connections between the left door units 52*a*, 52*b*, and 52*c*, and the back units 42*a*, 42*b*, and 42*c*, respectively, on the respective left sides of the back units 42*a*, 42*b*, and 42*c* (as viewed in FIG. 11). The respective hinge pins 84*a* and 84*b*, and the through openings 112*ad* and 112*bd*, of the left door units 52*a*, 52*b*, and 52*c* are all coaxial, or axially aligned, with the hinge axis 136. The left door brace 56 includes handle portions 56*a* and 56*b* to facilitate the pivoting movement of the left door assembly 44. The left door lower shroud 54 is connected to the left door unit 52*a* via one or more components thereof including, for example, the horizontal support 110*b* of the left door unit 52*a*.

The lower end portion of the right door brace 62 is connected to the horizontal support 110*a* of the right door unit 58*a*. The right door brace 62 extends upwards from the horizontal support 110*a* of the right door unit 58*a*, and is connected to the horizontal supports 110*a* and 110*b* of the right door unit 58*b*. The right door brace 62 extends upwards from the horizontal support 110*a* of the right door unit 58*b*, and is connected to the horizontal supports 110*a* and 110*b* of the right door unit 58*c*. The right door brace 62 connects the right door units 58*a*, 58*b*, and 58*c* together so that the right door units 58*a*, 58*b*, and 58*c* pivot together about a hinge axis 138. The hinge axis 138 is the hinge axis for the respective hinged connections between the right door units 58*a*, 58*b*, and 58*c*, and the back units 42*a*, 42*b*, and 42*c*, respectively, on the respective right sides of the back units 42*a*, 42*b*, and 42*c* (as viewed in FIG. 11). The respective hinge pins 84*a* and 84*b*, and the through openings 112*ad* and 112*bd*, of the right door units 58*a*, 58*b*, and 58*c* are all coaxial, or axially aligned, with the hinge axis 138. The right door brace 62 includes handle portions 62*a* and 62*b* to facilitate the pivoting movement of the right door assembly 46. The right door lower shroud 60 is connected to the right door unit 58*a* via one or more components thereof including, for example, the horizontal support 110*b* of the right door unit 58*a*.

Figure 15:
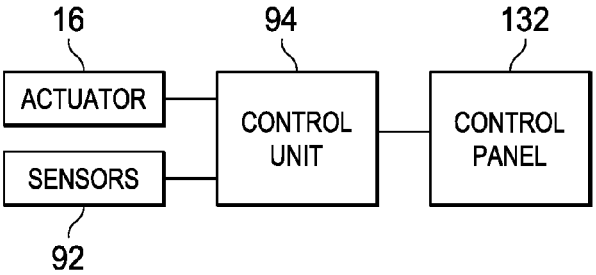
FIG. 15 is a diagrammatic illustration of components of the tube expander of FIG. 1, according to an exemplary embodiment.

In an exemplary embodiment, as illustrated in FIG. 15 with continuing reference to FIGS. 1-14, and as described above, the control panel 132 is in communication with the control unit 94. The actuator 16 is in communication with the control unit 94. The respective pairs of sensors 92 of the back units 42*a*, 42*b*, and 42*c* are in communication with the control unit 94. In an exemplary embodiment, the sensors 92 are in communication with the control unit 94 via at least the respective cables 92*b*. In an exemplary embodiment, the sensors 92 are electrically coupled in parallel to the control unit 94. In an exemplary embodiment, each of the pairs of sensors 92 of the back units 42*a*, 42*b*, and 42*c* are electrically coupled in parallel to the control unit 94. In an exemplary embodiment, for each of the back units 42*a*, 42*b*, and 42*c*, the control unit 94 is configured to determine if either one of the sensors 92 in the corresponding pair of the sensors 92, or the other of the sensors 92, senses the presence or extension of the latch bar 124 within the slot 86*c*. In an exemplary embodiment, each of the pairs of sensors 92 of the back units 42*a*, 42*b*, and 42*c* are electrically coupled in parallel to the control unit 94 and, for each of the back units 42*a*, 42*b*, and 42*c*, the control unit 94 is configured to determine if either one of the sensors 92 in the corresponding pair of the sensors 92, or the other of the sensors 92, senses the presence or extension of the latch bar 124 within the slot 86*c*. In an exemplary embodiment, the control unit 94 controls the operation of at least the actuator 16. In an exemplary embodiment, the operator of the tube expander 10 uses the control panel 132 to control the operation of at least the actuator 16.

Figure 16:
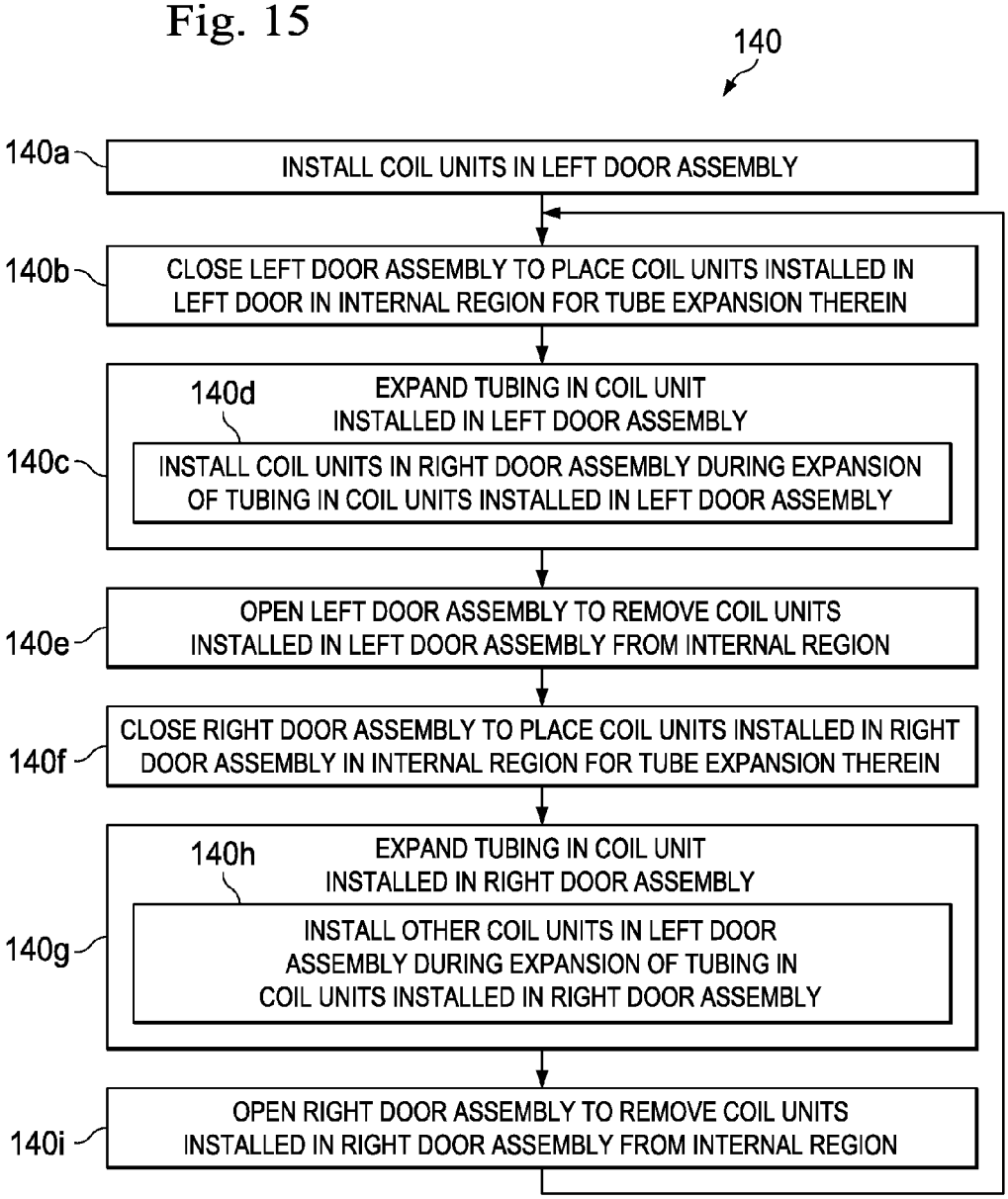
FIG. 16 is a flow chart illustration of a method of expanding tubes in respective ones of a plurality of heat exchanger coil units, according to an exemplary embodiment.

In an exemplary embodiment, as illustrated in FIG. 16 with continuing reference to FIGS. 1-15, a method of operating the tube expander 10 is generally referred to by the reference numeral 140. In several exemplary embodiments, the method 140 may be referred to as a method of expanding tubes in respective ones of a plurality of heat exchanger coil units. The method 140 includes at step 140*a* installing the coil units 50*a* and 50*b* in the left door assembly 44. After the step 140*a*, at step 140*b* the left door assembly 44 is closed so that the coil units 50*a* and 50*b* are disposed in the internal region 48 for tubular expansion therein. After the step 140*b*, at step 140*c* the respective pluralities of tubes in the coil units 50*a* and 50*b* are expanded using the expander rods 22 of the tube expander 10. During the step 140*c*, at step 140*d* two coil units are installed in the right door assembly 46. After the step 140*c*, at step 140*e* the left door assembly 44 is opened to remove the coil units 50*a* and 50*b* from the internal region 48. After the step 140*e*, at step 140*f* the right door assembly 46 is closed so that the two coil units installed therein are disposed in the internal region 48 for tubular expansion therein. After the step 140*f*, at step 140*g* the respective pluralities of tubes in the two coil units installed in the right door assembly 46 are expanded using the expander rods 22 of the tube expander 10. During the step 140*g*, at step 140*h* another two coil units are installed in the left door assembly 44. After the step 140*g*, at step 140*i* the right door assembly 46 is opened to remove the two coil units installed in the right door assembly 46 from the internal region 48. In several exemplary embodiments, the steps

140*b*-140*i* are repeated until all coil units to be expanded have undergone the tubular expansion process.

In several exemplary embodiments, instead of installing coil units in the left door assembly 44 at the steps 140*b* and 140*h*, and installing coil units in the right door assembly 46 at the step 140*f*, coil units may be installed in the right door assembly 46 at the steps 140*b* and 140*h*, and coil units may be installed in the left door assembly 44 at the step 140*f*. In several exemplary embodiments, the method 140 may be modified by replacing the left door assembly 44 in the steps 140*a*-140*i* with the right door assembly 46, and vice versa. In several exemplary embodiments, coil units installed in the right door assembly 46 may undergo a tubular expansion process before any coil units installed in the left door assembly 44 undergo a tubular expansion process. In several exemplary embodiments, in the method 140 as described in greater detail below, all references to the left door assembly 44 may be replaced with the right door assembly 46, and vice versa.

Figure 17:
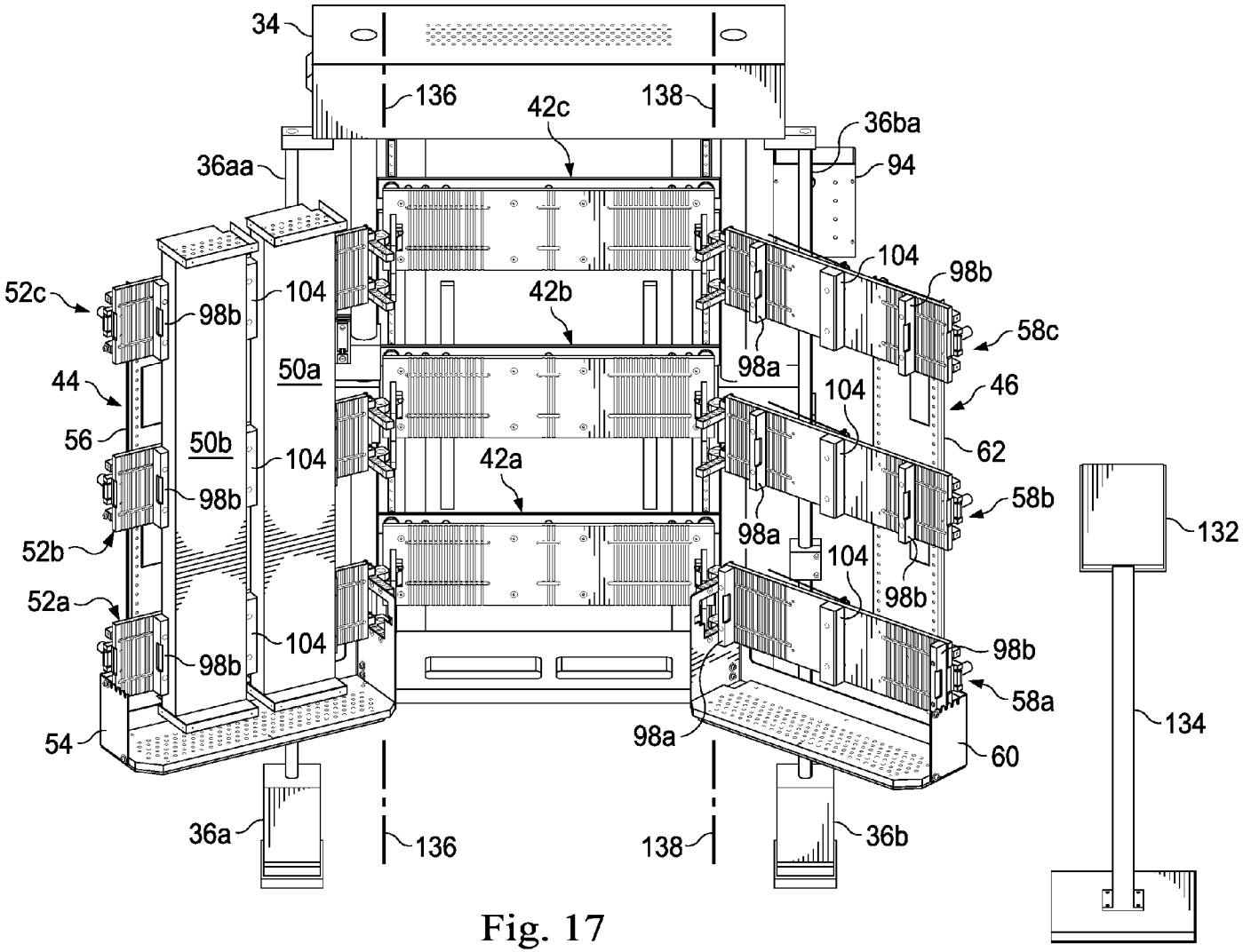
FIG. 17 is a perspective view of the fixture of FIGS. 1, 2, and 11-14 during a step of the method of FIG. 16, according to an exemplary embodiment.

In an exemplary embodiment, as illustrated in FIG. 17 with continuing reference to FIGS. 1-16, to install the coil units 50*a* and 50*b* in the left door assembly 44 at the step 140*a*, the coil unit 50*a* is positioned against the respective inside surfaces 96*c* of the plates 96, and between the center spacer block 104 and the outside spacer block 98*a* of each of the left door units 52*a*, 52*b*, and 52*c*. The rib 104*a* of the center spacer block 104 extends within one of the detents 96*i*, and the rib 98*aa* of the outside spacer block 98*a* extends within one of the detents 96*e*, so that the spacing between the blocks 104 and 98*a* is generally equal to, slightly greater than, or slightly less than, the width of the coil unit 50*a*. As a result, the coil unit 50*a* fits snugly between the respective sets of the blocks 104 and 98*a* of the left door units 52*a*, 52*b*, and 52*c*, thereby connecting the coil unit 50*a* to the left door assembly 44. The 180-degree hairpin bends of the tubes in the coil unit 50*a* are received by respective ones of the U-shaped cavities 64*a* of the receivers 64, and the receivers 64 support the coil unit 50*a* (the receivers 64 are not shown in FIG. 17). Likewise, the coil unit 50*b* is positioned against the respective inside surfaces 96*c* of the plates 96, and between the center spacer block 104 and the outside spacer block 98*b* of each of the left door units 52*a*, 52*b*, and 52*c*. The rib 104*a* of the center spacer block 104 extends within one of the detents 96*i*, and the rib 98*ba* of the outside spacer block 98*b* extends within one of the detents 96*e*, so that the spacing between the blocks 104 and 98*b* is generally equal to, slightly greater than, or slightly less than, the width of the coil unit 50*b*. As a result, the coil unit 50*b* fits snugly between the respective sets of the blocks 104 and 98*b* of the left door units 52*a*, 52*b*, and 52*c*, thereby connecting the coil unit 50*b* to the left door assembly 44. The 180-degree hairpin bends of the tubes in the coil unit 50*b* are received by respective ones of the U-shaped cavities 64*a* of the receivers 64, and the receivers 64 support the coil unit 50*b* (the receivers 64 are not shown in FIG. 17). In an exemplary embodiment, at the step 140*a*, each of the coil units 50*a* and 50*b* is in an initial configuration in which it is a loose assembly of tubes and fins, and the tubes thereof are not yet expanded. In several exemplary embodiments, at the step 140*a*, straps, bands, or other elements may be used to further secure the coil units 50*a* and 50*b* within the left door assembly 44. In an exemplary embodiment, respective straps or bands may be connected to the plates 96 of the left door units 52*a*, 52*b*, and 52*c*, and at the step 140*a* the straps or bands may be disposed around the coil units 50*a* and 50*b* to further secure the coil units 50*a* and 50*b* within the left door assembly 44.

In an exemplary embodiment, as illustrated in FIG. 18*a* with continuing reference to FIGS. 1-17, to close the left door assembly 44 so that the coil units 50*a* and 50*b* are disposed in the internal region 48 at the step 140*b*, the left door assembly 44 is pivoted about the hinge axis 136, moving in a counterclockwise direction as indicated by an arrow 141 in FIG. 18*a*. In an exemplary embodiment, the left door brace 56 facilitates pivoting the left door assembly 44 about the hinge axis 136. As the left door assembly 44 continues to pivot, the respective angularly-extending engagement surfaces 124*c* of the latch bars 124 engage and slide across the corresponding angularly-extending surfaces 86*d* of the respective latch keepers 86 of the right hinge plate assemblies 70*b* of the back units 42*a*, 42*b*, and 42*c*. In response to this sliding engagement, each of the latch bars 24 slides, relative to the corresponding opposing latch brackets 120*a* and 120*b* and towards the corresponding end bracket 128. As a result, the corresponding spring 130 is compressed, or further compressed, between the corresponding end bracket 128 and the corresponding end surface 124*b* of the latch bar 24. As the left door assembly 44 continues to pivot, each of the latch bars 24 slides past the corresponding angularly-extending surface 86*d* of the latch keeper 86, permitting the corresponding spring 130 to extend and push the latch bar 24 into the slot 86*c* of the latch keeper 86. As a result, the left door units 52*a*, 52*b*, and 52*c* are secured to the back units 42*a*, 42*b*, and 42*c*, respectively, the left door assembly 44 is closed, and the coil units 50*a* and 50*b* are disposed in the internal region 48 of the fixture 40.

In an exemplary embodiment, as illustrated in FIG. 18*b* with continuing reference to FIGS. 1-18*a*, to expand the respective pluralities of tubes in the coil units 50*a* and 50*b* at the step 140*c*, the control panel 132 is used to control the actuator 16 via the control unit 94. In particular, the control unit 94 causes the rod 16*a* to extend out of the cylinder 16*b* and move downwards, as viewed in FIG. 1. The pressure plate 18 moves downward in response to the downward movement of the rod 16*a*, causing the expander rods 22 to also move downward, as indicated by an arrow 142 in FIG. 18*b*. The expander rods 22 move downward into the open ends of the tubes in the coil units 50*a* and 50*b*, expanding the tubes into the fins and forming interference fits therebetween. The control unit 94 then causes the rod 16*a* to retract back into the cylinder 16*b*, withdrawing the expander rods 22 out of the expanded tubes. At this point, each of the coil units 50*a* and 50*b* is in a finished configuration in which the tubes are expanded and connected to the fins via the interference fits to provide appropriate thermal conductivity across the tube-and-fin connections.

In an exemplary embodiment, as illustrated in FIG. 18*b* with continuing reference to FIGS. 1-18*a*, at the step 140*d* two coil units, which are referred to by reference numerals 144*a* and 144*b*, are installed in the right door assembly 46. The coil units 144*a* and 144*b* are installed in the right door assembly 46 at the step 140*d* in a manner substantially identical to the above-described manner in which the coil units 50*a* and 50*b* are installed in the left door assembly 44 at the step 140*a*. Therefore, the step 140*d* will not be described in further detail. In an exemplary embodiment, the step 140*d* is carried out during the step 140*c*, as indicated above and in FIG. 16. In an exemplary embodiment, the step 140*d* is carried out before, or after, the step 140*c*. In an exemplary embodiment, the step 140*d* is carried out before the step 140*c*, during the step 140*c*, after the step 140*c*, or any combination thereof.

In an exemplary embodiment, as illustrated in FIG. 18*c* with continuing reference to FIGS. 1-18*b*, to open the left door assembly 44 to remove the coil units 50*a* and 50*b* from the internal region 48 at the step 140*e*, an operator moves the respective handles 126 of the left door units 52*a*, 52*b*, and 52*c* within the corresponding slots 122 so that the corresponding latch bars 124 slide out of the corresponding slots 86*c* of the latch keepers 86 of the right hinge plate assemblies 70*b*. As a result, the respective springs 130 of the left door units 52*a*, 52*b*, and 52*c* are compressed or further compressed. While each of the latch bars 124 are not disposed in the corresponding slot 86*c*, the left door assembly 44 is pivoted about the hinge axis 136 in a clockwise direction, as indicated by arrow 146 in FIG. 18*c*. As a result, the left door assembly 44 is opened and the coil units 50*a* and 50*b* are removed from the internal region 48.

In an exemplary embodiment, as illustrated in FIG. 18*d* with continuing reference to FIGS. 1-18*c*, at the step 140*f* the right door assembly 46 is closed so that the coil units 144*a* and 144*b* are disposed in the internal region 48 for tubular expansion therein. The right door assembly 46 is closed by pivoting the right door assembly 46 about the hinge axis 138 in a clockwise direction, as indicated by an arrow 148 in FIG. 18*d*. The right door assembly 46 is closed at the step 140*f* in a manner substantially identical to the above-described manner in which the left door assembly 44 is closed at the step 140*b*. Therefore, the step 140*f* will not be described in further detail.

In an exemplary embodiment, as illustrated in FIG. 18*d* with continuing reference to FIGS. 1-18*c*, to expand the respective pluralities of tubes in the coil units 144*a* and 144*b* at the step 140*g*, the control unit 94 causes the rod 16*a* to extend out of the cylinder 16*b* and move downwards. The pressure plate 18 moves downward in response to the downward movement of the rod 16*a*, causing the expander rods 22 to also move downward, as indicated by an arrow 150 in FIG. 18*d*. The step 140*g* is substantially identical to the step 140*c* and therefore will not be described in further detail.

In an exemplary embodiment, as illustrated in FIG. 18*d* with continuing reference to FIGS. 1-18*c*, at the step 140*h* another two coil units, which are referred to by reference numerals 152*a* and 152*b*, are installed in the left door assembly 44. To do so, the coil units 50*a* and 50*b* must first be removed from the left door assembly 44, as indicated by an arrow 154 in FIG. 18*d*. To so remove the coil units 50*a* and 50*b*, one or more of the respective center spacer blocks 104, and the outside spacer blocks 98*a* and 98*b*, may be disconnected from the corresponding plates 96 of the left door units 52*a*, 52*b*, and 52*c*. After the removal of the coil units 50*a* and 50*b*, the coil units 152*a* and 152*b* are installed in the left door assembly 44, as indicated by an arrow 156 in FIG. 18*d*. The coil units 152*a* and 152*b* are installed in the left door assembly 44 at the step 140*h* in a manner identical to the above-described manner in which the coil units 50*a* and 50*b* are installed in the left door assembly 44 at the step 140*a*. Therefore, the step 140*h* will not be described in further detail. In an exemplary embodiment, the step 140*h* is carried out during the step 140*g*, as indicated above and in FIG. 16. In an exemplary embodiment, the step 140*h* is carried out before, or after, the step 140*g*. In an exemplary embodiment, the step 140*h* is carried out before the step 140*g*, during the step 140*g*, after the step 140*g*, or any combination thereof.

In an exemplary embodiment, as illustrated in FIG. 18*e* with continuing reference to FIGS. 1-18*d*, at the step 140*i* the right door assembly 46 is opened so that the coil units 144*a* and 144*b* are removed from the internal region 48. The right door assembly 46 is opened by pivoting the right door assembly 46 about the hinge axis 138 in a counterclockwise direction, as indicated by an arrow 158 in FIG. 18*e*. The right door assembly 46 is opened at the step 140*i* in a manner substantially identical to the above-described manner in which the left door assembly 44 is opened at the step 140*e*. Therefore, the step 140*i* will not be described in further detail.

In several exemplary embodiments, the execution of the method 140, and/or the operation of the tube expander 10 including the operation of the fixture 40, greatly decreases the time it takes to manufacture several coil units because the operator of the tube expander 10 does not have to wait until the tubular expansion process is completed for one or more coil units before installing one or more other coil units in the fixture 40; in several exemplary embodiments, the "load-then-wait" process is eliminated.

In several exemplary embodiments, one or more coil units may be installed in the left door assembly 44 and prepared for a tubular expansion process independently of any activities or processes related to one or more other coil units that may be installed in the right door assembly 46, including any tubular expansion process using the tube expander 10. In several exemplary embodiments, one or more coil units may be installed in the right door assembly 46 and prepared for a tubular expansion process independently of any activities or processes related to one or more other coil units that may be installed in the left door assembly 44, including any tubular expansion process using the tube expander 10.

In several exemplary embodiments, the execution of the method 140, and/or the operation of the tube expander 10 including the operation of the fixture 40, allows the operator to process coil units rather than wait during the tubular expansion process.

In several exemplary embodiments, the execution of the method 140, and/or the operation of the tube expander 10 including the operation of the fixture 40, provides at least two coil unit loading or installation points (the door assemblies 44 and 46) on the fixture 40, where the operator can unload and load coil units at one point (one of the door assemblies 44 and 46) while a tubular expansion process occurs at the other point (the other of door assemblies 44 and 46).

In several exemplary embodiments, the lower shroud 54 and the receivers 64 allow for the installation of one or more coil units in the left door assembly 44 to be independent of any installation of one or more other coil units in the right door assembly 46. In several exemplary embodiments, the lower shroud 60 and the receivers 66 allow for the installation of one or more coil units in the right door assembly 46 to be independent of any installation of one or more other coil units in the left door assembly 44.

In several exemplary embodiments, the execution of the method 140, and/or the operation of the tube expander 10 including the operation of the fixture 40, significantly shortens machine cycle time while increasing production capacity.

In several exemplary embodiments, the execution of the method 140, and/or the operation of the tube expander 10 including the operation of the fixture 40, provides a shuttle loading system with two loading points, wherein an operator can unload and load coil units while the tube expander 10 is operating.

Figure 19:
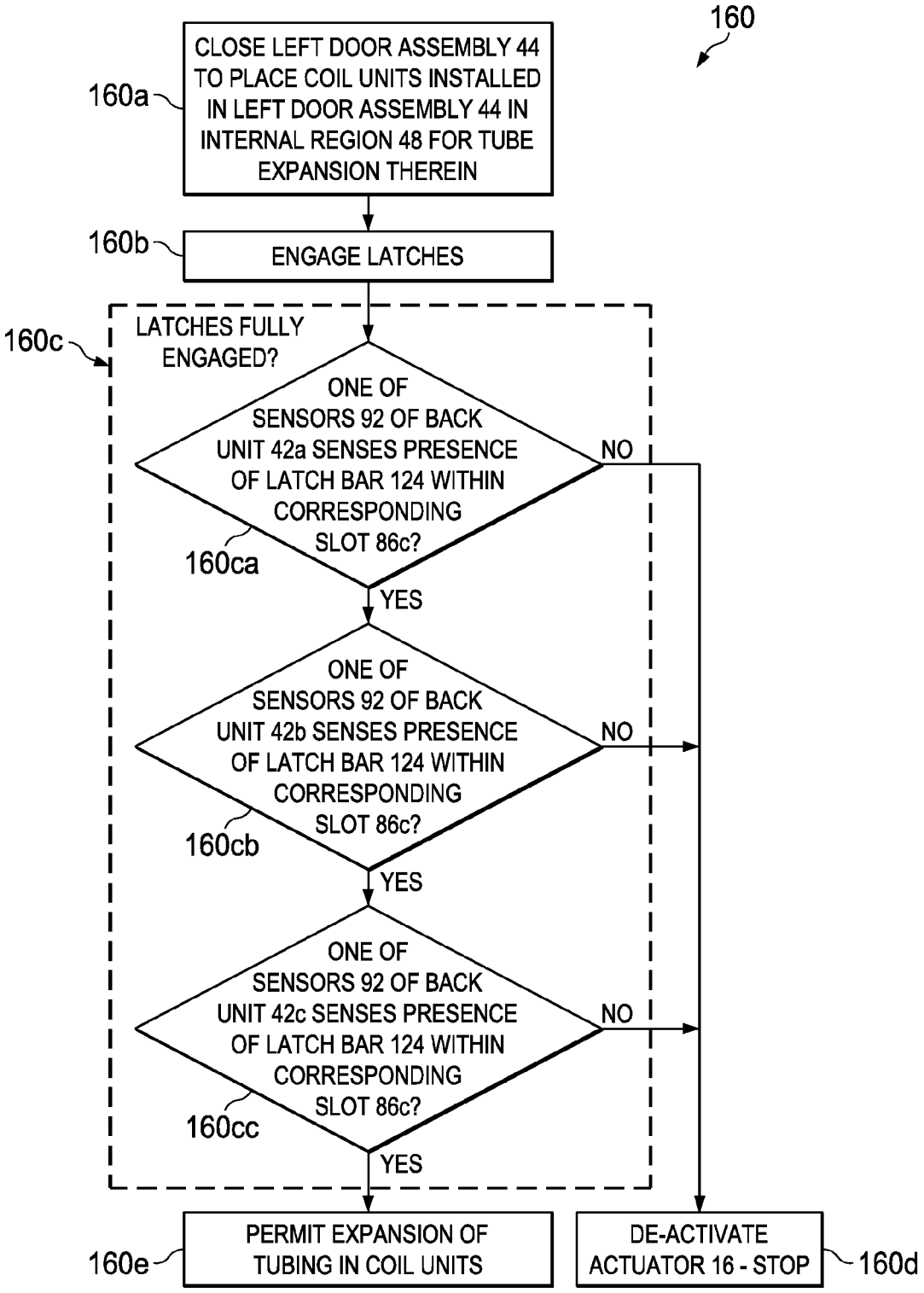
FIG. 19 is a flow chart illustration of a method of securing a door assembly, according to an exemplary embodiment.

In an exemplary embodiment, as illustrated in FIG. 19 with continuing reference to FIGS. 1-18, a flow chart illustration of a method of securing either the left door assembly 44 or the right door assembly to the back units 42*a*, 42*b*, and 42*c* is generally referred to by the reference numeral 160. In an exemplary embodiment, the step 140*b* of the method 140 includes the method 160. In an exemplary embodiment, the step 140*f* of the method 140 includes the method 160.

The method 160 will be described below with respect to securing the left door assembly 44 to the back units 42*a*, 42*b*, and 42*c*, but it is understood that the method 160 applies in the same manner to securing the right door assembly 46 to the back units 42*a*, 42*b*, and 42*c*.

As shown in FIG. 19, the method 160 includes at step 160*a* closing the left door assembly 44 to place coil unit(s) installed therein (e.g., the coil units 50*a* and 50*b*, or the coil units 152*a* and 152*b*) in the internal region 48 for tubular expansion therein. At step 160*b*, the latch bars 124 are engaged with the respective latch keepers 86. At step 160*c*, it is determined whether the latch bars 24 are fully engaged with the respective latch keepers 86. If not, then at step 160*d* the actuator 16 is deactivated and any ongoing tubular expansion process using the tube expander 10 is stopped, and/or any planned tubular expansion process using the tube expander 10 is not permitted to begin. If it is determined at the step 160*c* that the latch bars 24 are fully engaged with the respective latch keepers 86, then at step 160*e* any ongoing and/or planned tubular expansion processes using the tube expander 10 is permitted.

In an exemplary embodiment, the step 160*a* is identical to the above-described step 140*b* of the method 140. Therefore, the step 160*a* will not be described in further detail.

In an exemplary embodiment, at the step 160*b*, the latch bars 124 of the left door assembly 44 are engaged with the respective latch keepers 86 of the right hinge plate assemblies 70*b* of the back units 42*a*, 42*b*, and 42*c*. More particularly, at the step 160*b*, the handles 126 are gripped and moved within the slots 122, respectively, causing the latch bars 124 to move horizontally. The handles 126 are moved horizontally towards the respective latch keepers 86 and away from the respective end brackets 128 so that the latch bars 124 extend within the respective slots 86*c* and thus the latch bars 124 are engaged with the respective latch keepers 86. In an exemplary embodiment, the step 160*b* is omitted from the method 160 because the springs 130 move the latch bars 124 horizontally and towards the latch keepers 86 so that the latch bars 124 extend within the respective slots 86*c*, as described above in connection with the step 140*b*. In an exemplary embodiment, the step 160*b* is part of the step 160*a*. In an exemplary embodiment, the steps 160*a* and 160*b* are combined.

Figure 20:
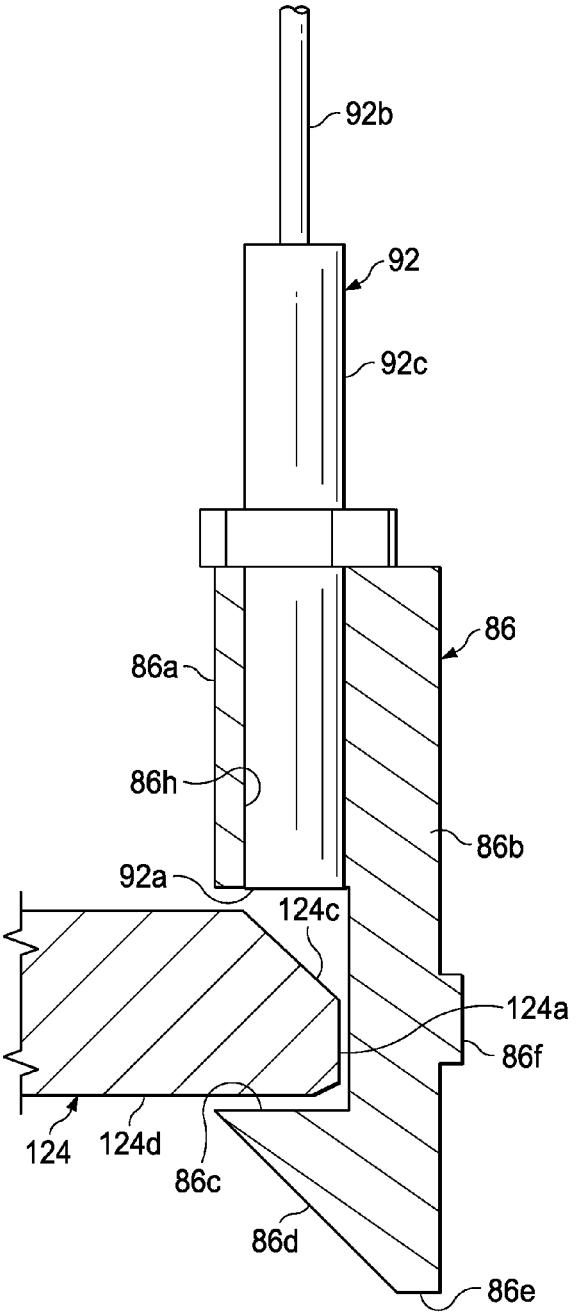
FIG. 20 is a sectional view of components of the tube expander of FIG. 1 during a step of the method of FIG. 19, according to an exemplary embodiment.

In an exemplary embodiment, as illustrated in FIGS. 19 and 20 with continuing reference to FIGS. 1-18, to determine whether the latch bars 124 are fully engaged with the respective latch keepers 86 at the step 160*c*, it is determined at 160*ca* whether one of the sensors 92 of the back unit 42*a* senses the presence of the corresponding latch bar 124 in the corresponding slot 86*c*, it is determined at 160*cb* whether one of the sensors 92 of the back unit 42*b* senses the presence of the corresponding latch bar 124 in the corresponding slot 86*c*, and it is determined at 160*cc* whether one of the sensors 92 of the back unit 42*c* senses the presence of the corresponding latch bar 124 in the corresponding slot 86*c*. If it is determined at any one of the steps 160*ca*, 160*cb*, and 160*cc* that one of the sensors 92 does not sense the presence of the corresponding latch bar 124, then the step 160*d* is executed. In several exemplary embodiments, the control unit 94 automatically makes the determination at the step 160*c*, including the respective determinations at the steps 160*ca*, 160*cb*, and 160*cc*, based on the communication of the control unit 94 with each pair of sensors 92 in the back units 42*a*, 42*b*, and 42*c*. Since the left door assembly 44 is closed at the step 160*a*, it is impossible for the right door assembly 46 to be closed and the latch bars 124 of the right door assembly 46 to be fully engaged with the respective latch keepers 86; thus, the determination at each of the steps 160*ca*, 160*cb*, and 106*cc* is directed to determining whether the sensor 92 of the hinge plate assembly 70*b* senses the presence of the corresponding latch bar 24 of the left door unit 52*a*, 52*b*, or 52*c*.

In an exemplary embodiment, as shown in FIG. 20, the sensor 92 is a proximity sensor and operates to determine whether an object (that is, the latch bar 124) is close enough to the face 92*a* of the sensor 92. In an exemplary embodiment, the sensors 92 are electrically coupled in parallel to the control unit 94. In an exemplary embodiment, each of the pairs of sensors 92 of the back units 42*a*, 42*b*, and 42*c* are electrically coupled in parallel to the control unit 94. In an exemplary embodiment, at the step 160*c*, for each of the back units 42*a*, 42*b*, and 42*c*, the control unit 94 determines if one of the sensors 92 in the corresponding pair of the sensors 92 senses the presence or extension of the latch bar 124 within the slot 86*c*. If not, then at the step 160*c* the control unit 94 determines that the latch bars 124 of the left door assembly 44 are not fully engaged with the respective latch keepers 86 and the step 160*d* is executed.

In an exemplary embodiment, at the step 160*d*, the control unit 94 does not permit the actuator 16 of the tube expander 10 to operate to conduct the tubular expansion process within the heat exchanger coil units 50*a* and 50*b* when the left door assembly 44 is closed and one or more of the respective sensors 92 of the hinge plate assemblies 70*b* do not sense the presence of the corresponding latch bar 124 of the left door assembly within the slot 86*c*, regardless of whether the latch bar 124 extends within the slot 86*c*.

In an exemplary embodiment, at the step 160*d*, a status indicator on the left door assembly 44 emits light to indicate that all of the latch bars 124 of the left door assembly 44 are not fully engaged with the respective latch keepers 86. In an exemplary embodiment, each of the left door units 52*a*, 52*b*, and 52*c* includes a status indicator; at the step 160*d*, at least one of the status indicators emits light to indicate that the corresponding left door unit 52*a*, 52*b*, or 52*c* is not fully engaged. In an exemplary embodiment, at the step 160*d*, one or more status indicators on the left door assembly 44, the control unit 94, the control panel 132, or any combination thereof, emit light to indicate that not all of the latch bars 124 of the left door assembly 44 are fully engaged with the respective latch keepers 86.

In an exemplary embodiment, if it is determined at each of the steps 160*ca*, 160*cb*, and 160*cc* that one of the sensors 92 does indeed sense the presence of the corresponding latch bar 124, then the step 160*e* is executed. In an exemplary embodiment, if at the step 160*c* the control unit 94 determines that, for each of the back units 42*a*, 42*b*, and 42*c*, one of the sensors 92 in the corresponding pair of the sensors 92 senses the presence or extension of the latch bar 124 within the slot 86*c*, then at the step 160*c* the control unit 94 determines that the latch bars 124 of the left door assembly 44 are fully engaged with the respective latch keepers 86 and the step 160*e* is executed.

In an exemplary embodiment, at the step 160*e*, the control unit 94 permits the actuator 16 of the tube expander 10 to operate to conduct the tubular expansion process within the heat exchanger coil units 50 and 50*b* when the left door assembly 44 is closed, the latch bars 124 of the left door assembly 44 extend within the corresponding slots 86*c*, and each of the sensors 92 of the respective hinge plate assemblies 70*b* senses the presence of the corresponding latch bar 124 within the slot 86*c*.

In an exemplary embodiment, at the step 160*e*, a status indicator on the left door assembly 44 emits light to indicate that the latch bars 124 of the left door assembly 44 are fully engaged with the respective latch keepers 86. In an exemplary embodiment, each of the left door units 52*a*, 52*b*, and 52*c* includes a status indicator; at the step 160*e*, each status indicator emits light to indicate that the corresponding left door unit 52*a*, 52*b*, or 52*c* is fully engaged. In an exemplary embodiment, at the step 160*e*, one or more status indicators on the left door assembly 44, the control unit 94, the control panel 132, or any combination thereof, emit light to indicate that the latch bars 124 of the left door assembly 44 are fully engaged with the respective latch keepers 86.

In several exemplary embodiments, the execution of the method 160, and/or the operation of the tube expander 10 including the operation of the fixture 40, ensures that the left door assembly 44 does not accidentally open during a tubular expansion process. In several exemplary embodiments, the execution of the method 160, and/or the operation of the tube expander 10 including the operation of the fixture 40, improves operator safety. In several exemplary embodiments, the execution of the method 160, and/or the operation of the tube expander 10 including the operation of the fixture 40, prevents the occurrence of a destructive tubular expansion process due to an unconstrained coil unit, that is, a coil unit connected to the left door assembly 44 when the left door assembly 44 is not secured to the back units 42*a*, 42*b*, and 42*c*.

Figure 21A:
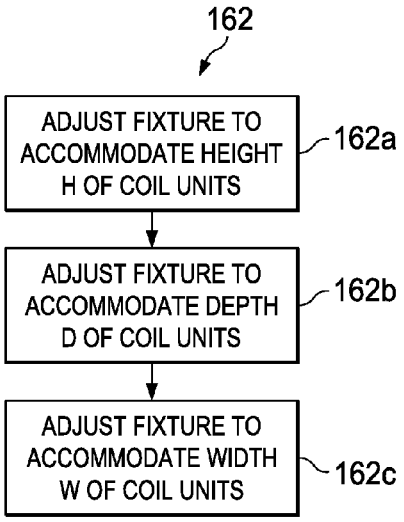
FIG. 21A is flow chart illustration of a method of adjusting the fixture of FIGS. 1, 2, and 11-14 to accommodate coil units of different sizes, according to an exemplary embodiment.
Figure 21B:
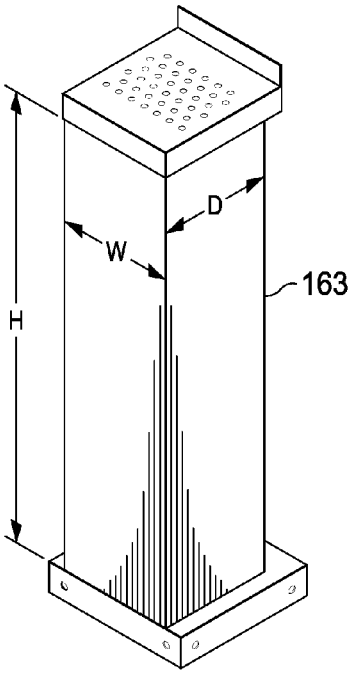
FIG. 21B is a perspective view of a coil unit and dimensions thereof, according to an exemplary embodiment.

In an exemplary embodiment, as illustrated in FIGS. 21A and 21B with continuing reference to FIGS. 1-20, a method of adjusting the fixture 40 to accommodate different sizes of coil units is generally referred to by the reference numeral 162. The method 162 includes adjusting the fixture 40 to accommodate the height H of a coil unit 163 at step 162*a*, adjusting the fixture 40 to accommodate the width W of the coil unit 163 at step 162*b*, and adjusting the fixture 40 to accommodate the depth D of the coil unit 163 at step 162*c*. The method 162, or one or more of the steps 162*a*, 162*b*, and 162*c*, may be necessary due to variances in one or more of the height H, the width W, and the depth D of the coil unit 53 and other coil units, such as the coil unit 50*a* shown in FIG. 17.

Figure 22:
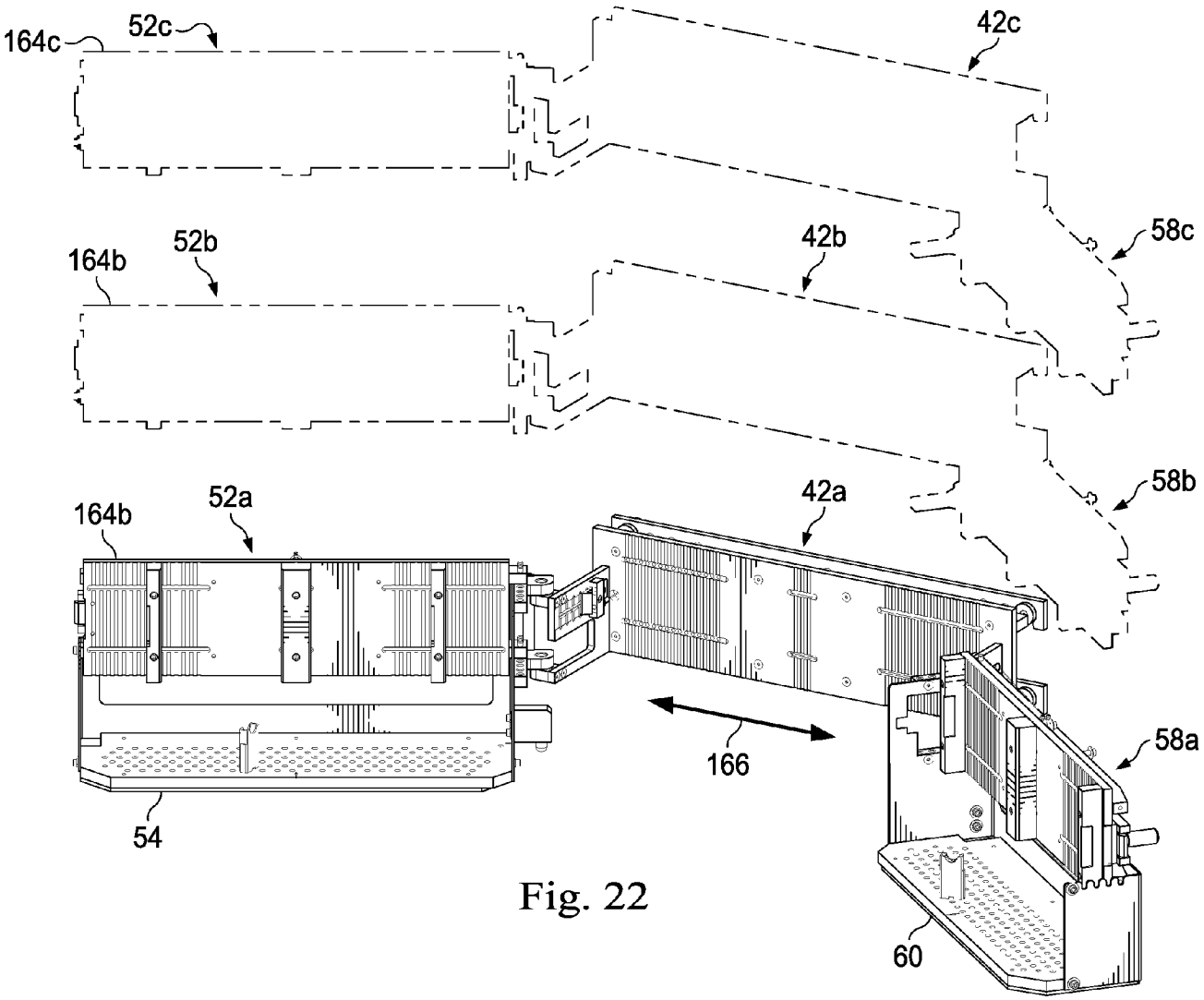
FIG. 22 is a perspective view of the fixture of FIGS. 1, 2, 11-14, and 17 during a step of the method of FIG. 21A, according to an exemplary embodiment.

In an exemplary embodiment, as illustrated in FIG. 22 with continuing reference to FIGS. 1-21B, to adjust the fixture 40 to accommodate the height H of a coil unit at the step 162*a*, one or both of the back units 42*b* and 42*c* are removed if the height H of the coil unit to be expanded is less than the height H of, for example, the coil unit 50*a* shown in FIG. 17. The removal of one or both of the back units 42*b* and 42*c* is dependent upon the degree to which the height H of the coil unit to be expanded is less than the height H of, for example, the coil unit 50*a* shown in FIG. 17. If the back unit 42*c* is removed, the left door unit 52*c* and the right door unit 58*c* are also removed. If the back unit 42*b* is also removed, the left door unit 52*b* and the right door unit 58*b* are also removed. In several exemplary embodiments, the fixture 40 is described as including modules 164*a*, 164*b*, and 164*c*. In several exemplary embodiments, the modules 164*a*, 164*b*, and 164*c* are identical. The module 164*a* is the combination of the back unit 42*a*, the left door unit 52*a* hingedly connected to the back unit 42*a*, and the right door unit 58*a* hingedly connected to the back unit 42*a*. The module 164*b* is the combination of the back unit 42*b*, the left door unit 52*b* hingedly connected to the back unit 42*b*, and the right door unit 58*b* hingedly connected to the back unit 42*b*. The module 164*c* is the combination of the back unit 42*c*, the left door unit 52*c* hingedly connected to the back unit 42*c*, and the right door unit 58*c* hingedly connected to the back unit 42*c*. In an exemplary embodiment, to adjust the fixture 40 to accommodate the height H of a coil unit at the step 162*a*, at least one other module identical to the module 164*c* is connected to the T-tracks 32*a* and 32*b* in a manner identical to the above-described manner in which the module 164*c*, and in particular the back unit 42*c*, is connected to the T-tracks 32*a* and 32*b*. The at least one other module identical to the module 164*c* is positioned above the module 164*c*. The number of other modules to add to the fixture 40 is dependent upon the degree to which the height H of the coil unit to be expanded is greater than the height H of, for example, the coil unit 50*a* shown in FIG. 17. Additionally, to adjust the fixture 40 to accommodate the height H of the coil unit to be expanded, the respective vertical positions of each of the modules 164*b* and 164*c* may be adjusted by moving the module 164*b* or 164*c* up or down a predetermined increment, which predetermined increment corresponds to the vertical spacing between each pair of vertically adjacent mount points along each of the T-tracks 32*a* and 32*b*.

In an exemplary embodiment, as indicated in FIG. 22, the fixture 40 includes at least one module, that is, the module 164*a*, and is centered around a repeating, fixed height module mounted on, or connected to, the T-tracks 32*a* and 32*b*. In several exemplary embodiments, the T-tracks 32*a* and 32*b* include mount points with one-inch centers. The connection of the T-tracks 32*a* and 32*b* to the frame 12, and the respective connections between the T-tracks 32*a* and 32*b* and one or more of the modules 164*a*, 164*b*, and 164*c*, and optionally one or more other modules identical to the module 164*a*, 164*b*, or 164*c*, eliminate the need for an operator to establish horizontal alignment in the direction indicated by arrows 166 in FIG. 22. In several exemplary embodiments, the modules 164*a*, 164*b*, and 164*c* are a common, interchangeable, lightweight set of components, which are easy to connect to, and remove from, the frame 12. In several exemplary embodiments, the modules 164*a*, 164*b*, and 164*c* provide improved machine setup time and reduced downtime between jobs.

In an exemplary embodiment, instead of, or in addition to modules identical to the module 164*a*, 164*b*, or 164*c*, the fixture 40 includes a module having a height that is less than the height of the module 164*a*, 164*b*, or 164*c*, such as a module having a height that is about half of the height of the module 164*a*, 164*b*, or 164*c*. In an exemplary embodiment, instead of, or in addition to modules identical to the module 164*a*, 164*b*, or 164*c*, the fixture 40 includes a module having a height that is greater than the height of the module 164*a*, 164*b*, or 164*c*.

In an exemplary embodiment, if coils cannot be expanded because the coils are too tall for the module 164*a* but too short for the combination of the modules 164*b* and 164*a*, or if coils cannot be expanded because the coils are too tall for the combination of the modules 164*a* and 164*b* but too short for the combination of the modules 164*a*, 164*b*, and 164*c*, an extension, such as a 4-inch high extension, for the backplate 68 of the module 164*b* or 164*c* is inserted and held with dowel pins; a corresponding embodiment of the door plate 96 accommodates this height extension.

Figure 23:
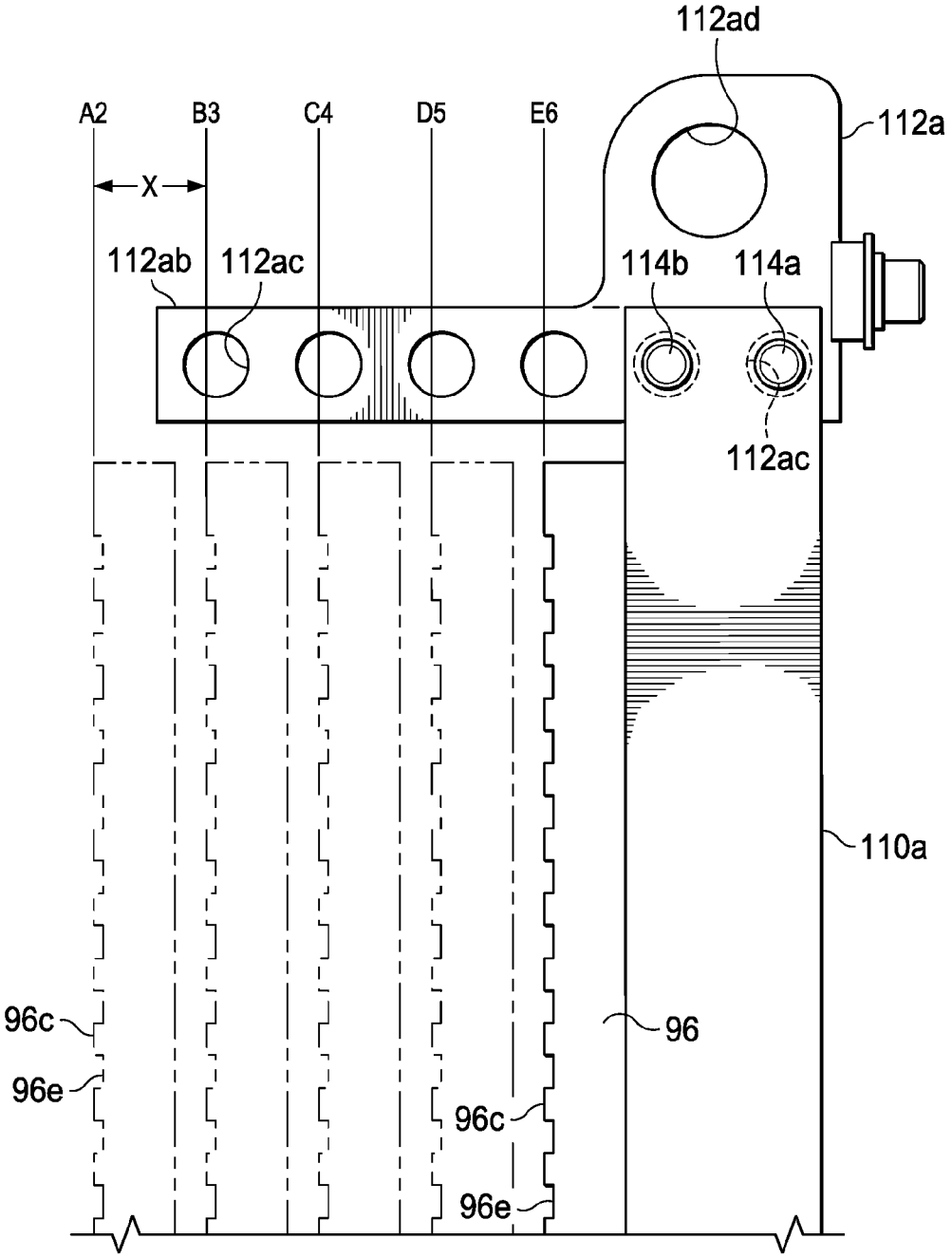
FIG. 23 is a top plan view of a portion of the right door unit of FIGS. 8-10 during another step of the method of FIG. 21A, according to an exemplary embodiment.
Figure 24:
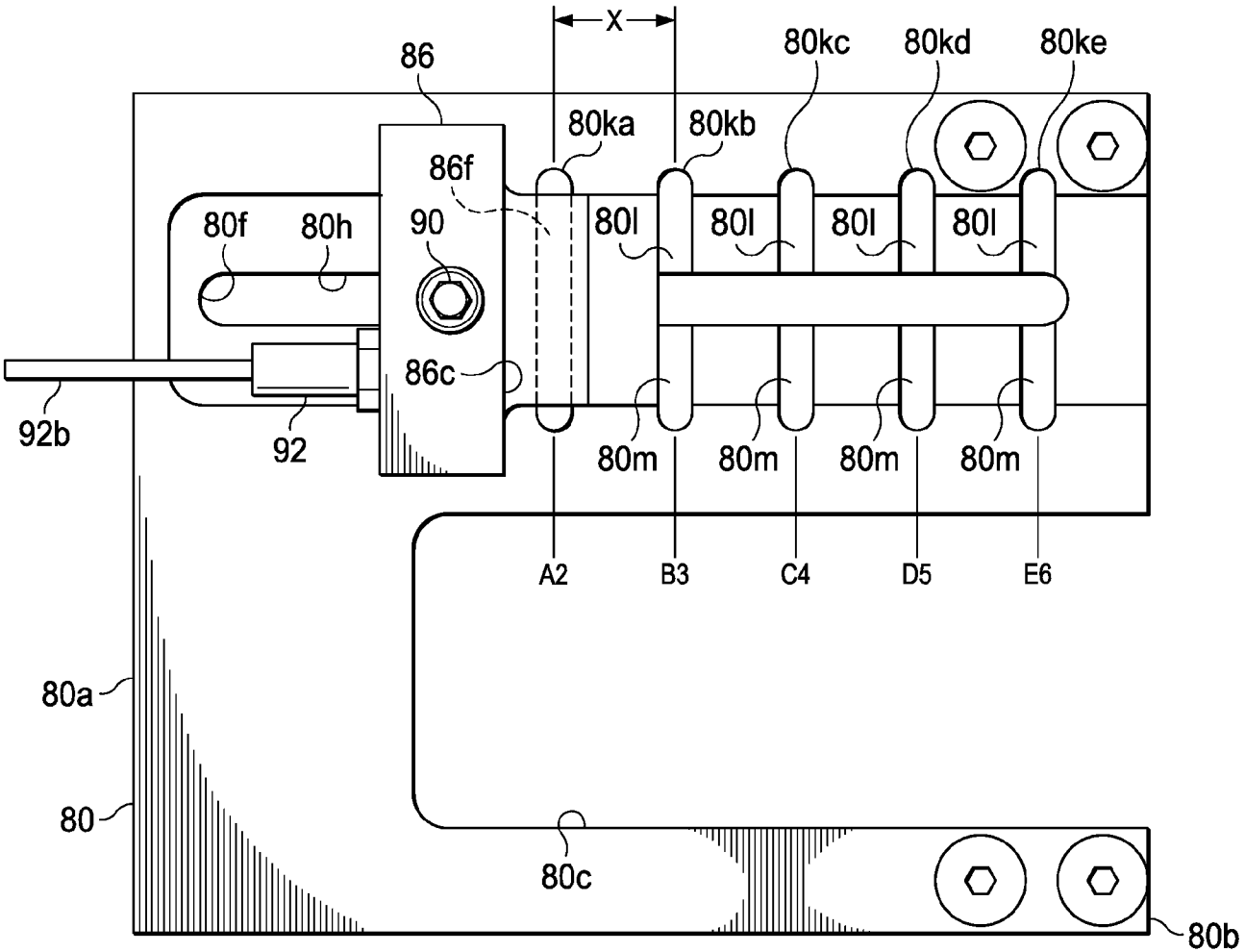
FIG. 24 is an elevational view of the hinge plate assembly of FIGS. 6 and 7 during the other step of the method of FIG. 21A, according to an exemplary embodiment.

In an exemplary embodiment, as illustrated in FIGS. 23 and 24 with continuing reference to FIGS. 1-22, to adjust the fixture 40 to accommodate the depth D of a coil unit at the step 162*b*, the respective positions of the inside surfaces 96*c* of the plates 96 are adjusted, relative to the corresponding pairs of door supports 112*a* and 112*b*, and the respective positions of the latch keepers 86 are also adjusted, relative to the corresponding hinge plates 80.

More particularly, as shown in FIG. 23, the predetermined position of the inside surface 96*c* of the plate 96, relative to the pair of door supports 112*a* and 112*b*, corresponds to a coil unit that has a relatively large depth D. In an exemplary embodiment, the predetermined position of the inside surface 96*c*, relative to the pair of door supports 112*a* and 112*b*, corresponds to a coil unit having a depth D that accommodates six (6) rows of tubes; this predetermined position is referred to as predetermined position E6 in FIG. 23. If the depth D of the coil unit to be installed in the corresponding door assembly 44 or 46 is less than that of a coil unit that has six (6) rows of tubes, the fixture 40 is adjusted by disconnecting the horizontal supports 110*a* and 110*b* from the door supports 112*a* and 112*b*. Relative movement between the horizontal supports 110*a* and 110*b*, and the door supports 112*a* and 112*b*, is then effected, thereby shifting the position of the inside surface 96*c* of the plate 96 to which the horizontal supports 110*a* and 110*b* are connected. The horizontal supports 110*a* and 110*b* are reconnected to the door supports 112*a* and 112*b*, respectively, but using different pairs of the linearly-aligned through openings 112*ac* and 112*bc*. If the coil unit to be installed in the corresponding door assembly 44 or 46 has five (5) rows of tubes, the horizontal supports 110*a* and 110*b*, and thus the plate 96, are shifted to the left, as viewed in FIG. 23, by a predetermined increment X, which corresponds to the center-to-center spacing between adjacent ones of the through openings 112*ac* or 112*bc*. This shift to the left by the increment X results in the predetermined position of the inside surface 96*c*, relative to the door supports 112*a* and 112*b*, corresponding to a coil unit having a depth D that accommodates five (5) rows of tubes; this predetermined position is referred to as predetermined position D5 in FIG. 23. The predetermined positions C4, B3, and A2 in FIG. 23 refer to positions of the inside surface 96*c*, relative to the door supports 112*a* and 112*b*, corresponding to coil units have depths D that accommodate four (4) row of coils, three (3) rows of coils, and two (2) rows of coils, respectively.

As noted above, to execute the step 162*b*, in addition to adjusting the respective positions of the inside surfaces 96*c* of the plates 96, the respective predetermined positions of the latch keepers 86 are also adjusted accordingly. More particularly, as shown in FIG. 24, the position of the latch keeper 86, relative to the hinge plate 80, corresponds to a coil unit having a depth D that accommodates two (2) rows of tubes; this position is referred to as position A2 in FIG. 24. The rib 86*f* of the latch keeper 86 extends within the detent 80*ka* so that the rib 86*f* engages, or is at least proximate, the corresponding pair of surfaces 80*l* and 80*m* defined by the detent 80*ka*. If the depth D of the coil unit to be positioned in the internal region 48 is greater than that of a coil unit that has two (2) rows of tubes, the fixture 40 is adjusted by disconnecting the latch keeper 86 from the hinge plate 80, and moving the latch keeper 86 to the right, as viewed in FIG. 24. The latch keeper 86 is then reconnected to the hinge plate 80, but with the rib 86*f* extending within one of the detents 80*kb*, 80*kc*, 80*kd*, and 80*ke* (rather than the detent 80*ka*). If the coil unit to be positioned in the internal region 48 has three (3) rows of tubes, the latch keeper 86 is disconnected from the hinge plate 80 and shifted to the right, as viewed in FIG. 24, by a predetermined increment equal to the increment X in FIG. 23 and thus also referred to by the increment X in FIG. 24; the increment X corresponds to the center-to-center spacing between adjacent ones of the detents 80*ka*, 80*kb*, 80*kc*, 80*kd*, and 80*ke*. The latch keeper 86 is then reconnected to the hinge plate 80. This shift to the right by the increment X, and subsequent reconnection, results in the rib 86*f* extending within the detent 80*kb* so that the rib 86*f* engages, or is at least proximate, the corresponding pair of surfaces 80*l* and 80*m* defined by the detent 80*kb*; this position of the latch keeper 86 accommodates a coil unit having a depth D that accommodates three (3) rows of tubes, and is referred to as predetermined position B3 in FIG. 24. The predetermined positions C4, D5, and E6 in FIG. 24 refer to positions of the latch keeper 86, relative to the hinge plate 80, corresponding to coil units have depths D that accommodate four (4) row of coils, five (5) rows of coils, and six (6) rows of coils, respectively. The predetermined positions A2, B3, C4, D5, and E6 of the latch keeper 86 in FIG. 24 correspond to the predetermined positions A2, B3, C4, D5, and E6, respectively, of the insider surface 96*c* of the plate 96 in FIG. 23.

Figure 25:
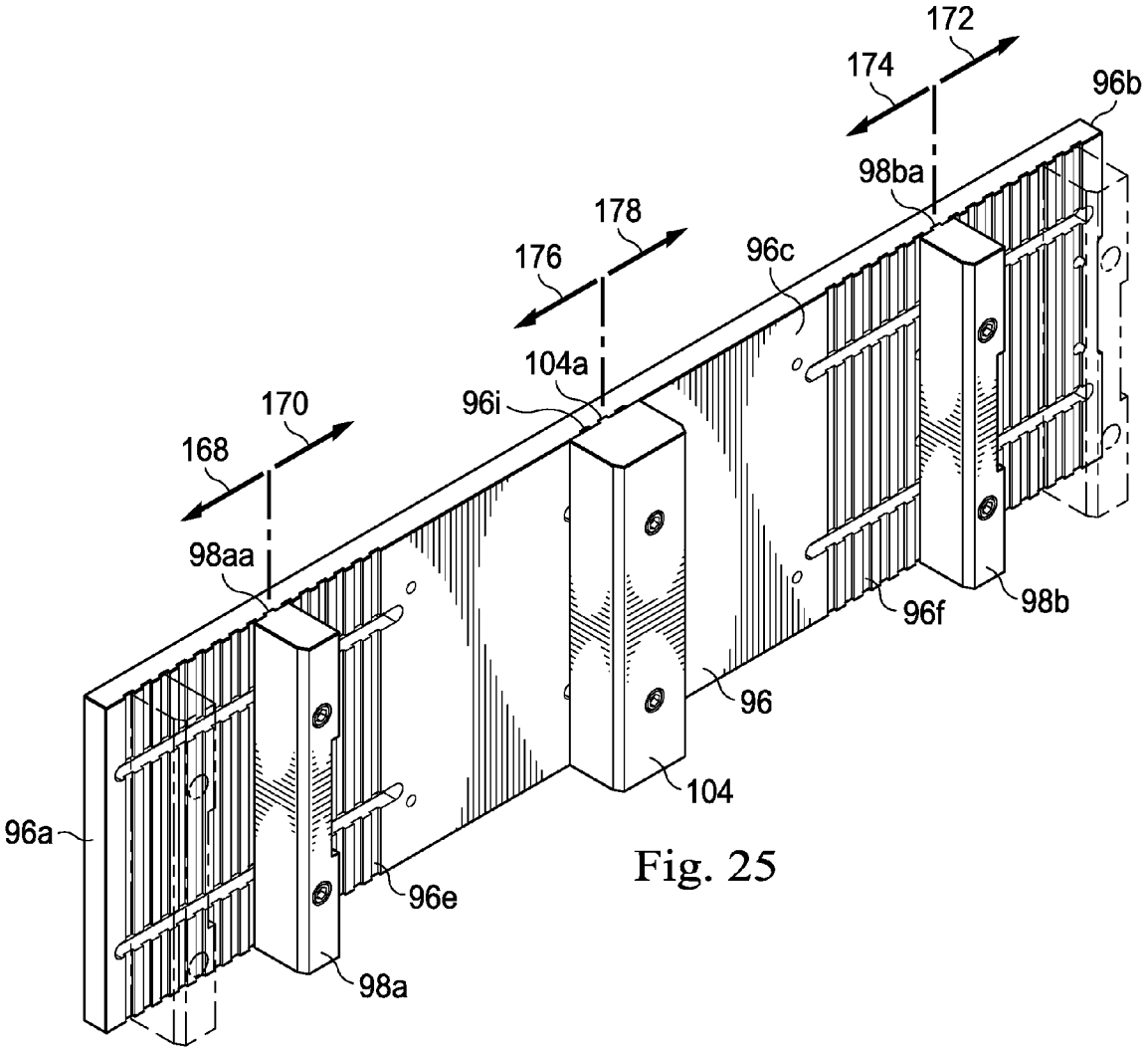
FIG. 25 is a perspective view of a portion of the right door unit of FIGS. 8-10 during yet another step of the method of FIG. 21A, according to an exemplary embodiment.

In an exemplary embodiment, as illustrated in FIG. 25 with continuing reference to FIGS. 1-24, to adjust the fixture 40 to accommodate the width W of a coil unit at the step 162*c*, the respective predetermined positions of one or more of the center spacer block 104 and the outside spacer blocks 98*a* and 98*b* are adjusted. If the width W of the coil unit to be connected to the corresponding door assembly 44 or 46, and to be positioned between the center block 104 and the outside spacer block 98*a*, is greater than the width of the coil unit 144*a*, then the outside spacer block 98*a* is disconnected from the plate 96 and moved to the left, as viewed in FIG. 25 and indicated by an arrow 168. The outside spacer block 98*a* is reconnected to the plate 96 with the rib 98*aa* extending in a different one of the detents 96*e*, at a predetermined position that is closer to the end portion 96*a* of the plate 96. Conversely, if the width W of the coil unit to be connected to the corresponding door assembly 44 or 46 is less than the width of the coil unit 144*a*, then the outside spacer block 98*a* is disconnected from the plate 96 and moved to the right, as viewed in FIG. 25 and indicated by an arrow 170. The outside spacer block 98*a* is reconnected to the plate 96 with the rib 98*aa* extending in a different one of the detents 96*e*, at a predetermined position that is farther away from the end portion 96*a* of the plate 96. Similarly, if the width W of the coil unit to be connected to the corresponding door assembly 44 or 46, and to be positioned between the center block 104 and the outside spacer block 98*b*, is greater than the width of the coil unit 144*b*, then the outside spacer block 98*b* is disconnected from the plate 96 and moved to the right, as viewed in FIG. 25 and indicated by an arrow 172. The outside spacer block 98*b* is reconnected to the plate 96 with the rib 98*ba* extending in a different one of the detents 96*f*, at a predetermined position that is closer to the end portion 96*b* of the plate 96. Conversely, if the width W of the coil unit to be connected to the corresponding door assembly 44 or 46 is less than the width of the coil unit 144*b*, then the outside spacer block 98*b* is disconnected from the plate 96 and moved to the left, as viewed in FIG. 25 and indicated by an arrow 174. The outside spacer block 98*b* is reconnected to the plate 96 with the rib 98*ba* extending in a different one of the detents 96*f*, at a predetermined position that is farther away from the end portion 96*b* of the plate 96. Additionally, the position of the center spacer block 104 may be slightly adjusted in either of the directions indicated by arrows 176 and 178 so that the rib 104*a* extends in either of the outside ones of the detents 96*i*.

In an exemplary embodiment, at the step 162*c*, if the width W of the coil unit to be connected to the corresponding door assembly 44 or 46 is greater than the maximum allowable spacing between the center spacer block 104 and the outside spacer block 98*a* or 98*b*, the center block 104 may be removed and the coil unit may be snugly fit between the outside spacer blocks 98*a* and 98*b* to connect the coil unit to the door assembly 44 or 46, in accordance with the foregoing.

In an exemplary embodiment, at the step 162*c*, if the respective widths W of the coil units to be connected to the corresponding door assembly 44 or 46 are small enough, one or more additional spacer blocks, each of which is similar to the center spacer block 104 or the outside spacer block 98*a* or 98*b*, may be connected to the plate 96 so that three (3) or more coil units may be connected to the door assembly 44 or 46.

In several exemplary embodiments, the execution of the method 162, and/or the operation of the tube expander 10 including the operation of the fixture 40, provide side-to-side constraints that fit into detents spaced apart by one half of the side-to-side rod space interval. These constraints create a width for the coil equivalent to its design width plus permitted tolerance and slight clearance. Moreover, these side constraints may be relocated quickly. In several exemplary embodiments, for depth, the fixture 40 incorporates a fixed center hinge with quick change pin-and-hole mount features for the closing door such that the door can be mounted to create multiple constraining depths, plus tolerance and fit clearance, on the fixed interval of the machine rod spacing. In several exemplary embodiments, the door latch is designed to be quick release and detents located on the machine depth interval are designed to accommodate the various alignments of the door.

In several exemplary embodiments, a door assembly back is selectively placed on a mounting hub connected to a T-Track with fixed interval mounting points. In several exemplary embodiments, the hub mounting and precise T-Track fit create a repeatable positioning, adjustment-free positioning of the door that precisely aligns the coil unit containment feature described above to the expansion ram and vertical rods. Additionally, the pivot axis of the each door module is aligned with all other installed modules. In several exemplary embodiments, these features produce a repeatable, quality product by reducing operator involvement, improving changeover speed between jobs, and minimizing damage to the machine due to misalignment.

Figure 26A:
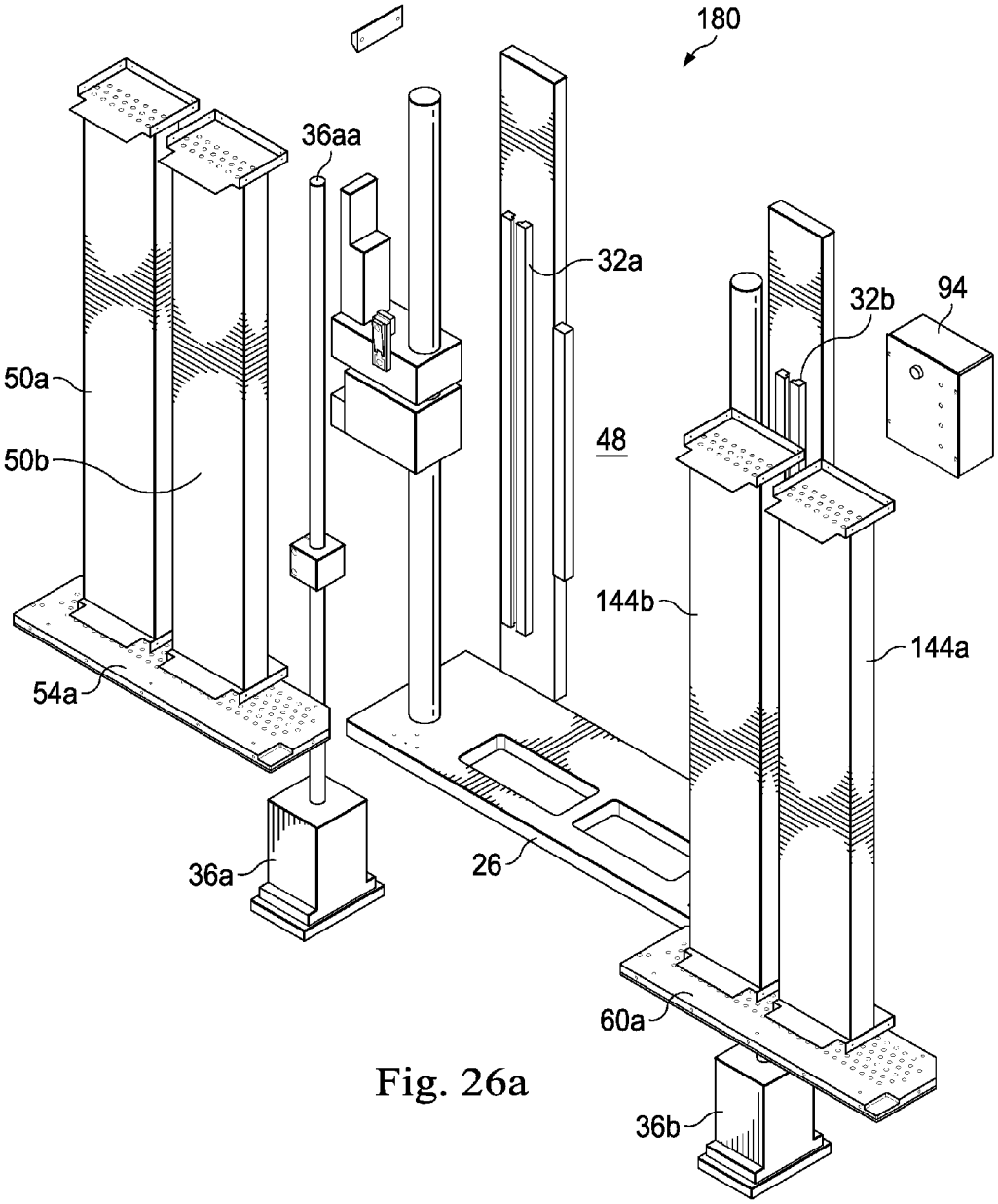
FIGS. 26*a* and 26*b* are perspective views of a fixture of the tube expander of FIG. 1, according to another exemplary embodiment.
Figure 26B:
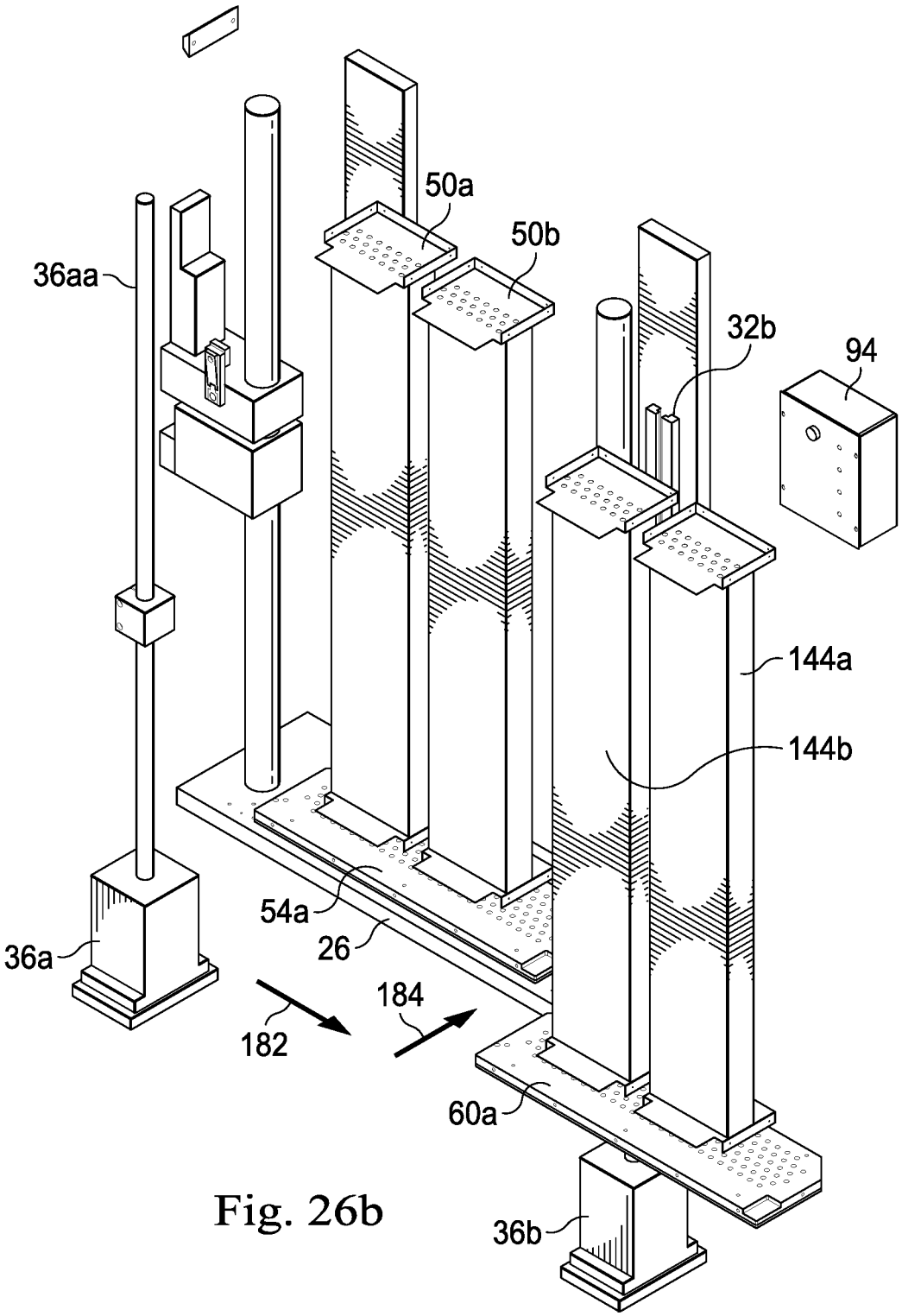

In an exemplary embodiment, as illustrated in FIGS. 26*a* and 26*b* with continuing reference to FIGS. 1-25, a fixture adapted to be connected to the frame 12 of the tube expander 10 is generally referred to by the reference numeral 180. The fixture 180 includes several components that are identical to corresponding components of the fixture 40; these identical components are given the same reference numerals. Like the fixture 40, the fixture 180 is vertically disposed between the upper shroud 34 (not shown in FIGS. 26*a* and 26*b*) and the horizontal support 26. In the fixture 180 illustrated in FIGS. 26*a* and 26*b*, instead of being hingedly connected, each of the left door assembly 44 and the right door assembly 46 is movably connected to the back units 42*a*, 42*b*, and 42*c* by being slidably connected to the back units 42*a*, 42*b*, and 42*c*.

In several exemplary embodiments, the method 140 is executed using the fixture 180 in a manner substantially similar to the above-described manner in which the method 140 is executed using the fixture 40, except that neither the left door assembly 44 nor the right door assembly 46 pivots about a hinge axis. Instead, to close the left door assembly 44 so that the coil units 50*a* and 50*b* are disposed in the internal region 48, the left door assembly 44 is slid, relative to the back units 42*a*, 42*b*, and 42*c* and in a direction indicated by an arrow 182 in FIG. 26*b*. The left door assembly 44 is so slid until the coil units 50*a* and 50*b* are positioned in front of the internal region 48, at which point the left door assembly 44 is translated forwards, relative to the back units 42*a*, 42*b*, and 42*c* and in a direction indicated by an arrow 184 in FIG. 26*b*, to position the coil units 50*a* and 50*b* in the internal region 48. After the tubular expansion process is completed for the coil units 50*a* and 50*b*, the left door assembly 44 is moved in a direction opposite that indicated by the arrow 184, followed by movement in a direction opposite that indicated by the arrow 182. Likewise, to close the right door assembly 46 so that the coil units 144*a* and 144*b* are disposed in the internal region 48, the left door assembly 44 is slid, relative to the back units 42*a*, 42*b*, and 42*c* and in a direction opposite that indicated by the arrow 182 in FIG. 26*b*. The right door assembly 46 is so slid until the coil units 144*a* and 144*b* are positioned in front of the internal region 48, at which point the right door assembly 46 is translated forwards, relative to the back units 42*a*, 42*b*, and 42*c* and in a direction indicated by an arrow 184 in FIG. 26*b*. After the tubular expansion process is completed for the coil units 144*a* and 144*b*, the right door assembly 46 is in a direction opposite that indicated by the arrow 184, followed by movement in a direction indicated by the arrow 182.

In several exemplary embodiments, the execution of the method 140, and/or the operation of the tube expander 10 including the operation of the fixture 180, provides a shuttle loading system with two loading points, wherein an operator can unload and load coil units while the tube expander 10 is operating.

In several exemplary embodiments, the method 160 is executed using the fixture 180 in a manner substantially similar to the above-described manner in which the method 140 is executed using the fixture 40.

In several exemplary embodiments, the method 162 is executed using the fixture 180 in a manner substantially similar to the above-described manner in which the method 140 is executed using the fixture 40.

Figure 27:
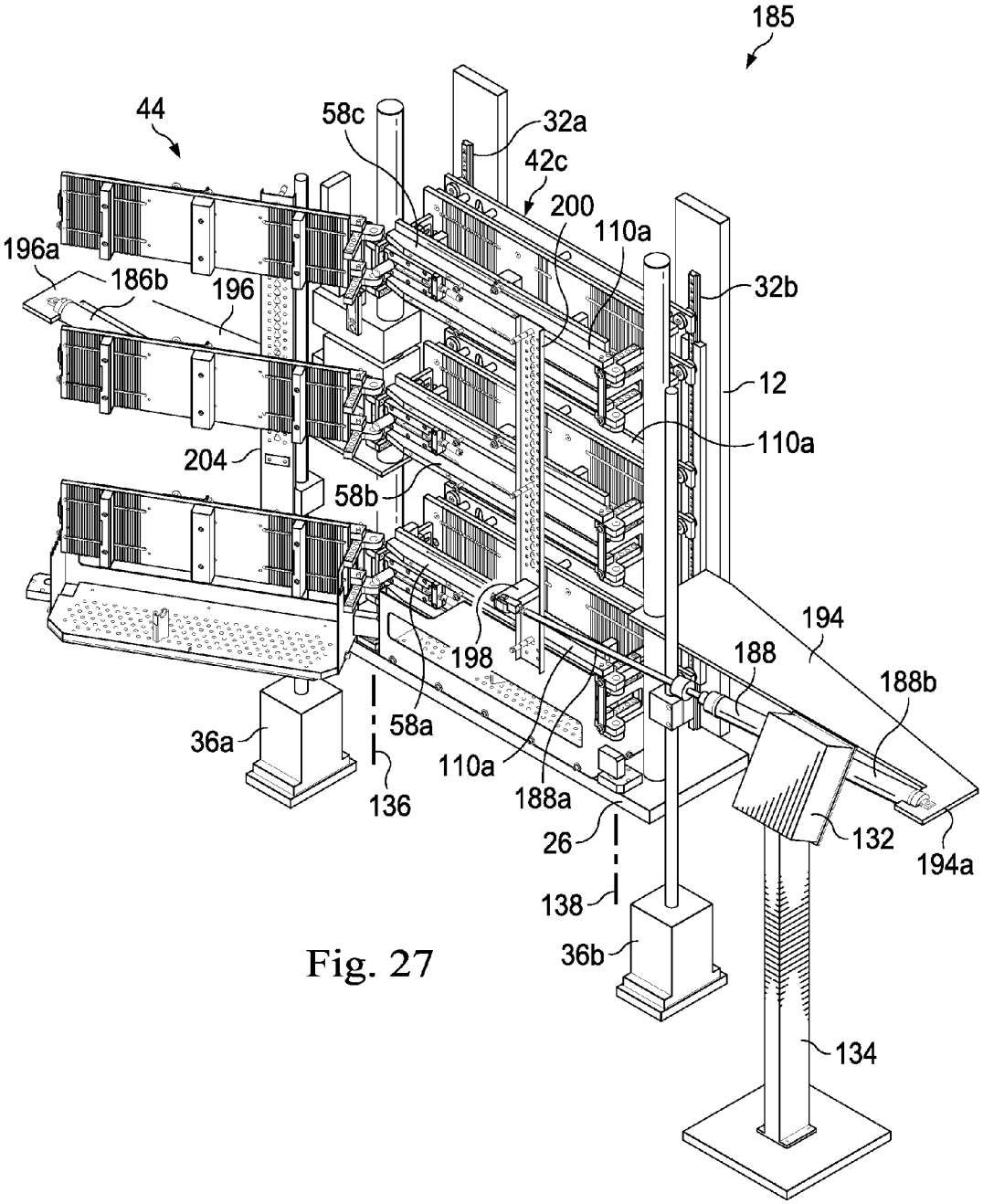
FIG. 27 is a perspective view of a fixture of the tube expander of FIG. 1, according to yet another exemplary embodiment.
Figure 28:
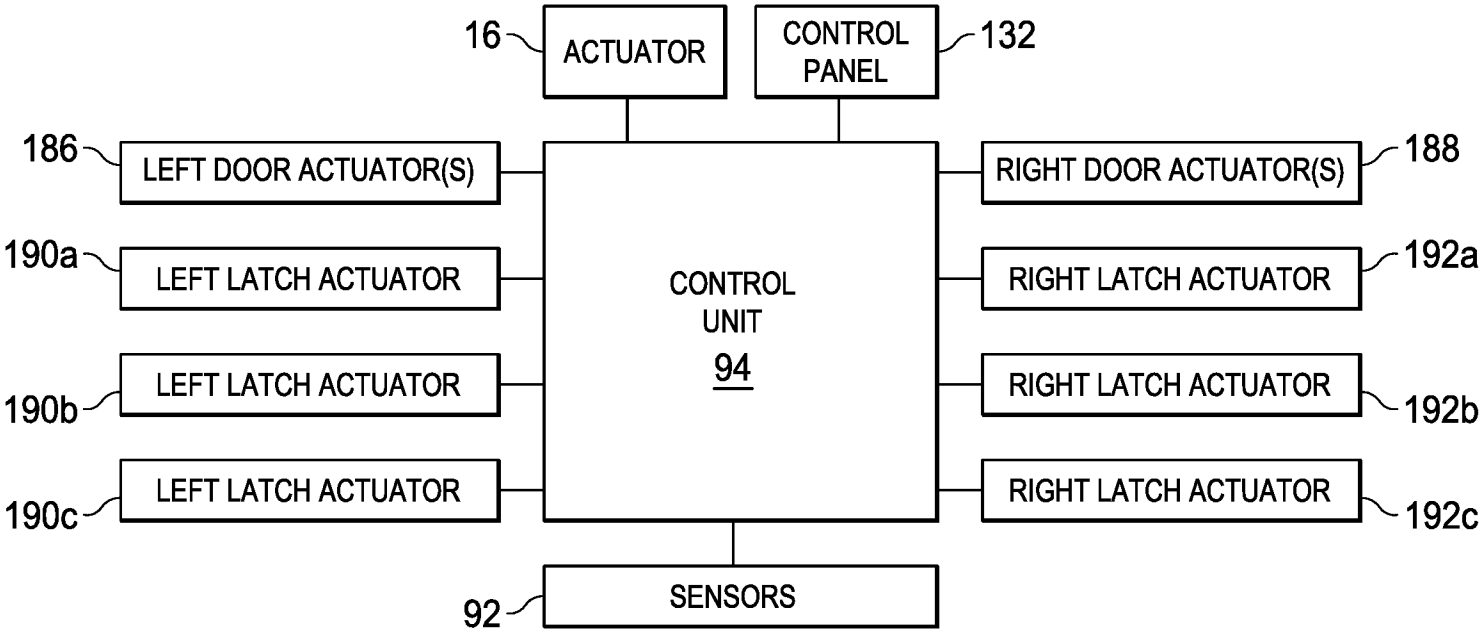
FIG. 28 is a diagrammatic illustration of components of the fixture of FIG. 27 and the tube expander of FIG. 1, according to an exemplary embodiment.

In an exemplary embodiment, as illustrated in FIGS. 27-31 with continuing reference to FIGS. 1-26*b*, a fixture is generally referred to by the reference numeral 185 and includes most of the components of the fixture 40, which components are given the same reference numerals. As shown in FIG. 28, the fixture 40 includes at least one left door actuator 186, at least one right door actuator 188, left latch actuators 190*a*, 190*b*, and 190*c*, and right latch actuators 192*a*, 192*b*, and 192*c*, all of which are in communication with the control unit 94. In an exemplary embodiment, one or more of the actuators 186, 188, 190*a*, 190*b*, 190*c*, 192*a*, 192*b*, and 192*c* are pneumatic actuators. In an exemplary embodiment, one or more of the actuators 186, 188, 190*a*, 190*b*, 190*c*, 192*a*, 192*b*, and 192*c* are hydraulic actuators.

Figure 29:
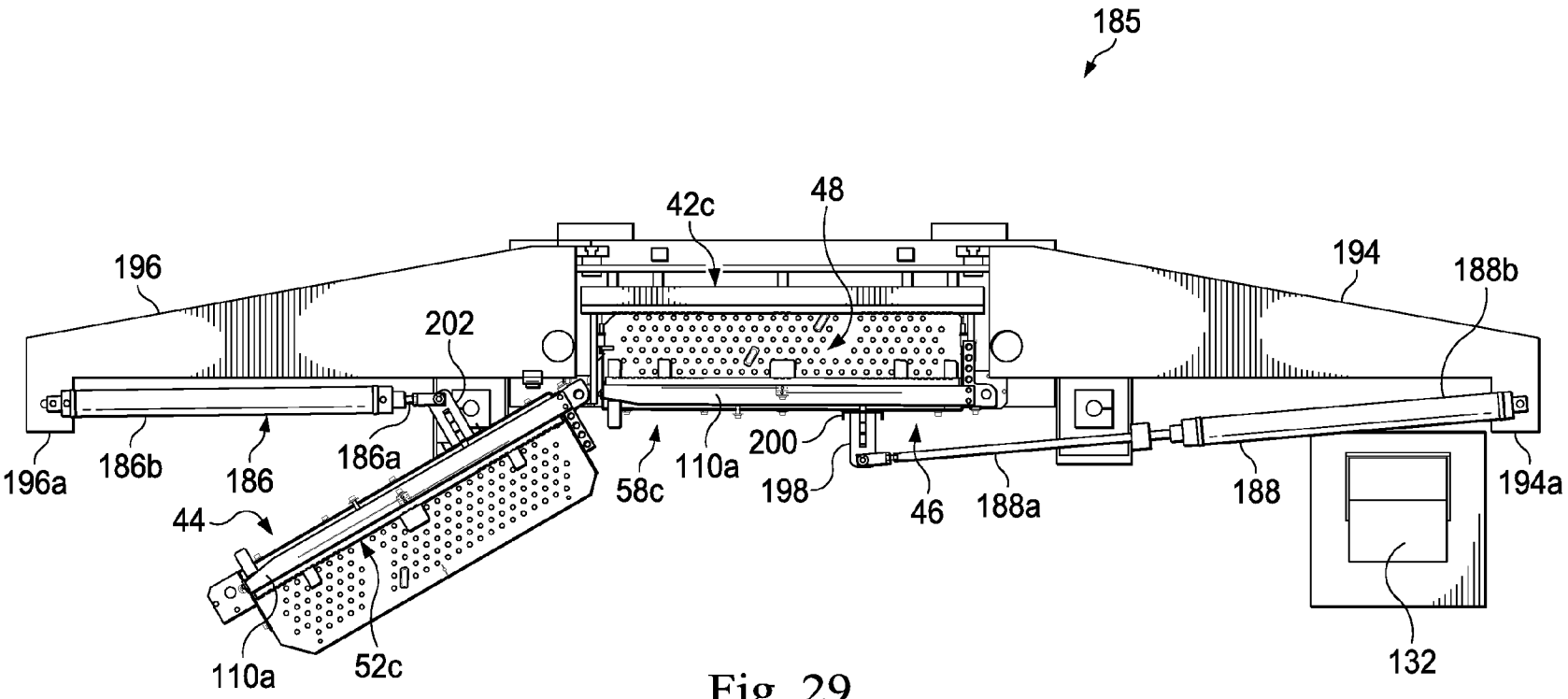
FIG. 29 is a top plan view of the fixture of FIG. 27, according to an exemplary embodiment.

As shown in FIGS. 27 and 29-31, a horizontally-extending support 194 is connected to the frame 12, and extends outward to the right of the fixture 185, as viewed in FIGS. 27 and 29. A horizontally-extending support 196 is connected to the frame 12, and extends outward to the left of the fixture 185, as viewed in FIGS. 27 and 29.

The right door actuator 188 is connected to the horizontally-extending support 194. More particularly, the right door actuator 188 includes a rod 188*a*, which is adapted to reciprocate relative to a cylinder 188*b*. To so reciprocate, the rod 188*a* is adapted to extend out from, and retract into, an end of the cylinder 188*b*. The other end of the cylinder 188*b* is pivotably coupled to a distal end portion 194*a* of the horizontally-extending support 194. The distal end of the rod 188*a* is pivotably connected to a protrusion 198, which extends from a right door brace 200. In the fixture 185, the right door brace 62 is omitted in favor of the right door brace 200. In the fixture 185, the right door brace 200 is connected to each of the right door units 58*a*, 58*b*, and 58*c*. The lower end portion of the right door brace 200 is connected to the horizontal support 110*a* of the right door unit 58*a*. The right door brace 200 extends upwards from the horizontal support 110*a* of the right door unit 58*a*, and is connected to the horizontal support 110*a* of the right door unit 58*b*. The right door brace 200 extends upwards from the horizontal support 110*a* of the right door unit 58*b*, and is connected to the horizontal support 110*a* of the right door unit 58*c*. The right door brace 200 connects the right door units 58*a*, 58*b*, and 58*c* together so that the right door units 58*a*, 58*b*, and 58*c* pivot together about the hinge axis 138.

The left door actuator 186 is connected to the horizontally-extending support 196. More particularly, the left door actuator 186 includes a rod 186*a*, which is adapted to reciprocate relative to a cylinder 186*b*. To so reciprocate, the rod 186*a* is adapted to extend out from, and retract into, an end of the cylinder 186*b*. The other end of the cylinder 186*b* is pivotably coupled to a distal end portion 196*a* of the horizontally-extending support 196. The distal end of the rod 186*a* is pivotably connected to a protrusion 202, which extends from a left door brace 204. In the fixture 185, the left door brace 56 is omitted in favor of the left door brace 204. In the fixture 185, the left door brace 204 is connected to each of the left door units 52*a*, 52*b*, and 52*c*. The lower end portion of the left door brace 204 is connected to the horizontal support 110*a* of the left door unit 52*a*. The left door brace 204 extends upwards from the horizontal support 110*a* of the left door unit 52*a*, and is connected to the horizontal support 110*a* of the left door unit 52*b*. The left door brace 204 extends upwards from the horizontal support 110*a* of the left door unit 52*b*, and is connected to the horizontal support 110*a* of the left door unit 52*c*. The left door brace 204 connects the left door units 52*a*, 52*b*, and 52*c* together so that the left door units 52*a*, 52*b*, and 52*c* pivot together about the hinge axis 136.

Figure 30:
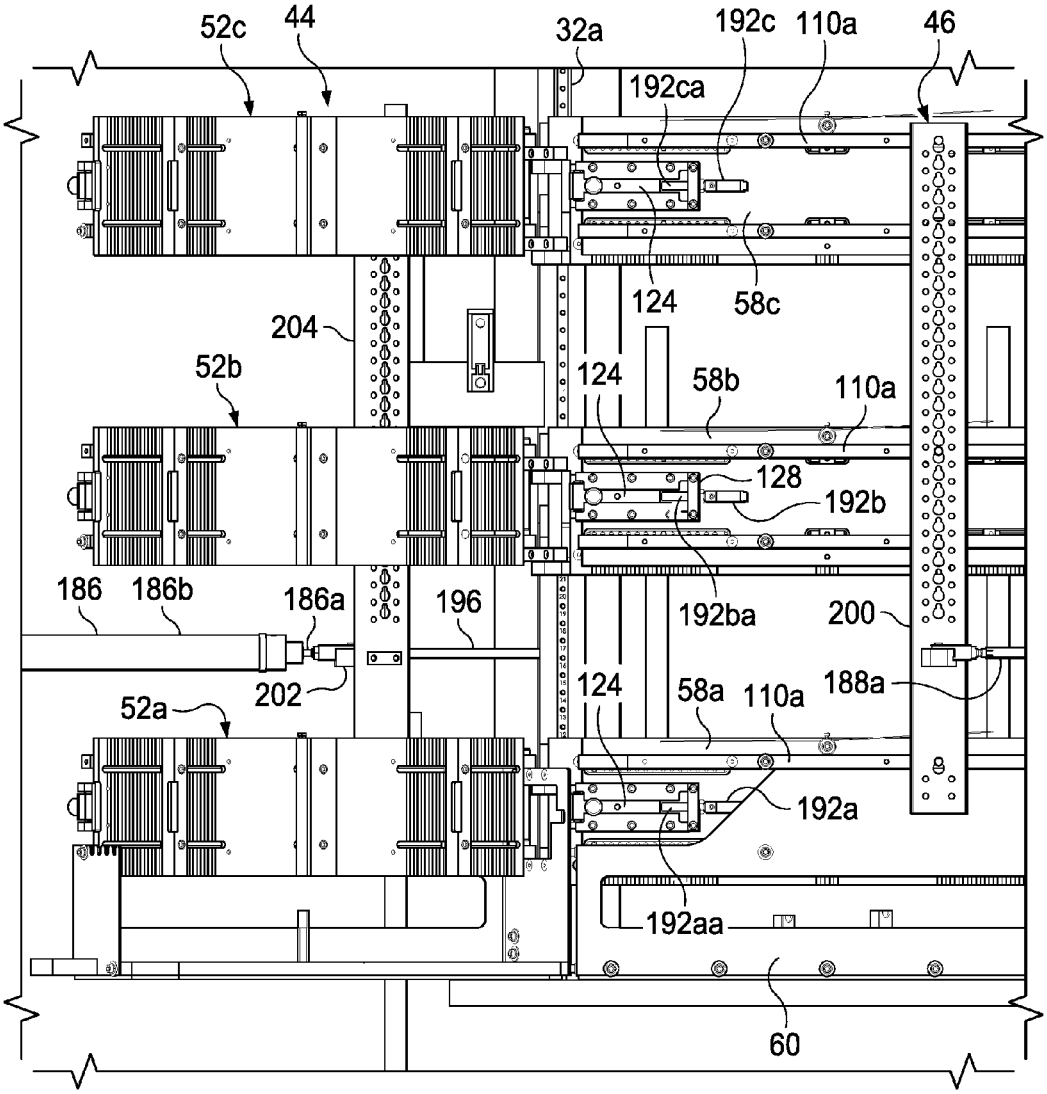
FIG. 30 is a front elevational view of a portion of the fixture of FIGS. 27 and 29, according to an exemplary embodiment.
Figure 31:
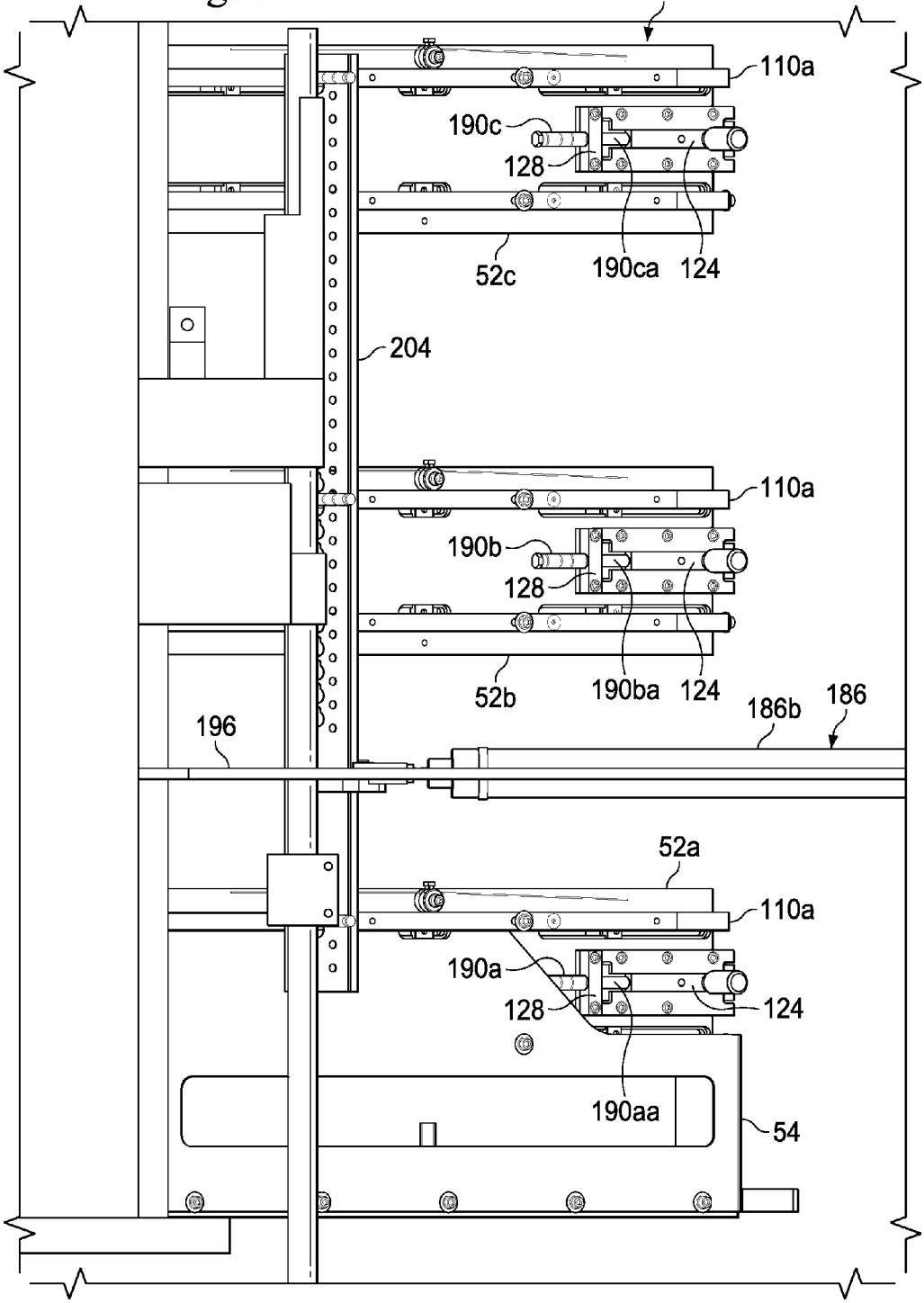
FIG. 31 is a left side elevational view of a portion of the fixture of FIGS. 27, 29, and 30, according to an exemplary embodiment.

As shown most clearly in FIG. 30, the right latch actuators 192*a*, 192*b*, and 192*c* are connected to the respective end brackets 128 of the right door units 58*a*, 58*b*, and 58*c*. The right latch actuators 192*a*, 192*b*, and 192*c* include actuating members 192*aa*, 192*ba*, and 192*ca*, respectively, which are adapted to operably engage the respective latch bars 124 of the right door units 58*a*, 58*b*, and 58*c*. As shown most clearly in FIG. 31, the left latch actuators 190*a*, 190*b*, and 190*c* are connected to the respective end brackets 128 of the left door units 52*a*, 52*b*, and 52*c*. The left latch actuators 190*a*, 190*b*, and 190*c* include actuating members 190*aa*, 190*ba*, and 190*ca*, respectively, which are adapted to operably engage the respective latch bars 124 of the left door units 52*a*, 52*b*, and 52*c*. In several exemplary embodiments, all of the springs 130 are omitted from the fixture 185 in favor of the actuators 190*a*, 190*b*, 190*c*, 192*a*, 192*b*, and 192*c*.

In several exemplary embodiments, with continuing reference to FIGS. 1-31, the operation of the fixture 185 is substantially identical to the above-described operation of the fixture 40 except that, instead of an operator manually opening and closing the right door assembly 46, the right door actuator 188 operates to open and close the right door assembly 46. To close the right door assembly 46, the control unit 94 causes the rod 188*a* to extend out of the cylinder 188*b*. During the extension of the rod 188*a*, relative pivoting motion occurs between the protrusion 200 and the rod 188*a*, and the cylinder 188*b* also pivots, relative to the horizontal-extending support 194 and in a counterclockwise direction as viewed in FIG. 29. The rod 188*a* continues to extend until the right door assembly 46 has pivoted, about the hinge axis 138 and in a clockwise direction as viewed in FIG. 29, so that the right door assembly 46 is closed and the coil units installed in the right door assembly (e.g., the coil units 144*a* and 144*b*) are positioned in the internal region 48. This closed position of the right door assembly 46 is shown in FIG. 29. Before, during, and/or after this pivoting movement of the right door assembly 46, the control unit 94 causes the actuators 192*a*, 192*b*, and 192*c* to engage the respective latch bars 124 of the right door units 58*a*, 58*b*, and 58*c*. The actuating members 192*aa*, 192*ba*, and 192*bc* move, relative to the respective end brackets 128, and engage the respective latch bars 124, causing the latch bars 124 to slide into the respective slots 86*c* for full latch engagement. As a result, an operator does not have to manually ensure full latch engagement using the handles 126.

To open the right door assembly 46, the latch bars 124 are disengaged from the slots 86*c*, respectively, using the actuators 192*a*, 192*b*, and 192*c* and/or the handles 126. If the actuators 192*a*, 192*b*, and 192*c* are used, the actuating members 192*aa*, 192*ba*, and 192*ca* are connected to the latch bars 124, respectively, and the control unit 94 causes the actuating members 192*aa*, 192*ba*, and 192*ca* to retract. The control unit 94 causes the rod 188*a* to retract into the cylinder 188*b*, thereby causing the right door assembly 46 to pivot about the hinge axis 138, in a counterclockwise direction as viewed in FIG. 29.

Similarly, instead of an operator manually opening and closing the left door assembly 44, the left door actuator 186 operates to open and close the left door assembly 44. To close the left door assembly 44, the control unit 94 causes the rod 186*a* to extend out of the cylinder 186*b*. During the extension of the rod 186*a*, relative pivoting motion occurs between the protrusion 202 and the rod 186*a*, and the cylinder 186*b* also pivots, relative to the horizontal-extending support 196 and in a clockwise direction as viewed in FIG. 29. The rod 186*a* continues to extend until the left door assembly 44 has pivoted, about the hinge axis 136 and in a counterclockwise direction as viewed in FIG. 29, so that the left door assembly 44 is closed and the coil units installed in the right door assembly (e.g., the coil units 50*a* and 50*b*) are positioned in the internal region 48. Before, during, and/or after this pivoting movement of the left door assembly 44, the control unit 94 causes the actuators 190*a*, 190*b*, and 190*c* to engage the respective latch bars 124 of the left door units 52*a*, 52*b*, and 52*c*. The actuating members 190*aa*, 190*ba*, and 190*bc* move, relative to the respective end brackets 128, and engage the respective latch bars 124, causing the latch bars 124 to slide into the respective slots 86*c* for full latch engagement. As a result, an operator does not have to manually ensure full latch engagement using the handles 126.

To open the left door assembly 44, the latch bars 124 are disengaged from the slots 86*c*, respectively, using the actuators 190*a*, 190*b*, and 190*c* and/or the handles 126. If the actuators 190*a*, 190*b*, and 190*c* are used, the actuating members 190*aa*, 190*ba*, and 190*ca* are connected to the latch bars 124, respectively, and the control unit 94 causes the actuating members 190*aa*, 190*ba*, and 190*ca* to retract. The control unit 94 causes the rod 186*a* to retract into the cylinder 186*b*, thereby causing the left door assembly 44 to pivot about the hinge axis 136, in a clockwise direction as viewed in FIG. 29, until the left door assembly 44 is open. This open position of the left door assembly 44 is shown in FIG. 29.

In several exemplary embodiments, the execution of the methods 140 and 160 using the fixture 185 is substantially identical to the execution of the methods 140 and 160 using the fixture 40, except that the door assemblies 44 and 46 are not manually opened and closed; instead, the control unit 94 uses the actuators 186 and 188 to open and close the door assemblies 44 and 46, respectively. Moreover, in several exemplary embodiments, the control unit 94 uses the actuators 190*a*, 190*b*, 190*c*, 192*a*, 192*b*, and 192*c* to engage the respective latch bars 124 and, in some exemplary embodiments, to disengage the respective latch bars 124.

In several exemplary embodiments, the operation of the fixture 185, and/or the execution of the methods 140 and/or 160 using the fixture 185, further decreases the cycle time of the tube expander 10 while reducing operator fatigue.

In an exemplary embodiment, the actuators 186 and 188 are omitted from the fixture 185 in favor of respective hydraulic motors, which operate to open and close the door assemblies 44 and 46. In several exemplary embodiments, the hydraulic motors are operably coupled to respective actuation linkages. In several exemplary embodiments, each of the actuation linkages is centered vertically and employs a vertically-oriented splined shaft and a corresponding gear. In several exemplary embodiments, the hydraulic motors provide high torque with low RPM. In several exemplary embodiments, the actuator 16 is a hydraulic actuator, and the hydraulic motors run off the hydraulic system of which the actuator 16 is a part.

In several exemplary embodiments, the fixture 40 may initially be a fixture kit, which is assembled in accordance with the foregoing description of the fixture 40; in several exemplary embodiments, the fixture kit may be used to retrofit an existing tube expander. In several exemplary embodiments, the fixture 180 may initially be a fixture kit, which is assembled in accordance with the foregoing description of the fixture 180; in several exemplary embodiments, the fixture kit may be used to retrofit an existing tube expander. In several exemplary embodiments, the fixture 185 may initially be a fixture kit, which is assembled in accordance with the foregoing description of the fixture 185; in several exemplary embodiments, the fixture kit may be used to retrofit an existing tube expander.

Figure 32:
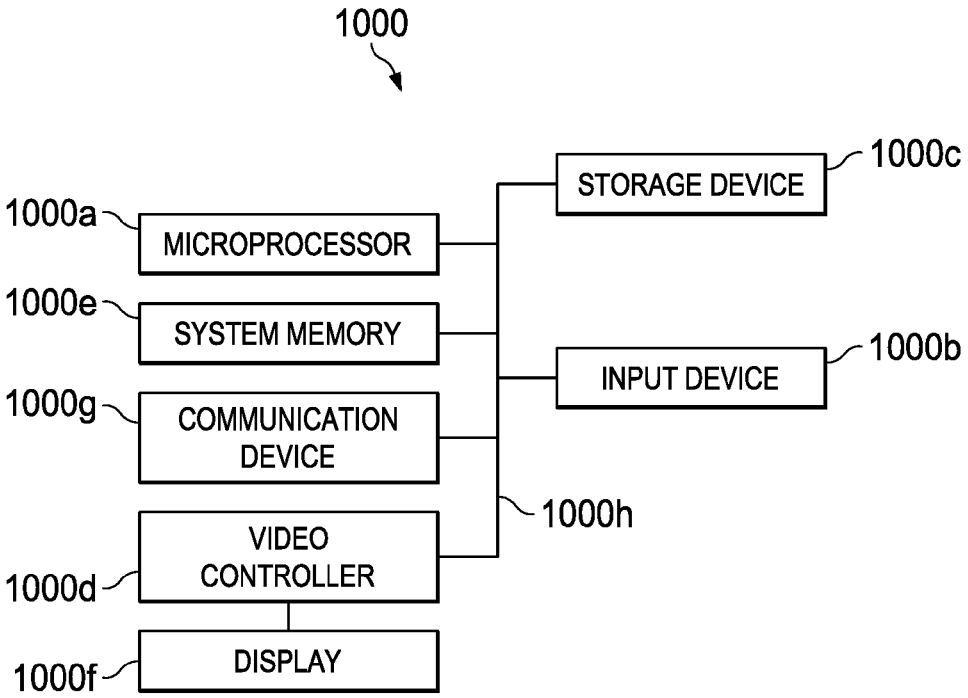
FIG. 32 is a diagrammatic illustration of a node for implementing one or more exemplary embodiments of the present disclosure, according to an exemplary embodiment.

In an exemplary embodiment, as illustrated in FIG. 32 with continuing reference to FIGS. 1-31, an illustrative computing device 1000 for implementing one or more embodiments of one or more of the above-described networks, elements, methods and/or steps, and/or any combination thereof, is depicted. The computing device 1000 includes a processor 1000*a*, an input device 1000*b*, a storage device 1000*c*, a video controller 1000*d*, a system memory 1000*e*, a display 1000*f*, and a communication device 1000*g*, all of which are interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer readable medium that may contain executable instructions. In an exemplary embodiment, the computer readable medium is a non-transitory tangible media. In several exemplary embodiments, the communication device 1000*g* may include a modem, network card, or any other device to enable the computing device 1000 to communicate with other computing devices. In several exemplary embodiments, any computing device represents a plurality of interconnected (whether by intranet or Internet) computer systems, including without limitation, personal computers, mainframes, PDAs, smartphones and cell phones.

In several exemplary embodiments, one or both of the control panel 132 and the control unit 94, and/or one or more components thereof, are, or at least include, the computing device 1000 and/or components thereof, and/or one or more computing devices that are substantially similar to the computing device 1000 and/or components thereof. In several exemplary embodiments, one or more of the above-described components of one or more of the computing device 1000, the control panel 132, the control unit 94, and/or one or more components thereof, include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In an exemplary embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In an exemplary embodiment, a data structure may provide an organization of data, or an organization of executable code.

In several exemplary embodiments, a database may be any standard or proprietary database software. In several exemplary embodiments, the database may have fields, records, data, and other database elements that may be associated through database specific software. In several exemplary embodiments, data may be mapped. In several exemplary embodiments, mapping is the process of associating one data entry with another data entry. In an exemplary embodiment, the data contained in the location of a character file can be mapped to a field in a second table. In several exemplary embodiments, the physical location of the database is not limiting, and the database may be distributed. In an exemplary embodiment, the database may exist remotely from the server, and run on a separate platform. In an exemplary embodiment, the database may be accessible across the Internet. In several exemplary embodiments, more than one database may be implemented.

In several exemplary embodiments, a computer program, such as a plurality of instructions stored on a computer readable medium, such as the system memory 1000*e*, may be executed by a processor to cause the processor to carry out or implement in whole or in part the operation of the tube expander 10, one or more of the methods 140, 160, and 162, and/or any combination thereof. In several exemplary embodiments, such a processor may include the processor 1000*a*. In several exemplary embodiments, such a processor may execute the plurality of instructions in connection with a virtual computer system.

A tube expander for heat exchanger coil units is provided that includes a frame; a first back unit connected to the frame, the first back unit at least partially defining an internal region; a first door assembly movably connected to the first back unit and to which at least a first heat exchanger coil unit is adapted to be connected, the first door assembly being movable between: a first position in which the first heat exchanger coil unit is adapted to be disposed in the internal region for tubular expansion therein; and a second position in which the first heat exchanger coil unit is not adapted to be disposed in the internal region; and a second door assembly movably connected to the first back unit and to which at least a second heat exchanger coil unit is adapted to be connected, the second door assembly being movable between: a third position in which the second heat exchanger coil unit is adapted to be disposed in the internal region for tubular expansion therein; and a fourth position in which the second heat exchanger coil unit is not adapted to be disposed in the internal region. In an exemplary embodiment, the first door assembly is in the first position when the second door assembly is in the fourth position, and the second door assembly is in the third position when the first door assembly is in the second position. In an exemplary embodiment, the first back unit includes opposing first and second side portions; wherein the first door assembly is hingedly connected to the first back unit at the first side portion thereof; wherein the second door assembly is hingedly connected to the first back unit at the second side portion thereof; wherein a first hinge axis is defined by the hinged connection between the first door assembly and the first back unit; wherein the first door assembly is permitted to pivot, about the first hinge axis, between the first and second positions; wherein a second hinge axis is defined by the hinged connection between the second door assembly and the first back unit; and wherein the second door assembly is permitted to pivot, about the second hinge axis, between the third and fourth positions. In an exemplary embodiment, the first door assembly is slidably connected to the first back unit, and the second door assembly is slidably connected to the first back unit. In an exemplary embodiment, the first door assembly includes a first left door unit hingedly connected to the first back unit, and the second door assembly includes a first right door unit hingedly connected to the first back unit. In an exemplary embodiment, the tube expander includes a second back unit connected to the frame, the second back unit at least partially defining the internal region; and first and second braces connected to the first and second door assemblies, respectively; wherein the first door assembly further includes a second left door unit hingedly connected to the second back unit; wherein the first brace is connected to each of the first and second left door units; wherein the second door assembly further includes a second right door unit hingedly connected to the second back unit; and wherein the second brace is connected to each of the first and second right door units. In an exemplary embodiment, at least one heat exchanger coil unit has a height, width, and depth; wherein the first door assembly includes a first door unit connected to the first back unit; and a spacer block connected to the first door unit at one of a first plurality of predetermined positions, each of the predetermined positions in the first plurality of predetermined positions being spaced from at least one other predetermined position adjacent thereto by a first predetermined increment; wherein the one of the first plurality of predetermined positions at which the spacer block is connected accommodates the width of the at least one heat exchanger coil unit; wherein the connection between the first back unit and the frame, the connection between the first door unit and the first back unit, and the connection between the spacer block and the first door unit, are configured so that the spacer block is permitted to be disconnected from the first door unit and reconnected thereto at a different one of the first plurality of predetermined positions to accommodate a width of at least one other heat exchanger coil unit. In an exemplary embodiment, the first door unit includes a door plate to which the spacer block is connected; and a door support connected to the door plate and hingedly connected to the first back unit; wherein the position of the door plate, relative to the door support, is adjustable to accommodate the depth of the at least one heat exchanger coil unit; and wherein the door plate is positioned, relative to the door support, at one of a second plurality of predetermined positions, each of the predetermined positions in the second plurality of predetermined positions being spaced from at least one other predetermined position adjacent thereto by a second predetermined increment. In an exemplary embodiment, the first door unit further includes a first latch bar operably coupled to the door plate; wherein the first back unit includes a first hinge plate to which the door support is hingedly connected; a second hinge plate spaced from the first hinge plate; and a latch keeper connected to the second hinge plate and with which the first latch bar is adapted to be engaged; wherein the position of the latch keeper, relative to the second hinge plate, is adjustable to accommodate the depth of the at least one heat exchanger coil unit; and wherein the latch keeper is positioned, relative to the second hinge plate, at one of a third plurality of predetermined positions, each of the predetermined positions in the third plurality of predetermined positions being spaced from at least one other predetermined position adjacent thereto by a third predetermined increment, the third predetermined increment being equal to the second predetermined increment. In an exemplary embodiment, the tube expander includes a plurality of modules, each of which is connected to the frame; wherein the first back unit and the first door unit are part of one module in the plurality of modules; wherein the quantity of the modules in the plurality of modules that are connected to the frame is adjustable to accommodate the height of the at least one heat exchanger coil unit; wherein the first back unit includes at least two connectors; wherein the position of the one module, relative to the frame, is adjustable to accommodate the height of the at least one heat exchanger coil unit; and wherein the at least two connectors are configured so that the one module is connected to the frame at one of a fourth plurality of predetermined positions, each of the predetermined positions in the fourth plurality of predetermined positions being spaced from at least one other predetermined position adjacent thereto by a fourth predetermined increment. In an exemplary embodiment, the tube expander includes an actuator to conduct a tubular expansion process, the actuator being connected to the frame; a control unit in communication with the actuator; a sensor in communication with the control unit, the sensor including a face; a latch bar, which is part of the first door assembly; and a latch keeper connected to the first back unit and to which the sensor is connected, the latch keeper including a slot in which the latch bar is adapted to extend; wherein the face of the sensor is adjacent, or at least proximate, the slot of the latch keeper to sense the presence of the latch bar when the latch bar extends within the slot; and wherein the sensor and the control unit are configured so that: the control unit permits the actuator of the tube expander to operate to conduct the tubular expansion process when: the first door assembly is in the first position, the latch bar extends within the slot, and the sensor senses the presence of the latch bar within the slot; and the control unit does not permit the actuator of the tube expander to operate to conduct the tubular expansion process when the first door assembly is in the first position and the sensor does not sense the presence of the latch bar within the slot.

A tube expander for heat exchanger coil units is provided that includes a frame; and a fixture connected to the frame and to which at least one heat exchanger coil unit is adapted to be connected, the at least one heat exchanger coil unit having a height, width, and depth, the fixture including: a first back unit connected to the frame; a first door unit connected to the first back unit; and a spacer block connected to the first door unit at one of a first plurality of predetermined positions, each of the predetermined positions in the first plurality of predetermined positions being spaced from at least one other predetermined position adjacent thereto by a first predetermined increment; wherein the one of the first plurality of predetermined positions at which the spacer block is connected accommodates the width of the at least one heat exchanger coil unit; and wherein the connection between the first back unit and the frame, the connection between the first door unit and the first back unit, and the connection between the spacer block and the first door unit, are configured so that the spacer block is permitted to be disconnected from the first door unit and reconnected thereto at a different one of the first plurality of predetermined positions to accommodate a width of at least one other heat exchanger coil unit. In an exemplary embodiment, the first door unit includes: a door plate to which the spacer block is connected; and a door support connected to the door plate and hingedly connected to the first back unit; wherein the position of the door plate, relative to the door support, is adjustable to accommodate the depth of the at least one heat exchanger coil unit; and wherein the door plate is positioned, relative to the door support, at one of a second plurality of predetermined positions, each of the predetermined positions in the second plurality of predetermined positions being spaced from at least one other predetermined position adjacent thereto by a second predetermined increment. In an exemplary embodiment, the first door unit further includes a first latch bar operably coupled to the door plate; wherein the first back unit includes: a first hinge plate to which the door support is hingedly connected; a second hinge plate spaced from the first hinge plate; and a latch keeper connected to the second hinge plate and with which the first latch bar is adapted to be engaged; wherein the position of the latch keeper, relative to the second hinge plate, is adjustable to accommodate the depth of the at least one heat exchanger coil unit; and wherein the latch keeper is positioned, relative to the second hinge plate, at one of a third plurality of predetermined positions, each of the predetermined positions in the third plurality of predetermined positions being spaced from at least one other predetermined position adjacent thereto by a third predetermined increment, the third predetermined increment being equal to the second predetermined increment. In an exemplary embodiment, the tube expander includes a plurality of modules, each of which is connected to the frame; wherein the first back unit and the first door unit are part of a module in the plurality of modules; and wherein the quantity of the modules in the plurality of modules that are connected to the frame is adjustable to accommodate the height of the at least one heat exchanger coil unit. In an exemplary embodiment, the first back unit and the first door unit are part of a module; wherein the first back unit includes at least two connectors; and wherein the at least two connectors are configured so that the module is connected to the frame at one of a fourth plurality of predetermined positions, each of the predetermined positions in the fourth plurality of predetermined positions being spaced from at least one other predetermined position adjacent thereto by a fourth predetermined increment. In an exemplary embodiment, the tube expander includes first and second parallel-spaced tracks connected to the frame; wherein the at least two connectors are respectively connected to the first and second parallel-spaced tracks. In an exemplary embodiment, the tube expander includes an actuator to conduct a tubular expansion process, the actuator being connected to the frame; a control unit in communication with the actuator; a sensor in communication with the control unit, the sensor including a face; a latch bar, which is part of the first door unit; and a latch keeper connected to the first back unit and to which the sensor is connected, the latch keeper including a slot in which the latch bar is adapted to extend; wherein the face of the sensor is adjacent, or at least proximate, the slot of the latch keeper to sense the presence of the latch bar when the latch bar extends within the slot; wherein the first door unit has open and closed positions; and wherein the sensor and the control unit are configured so that: the control unit permits the actuator of the tube expander to operate to conduct the tubular expansion process when: the first door unit is in the closed position, the latch bar extends within the slot, and the sensor senses the presence of the latch bar within the slot; and the control unit does not permit the actuator of the tube expander to operate to conduct the tubular expansion process when the first door unit is in the closed position and the sensor does not sense the presence of the latch bar within the slot. In an exemplary embodiment, the first back unit at least partially defines an internal region; and wherein the fixture includes: a first door assembly movably connected to the first back unit and to which at least a first heat exchanger coil unit is adapted to be connected, the first door unit being part of the first door assembly, the first door assembly being movable between: a first position in which the first heat exchanger coil unit is adapted to be disposed in the internal region for tubular expansion therein; and a second position in which the first heat exchanger coil unit is not adapted to be disposed in the internal region; and a second door assembly movably connected to the first back unit and to which at least a second heat exchanger coil unit is adapted to be connected, the second door assembly being movable between: a third position in which the second heat exchanger coil unit is adapted to be disposed in the internal region for tubular expansion therein; and a fourth position in which the second heat exchanger coil unit is not adapted to be disposed in the internal region. In an exemplary embodiment, the first door assembly is in the first position when the second door assembly is in the fourth position; and wherein the second door assembly is in the third position when the first door assembly is in the second position. In an exemplary embodiment, the tube expander a second back unit connected to the frame, the second back unit at least partially defining the internal region; and first and second braces connected to the first and second door assemblies, respectively; wherein the first door unit is hingedly connected to the first back unit; wherein the first door assembly further includes a second door unit hingedly connected to the second back unit; wherein the first brace is connected to each of the first and second door units; wherein the second door assembly includes third and fourth door units hingedly connected to the first and second back units, respectively; and wherein the second brace is connected to each of the third and fourth door units.

A tube expander for one or more heat exchanger coil units is provided that includes a frame; an actuator connected to the frame to conduct a tubular expansion process within the one or more heat exchanger coil units; a control unit in communication with the actuator; a sensor in communication with the control unit, the sensor including a face; a door unit to which the one or more heat exchanger coil units are adapted to be connected, the door unit having open and closed positions and including a latch bar; and a latch keeper connected to the frame and to which the sensor is connected, the latch keeper including a slot in which the latch bar is adapted to extend; wherein the face of the sensor is adjacent, or at least proximate, the slot of the latch keeper to sense the presence of the latch bar when the latch bar extends within the slot; and wherein the sensor and the control unit are configured so that: the control unit permits the actuator of the tube expander to operate to conduct the tubular expansion process within the one or more heat exchanger coil units when: the door unit is in the closed position, the latch bar extends within the slot, and the sensor senses the presence of the latch bar within the slot; and the control unit does not permit the actuator of the tube expander to operate to conduct the tubular expansion process within the one or more heat exchanger coil units when the door is in the closed position and the sensor does not sense the presence of the latch bar within the slot. In an exemplary embodiment, at least one heat exchanger coil unit has a height, width, and depth; wherein the tube expander further includes: a back unit connected to the frame and to which the door unit is connected; and a spacer block connected to the door unit at one of a first plurality of predetermined positions, each of the predetermined positions in the first plurality of predetermined positions being spaced from at least one other predetermined position adjacent thereto by a first predetermined increment; wherein the one of the first plurality of predetermined positions at which the spacer block is connected accommodates the width of the at least one heat exchanger coil unit; wherein the connection between the back unit and the frame, the connection between the door unit and the back unit, and the connection between the spacer block and the door unit, are configured so that the spacer block is permitted to be disconnected from the door unit and reconnected thereto at a different one of the first plurality of predetermined positions to accommodate a width of at least one other heat exchanger coil unit. In an exemplary embodiment, the door unit includes: a door plate to which the spacer block is connected; and a door support connected to the door plate and hingedly connected to the back unit; wherein the position of the door plate, relative to the door support, is adjustable to accommodate the depth of the at least one heat exchanger coil unit; and wherein the door plate is positioned, relative to the door support, at one of a second plurality of predetermined positions, each of the predetermined positions in the second plurality of predetermined positions being spaced from at least one other predetermined position adjacent thereto by a second predetermined increment. In an exemplary embodiment, the door unit further includes a first latch bar operably coupled to the door plate; wherein the back unit includes: a first hinge plate to which the door support is hingedly connected; a second hinge plate spaced from the first hinge plate; and a latch keeper connected to the second hinge plate and with which the first latch bar is adapted to be engaged; wherein the position of the latch keeper, relative to the second hinge plate, is adjustable to accommodate the depth of the at least one heat exchanger coil unit; and wherein the latch keeper is positioned, relative to the second hinge plate, at one of a third plurality of predetermined positions, each of the predetermined positions in the third plurality of predetermined positions being spaced from at least one other predetermined position adjacent thereto by a third predetermined increment, the third predetermined increment being equal to the second predetermined increment. In an exemplary embodiment, the tube expander includes a plurality of modules, each of which is connected to the frame; wherein the back unit and the door unit are part of one module in the plurality of modules; and wherein the quantity of the modules in the plurality of modules that are connected to the frame is adjustable to accommodate the height of the at least one heat exchanger coil unit. In an exemplary embodiment, the back unit includes at least two connectors; wherein the back unit and the door unit are part of a module; wherein the position of the module, relative to the frame, is adjustable to accommodate the height of the at least one heat exchanger coil unit; and wherein the at least two connectors are configured so that the one module is connected to the frame at one of a fourth plurality of predetermined positions, each of the predetermined positions in the fourth plurality of predetermined positions being spaced from at least one other predetermined position adjacent thereto by a fourth predetermined increment. In an exemplary embodiment, the back unit at least partially defines an internal region; and wherein the fixture includes: a first door assembly movably connected to the back unit and to which at least a first heat exchanger coil unit is adapted to be connected, the door unit being part of the first door assembly, the first door assembly being movable between: a first position in which the first heat exchanger coil unit is adapted to be disposed in the internal region for tubular expansion therein; and a second position in which the first heat exchanger coil unit is not adapted to be disposed in the internal region; and a second door assembly movably connected to the back unit and to which at least a second heat exchanger coil unit is adapted to be connected, the second door assembly being movable between: a third position in which the second heat exchanger coil unit is adapted to be disposed in the internal region for tubular expansion therein; and a fourth position in which the second heat exchanger coil unit is not adapted to be disposed in the internal region. In an exemplary embodiment, the first door assembly is in the first position when the second door assembly is in the fourth position; and wherein the second door assembly is in the third position when the first door assembly is in the second position. In an exemplary embodiment, the tube expander includes another back unit connected to the frame, the another back unit at least partially defining the internal region; and first and second braces connected to the first and second door assemblies, respectively; wherein the door unit is hingedly connected to the back unit; wherein the first door assembly further includes another door unit hingedly connected to the another back unit; wherein the first brace is connected to each of the door unit and the another door unit; wherein the second door assembly includes two door units hingedly connected to the back unit and the another back unit, respectively; and wherein the second brace is connected to each of the two door units.

A fixture kit for a tube expander for heat exchanger coil units is provided that includes a first back unit adapted to be connected to the tube expander; a first door assembly adapted to be movably connected to the first back unit and to which at least a first heat exchanger coil unit is adapted to be connected; and a second door assembly adapted to be movably connected to the first back unit and to which at least a second heat exchanger coil unit is adapted to be connected; wherein, when the first back unit is connected to the tube expander and each of the first and second door assemblies is movably connected to the first back unit: the first back unit at least partially defines an internal region; the first door assembly has: a first position in which the first heat exchanger coil unit is adapted to be disposed in the internal region for tubular expansion therein; and a second position in which the first heat exchanger coil unit is not adapted to be disposed in the internal region; and the second door assembly has: a third position in which the second heat exchanger coil unit is adapted to be disposed in the internal region for tubular expansion therein; and a fourth position in which the second heat exchanger coil unit is not adapted to be disposed in the internal region. In an exemplary embodiment, the first door assembly is in the first position when the second door assembly is in the fourth position; and wherein the second door assembly is in the third position when the first door assembly is in the second position. In an exemplary embodiment, the first back unit includes opposing first and second side portions; wherein the first door assembly is adapted to be hingedly connected to the first back unit at the first side portion thereof; wherein the second door assembly is adapted to be hingedly connected to the first back unit at the second side portion thereof; wherein, when the first back unit is connected to the tube expander and each of the first and second door assemblies is hingedly connected to the first back unit: a first hinge axis is defined by the hinged connection between the first door assembly and the first back unit; the first door assembly is permitted to pivot, about the first hinge axis, between the first and second positions; a second hinge axis is defined by the hinged connection between the second door assembly and the first back unit; and the second door assembly is permitted to pivot, about the second hinge axis, between the third and fourth positions. In an exemplary embodiment, the first door assembly is adapted to be slidably connected to the first back unit; and wherein the second door assembly is adapted to be slidably connected to the first back unit. In an exemplary embodiment, the first door assembly includes a first left door unit adapted to be hingedly connected to the first back unit; and wherein the second door assembly includes a first right door unit adapted to be hingedly connected to the first back unit. In an exemplary embodiment, the fixture kit includes a second back unit adapted to be connected to the tube expander; and first and second braces adapted to be connected to the first and second door assemblies, respectively; wherein the first door assembly further includes a second left door unit adapted to be hingedly connected to the second back unit; wherein the first brace is adapted to be connected to each of the first and second left door units; wherein the second door assembly further includes a second right door unit adapted to be hingedly connected to the second back unit; and wherein the second brace is adapted to be connected to each of the first and second right door units.

A fixture kit is provided to which at least one heat exchanger coil unit is adapted to be connected, the at least one heat exchanger coil unit having a height, width, and depth, the fixture being adapted to be connected to a frame of a tube expander, the fixture kit including a first back unit adapted to be connected to the frame of the tube expander; a first door unit adapted to be connected to the first back unit; and a spacer block adapted to be connected to the first door unit at one of a first plurality of predetermined positions, each of the predetermined positions in the first plurality of predetermined positions being spaced from at least one other predetermined position adjacent thereto by a first predetermined increment; wherein the one of the first plurality of predetermined positions at which the spacer block is adapted to be connected accommodates the width of the at least one heat exchanger coil unit; wherein, when the first back unit is connected to the tube expander and the first door unit is connected to the first back unit, the first door unit and the spacer block are configured so that the spacer block is permitted to be disconnected from the first door unit and reconnected thereto at a different one of the first plurality of predetermined positions to accommodate a width of at least one other heat exchanger coil unit. In an exemplary embodiment, the first door unit includes: a door plate to which the spacer block is adapted to be connected; and a door support connected to the door plate and adapted to be hingedly connected to the first back unit; wherein the position of the door plate, relative to the door support, is adjustable to accommodate the depth of the at least one heat exchanger coil unit; and wherein the door plate is positioned, relative to the door support, at one of a second plurality of predetermined positions, each of the predetermined positions in the second plurality of predetermined positions being spaced from at least one other predetermined position adjacent thereto by a second predetermined increment. In an exemplary embodiment, the first door unit further includes a first latch bar operably coupled to the door plate; wherein the first back unit includes: a first hinge plate to which the door support is adapted to be hingedly connected; a second hinge plate spaced from the first hinge plate; and a latch keeper connected to the second hinge plate and with which the first latch bar is adapted to be engaged; wherein the position of the latch keeper, relative to the second hinge plate, is adjustable to accommodate the depth of the at least one heat exchanger coil unit; and wherein the latch keeper is positioned, relative to the second hinge plate, at one of a third plurality of predetermined positions, each of the predetermined positions in the third plurality of predetermined positions being spaced from at least one other predetermined position adjacent thereto by a third predetermined increment, the third predetermined increment being equal to the second predetermined increment. In an exemplary embodiment, the fixture kit includes a plurality of modules, each of which is adapted to be connected to the frame of the tube expander; wherein the first back unit and the first door unit are part of a module in the plurality of modules; and wherein the quantity of the modules in the plurality of modules that are connected to the frame of the tube expander is adjustable to accommodate the height of the at least one heat exchanger coil unit. In an exemplary embodiment, the first back unit and the first door unit are part of a module; wherein the first back unit includes at least two connectors; and wherein the at least two connectors are configured so that the module is adapted to be connected to the frame of the tube expander at one of a fourth plurality of predetermined positions, each of the predetermined positions in the fourth plurality of predetermined positions being spaced from at least one other predetermined position adjacent thereto by a fourth predetermined increment. In an exemplary embodiment, each of the at least two connectors is configured to be connected to a track.

A latch kit for a tube expander for one or more heat exchanger coil units is provided, the tube expander including an actuator to conduct a tubular expansion process within the one or more heat exchanger coil units, the tube expander further including a door to which the one or more heat exchanger coil units are adapted to be connected, the door including a latch bar and having open and closed positions, the latch kit including a control unit adapted to be in communication with the actuator; a sensor adapted to be in communication with the control unit, the sensor including a face; a latch keeper to which the sensor is adapted to be connected, the latch keeper including a slot in which the latch bar is adapted to extend; wherein, when the sensor is connected to the latch keeper, the face of the sensor is adjacent, or at least proximate, the slot of the latch keeper to sense the presence of the latch bar when the latch bar extends within the slot; wherein the sensor and the control unit are configured so that, when the control unit is in communication with the actuator and the sensor is in communication with the control unit: the control unit permits the actuator of the tube expander to operate to conduct the tubular expansion process within the one or more heat exchanger coil units when: the door is in the closed position, the latch bar extends within the slot, and the sensor senses the presence of the latch bar within the slot; and the control unit does not permit the actuator of the tube expander to operate to conduct the tubular expansion process within the one or more heat exchanger coil units when the door is in the closed position and the sensor does not sense the presence of the latch bar within the slot.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upward," "downward," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A fixture kit for a tube expander for heat exchanger coil units, the fixture kit comprising:

a first back unit adapted to be connected to the tube expander;

a first door assembly adapted to be movably connected to the first back unit and to which at least a first heat exchanger coil unit is adapted to be connected; and a second door assembly adapted to be movably connected to the first back unit and to which at least a second heat exchanger coil unit is adapted to be connected;

wherein, when the first back unit is connected to the tube expander and each of the first and second door assemblies is movably connected to the first back unit:

the first back unit at least partially defines an internal region;

the first door assembly has:

a first position in which the first heat exchanger coil unit is adapted to be disposed in the internal region for tubular expansion therein; and a second position in which the first heat exchanger coil unit is not adapted to be disposed in the internal region;

and the second door assembly has:

a third position in which the second heat exchanger coil unit is adapted to be disposed in the internal region for tubular expansion therein; and a fourth position in which the second heat exchanger coil unit is not adapted to be disposed in the internal region.

2. The fixture kit of claim 1, wherein the first door assembly is in the first position when the second door assembly is in the fourth position; and wherein the second door assembly is in the third position when the first door assembly is in the second position.

3. The fixture kit of claim 1, wherein the first back unit comprises opposing first and second side portions;

wherein the first door assembly is adapted to be hingedly connected to the first back unit at the first side portion thereof;

wherein the second door assembly is adapted to be hingedly connected to the first back unit at the second side portion thereof;

wherein, when the first back unit is connected to the tube expander and each of the first and second door assemblies is hingedly connected to the first back unit:

a first hinge axis is defined by the hinged connection between the first door assembly and the first back unit;

the first door assembly is permitted to pivot, about the first hinge axis, between the first and second positions;

a second hinge axis is defined by the hinged connection between the second door assembly and the first back unit; and the second door assembly is permitted to pivot, about the second hinge axis, between the third and fourth positions.

4. The fixture kit of claim 1, wherein the first door assembly is adapted to be slidably connected to the first back unit; and wherein the second door assembly is adapted to be slidably connected to the first back unit.

5. The fixture kit of claim 1, wherein the first door assembly comprises a first left door unit adapted to be hingedly connected to the first back unit; and wherein the second door assembly comprises a first right door unit adapted to be hingedly connected to the first back unit.

6. The fixture kit of claim 5, further comprising:

a second back unit adapted to be connected to the tube expander; and first and second braces adapted to be connected to the first and second door assemblies, respectively;

wherein the first door assembly further comprises a second left door unit adapted to be hingedly connected to the second back unit;

wherein the first brace is adapted to be connected to each of the first and second left door units;

wherein the second door assembly further comprises a second right door unit adapted to be hingedly connected to the second back unit; and wherein the second brace is adapted to be connected to each of the first and second right door units.

7. A fixture kit to which at least one heat exchanger coil unit is adapted to be connected, the at least one heat exchanger coil unit having a height, width, and depth, the fixture being adapted to be connected to a frame of a tube expander, the fixture kit comprising:

a first back unit adapted to be connected to the frame of the tube expander;

a first door unit adapted to be connected to the first back unit; and a spacer block adapted to be connected to the first door unit at one of a first plurality of predetermined positions, each of the predetermined positions in the first plurality of predetermined positions being spaced from at least one other predetermined position adjacent thereto by a first predetermined increment;

wherein the one of the first plurality of predetermined positions at which the spacer block is adapted to be connected accommodates the width of the at least one heat exchanger coil unit;

wherein, when the first back unit is connected to the tube expander and the first door unit is connected to the first back unit, the first door unit and the spacer block are configured so that the spacer block is permitted to be disconnected from the first door unit and reconnected thereto at a different one of the first plurality of predetermined positions to accommodate a width of at least one other heat exchanger coil unit.

8. The fixture kit of claim 7, wherein the first door unit comprises:

a door plate to which the spacer block is adapted to be connected; and a door support connected to the door plate and adapted to be hingedly connected to the first back unit;

wherein the position of the door plate, relative to the door support, is adjustable to accommodate the depth of the at least one heat exchanger coil unit; and wherein the door plate is positioned, relative to the door support, at one of a second plurality of predetermined positions, each of the predetermined positions in the second plurality of predetermined positions being spaced from at least one other predetermined position adjacent thereto by a second predetermined increment.

9. The fixture kit of claim 8, wherein the first door unit further comprises a first latch bar operably coupled to the door plate;

wherein the first back unit comprises:

a first hinge plate to which the door support is adapted to be hingedly connected;

a second hinge plate spaced from the first hinge plate; and a latch keeper connected to the second hinge plate and with which the first latch bar is adapted to be engaged;

wherein the position of the latch keeper, relative to the second hinge plate, is adjustable to accommodate the depth of the at least one heat exchanger coil unit; and wherein the latch keeper is positioned, relative to the second hinge plate, at one of a third plurality of predetermined positions, each of the predetermined positions in the third plurality of predetermined positions being spaced from at least one other predetermined position adjacent thereto by a third predetermined increment, the third predetermined increment being equal to the second predetermined increment.

10. The fixture kit of claim 7, further comprising a plurality of modules, each of which is adapted to be connected to the frame of the tube expander;

wherein the first back unit and the first door unit are part of a module in the plurality of modules; and wherein the quantity of the modules in the plurality of modules that are connected to the frame of the tube expander is adjustable to accommodate the height of the at least one heat exchanger coil unit.

11. The fixture kit of claim 7, wherein the first back unit and the first door unit are part of a module;

wherein the first back unit comprises at least two connectors; and wherein the at least two connectors are configured so that the module is adapted to be connected to the frame of the tube expander at one of a fourth plurality of predetermined positions, each of the predetermined positions in the fourth plurality of predetermined positions being spaced from at least one other predetermined position adjacent thereto by a fourth predetermined increment.

12. The fixture kit of claim 11, wherein each of the at least two connectors is configured to be connected to a track.

13. A latch kit for a tube expander for one or more heat exchanger coil units, the tube expander comprising an actuator to conduct a tubular expansion process within the one or more heat exchanger coil units, the tube expander further comprising a door to which the one or more heat exchanger coil units are adapted to be connected, the door comprising a latch bar and having open and closed positions, the latch kit comprising:

a control unit adapted to be in communication with the actuator;

a sensor adapted to be in communication with the control unit, the sensor comprising a face;

a latch keeper to which the sensor is adapted to be connected, the latch keeper comprising a slot in which the latch bar is adapted to extend;

wherein, when the sensor is connected to the latch keeper, the face of the sensor is adjacent, or at least proximate, the slot of the latch keeper to sense the presence of the latch bar when the latch bar extends within the slot;

wherein the sensor and the control unit are configured so that, when the control unit is in communication with the actuator and the sensor is in communication with the control unit:

the control unit permits the actuator of the tube expander to operate to conduct the tubular expansion process within the one or more heat exchanger coil units when:

the door is in the closed position, the latch bar extends within the slot, and the sensor senses the presence of the latch bar within the slot; and the control unit does not permit the actuator of the tube expander to operate to conduct the tubular expansion process within the one or more heat exchanger coil units when the door is in the closed position and the sensor does not sense the presence of the latch bar within the slot.

14. A method of expanding tubes in respective ones of a plurality of heat exchanger coil units, each of the heat exchanger coil units comprising a plurality of tubes and a plurality of fins, the method comprising:

(a) installing at least one of the heat exchanger coil units in a first door assembly;

(b) moving the first door assembly so that the at least one heat exchanger coil unit is disposed in an internal region defined by a fixture;

(c) after the at least one heat exchanger coil unit is disposed in the internal region defined by the fixture, expanding the tubes of the at least one heat exchanger coil unit so that the tubes form interference fits with the fins of the at least one heat exchanger coil unit;

(d) during expanding the tubes of the at least one heat exchanger coil unit, installing in a second door assembly at least one other of the heat exchanger coil units the tubes of which have not yet been expanded;

(e) moving the first door assembly to remove the at least one heat exchanger coil unit from the internal region defined by the fixture;

(f) moving the second door assembly so that the at least one other heat exchanger coil unit is disposed in the internal region defined by the fixture; and (g) after the at least one other heat exchanger coil unit is disposed in the internal region defined by the fixture, expanding the tubes of the at least one other heat exchanger coil unit so that the tubes form interference fits with the fins of the at least one other heat exchanger coil unit.

15. The method of claim 14, further comprising:

(h) during expanding the tubes of the at least one other heat exchanger coil unit, installing in the first door assembly at least one heat exchanger coil unit the tubes of which have not yet been expanded; and (i) moving the second door assembly to remove the at least one other heat exchanger coil unit from the internal region defined by the fixture.

16. The method of claim 15, further comprising:

(j) repeating steps (b) through (i) until the tubes of all of the respective ones of the plurality of heat exchanger coil units have been expanded.

17. The method of claim 15, wherein moving the first door assembly so that the at least one heat exchanger coil unit is disposed in the internal region defined by the fixture comprises:

closing the first door assembly so that the first door assembly pivots about a first hinge axis in a first direction;

wherein moving the first door assembly to remove the at least one heat exchanger coil unit from the internal region defined by the fixture comprises:

opening the first door assembly so that the first door assembly pivots about the first hinge axis in a second direction that is opposite the first direction;

wherein moving the second door assembly so that the at least one other heat exchanger coil unit is disposed in the internal region defined by the fixture comprises:

closing the second door assembly so that the second door assembly pivots about a second hinge axis in a third direction;

and wherein moving the second door assembly to remove the at least one other heat exchanger coil unit from the internal region defined by the fixture comprises:

opening the second door assembly so that the second door assembly pivots about the second hinge axis in a fourth direction that is opposite the third direction.

18. The method of claim 17, wherein closing the first door assembly comprises controlling a first actuator so that the first actuator operates to close the first door assembly;

wherein opening the first door assembly comprises controlling the first actuator so that the first actuator operates to open the first door assembly;

wherein closing the second door assembly comprises controlling a second actuator so that the second actuator operates to close the second door assembly; and wherein opening the second door assembly comprises controlling the second actuator so that the second actuator operates to open the second door assembly.

19. The method of claim 17, wherein the fixture is part of a tube expander;

wherein the fixture comprises a back unit;

wherein the first and second door assemblies are hingedly connected to the back unit at the first and second hinge axes, respectively.

20. The method of claim 14, wherein the fixture is part of a tube expander;

wherein the fixture comprises a back unit;

wherein the first and second door assemblies are connected to the back unit;

wherein the at least one heat exchanger coil unit has a first depth and a first width;

wherein the at least one other heat exchanger coil unit has a second depth and a second width; and wherein the method further comprises at least one of the following steps:

(i) adjusting the first door assembly to accommodate the first depth of the at least one heat exchanger coil unit;

(ii) adjusting the first door assembly to accommodate the first width of the at least one heat exchanger coil unit;

(iii) adjusting the second door assembly to accommodate the second depth of the at least one other heat exchanger coil unit; and (iv) adjusting the second door assembly to accommodate the second width of the at least one other heat exchanger coil unit.

21. The method of claim 20, wherein the back unit and the first and second door assemblies are configured so that each of the steps (i), (ii), (iii), and (iv) is permitted to be executed while the respective connections between the back unit and the first and second door assemblies are maintained.

22. The method of claim 14, wherein the fixture is part of a tube expander, the tube expander further comprising an actuator, the operation of which is adapted to cause the expansion of the tubes in the respective ones of the plurality of heat exchanger coil units;

wherein the fixture comprises first and second latch keepers;

wherein the first and second door assemblies comprise first and second latch bars, respectively; and wherein method further comprises:

before expanding the tubes of the at least one heat exchanger coil unit:

engaging the first latch bar with the first latch keeper;

determining, using a first sensor, whether the first latch bar is fully engaged with the first latch keeper;

if the first latch bar is fully engaged with the first latch keeper, then permitting activation of the actuator to permit the expansion of the tubes of the at least one heat exchanger coil unit;

if the first latch bar is not fully engaged with the first latch keeper, then deactivating the actuator to prevent the expansion of the tubes of the at least one heat exchanger coil unit;

and before expanding the tubes of the at least one other heat exchanger coil unit:

engaging the second latch bar with the second latch keeper;

determining, using a second sensor, whether the second latch bar is fully engaged with the second latch keeper;

if the second latch bar is fully engaged with the second latch keeper, then permitting activation of the actuator to permit the expansion of the tubes of the at least one other heat exchanger coil unit; and if the second latch bar is not fully engaged with the second latch keeper, then deactivating the actuator to prevent the expansion of the tubes of the at least one other heat exchanger coil unit.

* * * * *